US006285767B1

(12) United States Patent
Klayman

(10) Patent No.: US 6,285,767 B1
(45) Date of Patent: Sep. 4, 2001

(54) LOW-FREQUENCY AUDIO ENHANCEMENT SYSTEM

(75) Inventor: Arnold I. Klayman, Huntington Beach, CA (US)

(73) Assignee: SRS Labs, Inc., Santa Ana, CA (US)

( * ) Notice: Subject to any disclaimer, the term of this patent is extended or adjusted under 35 U.S.C. 154(b) by 0 days.

(21) Appl. No.: 09/148,222

(22) Filed: Sep. 4, 1998

(51) Int. Cl.[7] ..... H04R 5/00

(52) U.S. Cl. ..... 381/17; 381/98; 381/1; 381/106

(58) Field of Search ..... 381/106, 17, 98, 381/1, 18, 61

(56) References Cited

U.S. PATENT DOCUMENTS

| | | | | |
|---|---|---|---|---|
| 1,616,639 | | 2/1927 | Sprague . | |
| 1,951,669 | | 3/1934 | Ramsey . | |
| 2,113,976 | | 4/1938 | Bango . | |
| 2,315,248 | | 3/1943 | De Rosa . | |
| 2,315,249 | | 3/1943 | De Rosa . | |
| 2,461,344 | | 2/1949 | Olson . | |
| 3,398,810 | | 8/1968 | Clark, III . | |
| 3,612,211 | | 10/1971 | Clark, III . | |
| 4,045,748 | | 8/1977 | Filliman . | |
| 4,118,600 | | 10/1978 | Stahl . | |
| 4,182,930 | * | 1/1980 | Blackmer . | |
| 4,481,662 | | 11/1984 | Long et al. . | |
| 4,698,842 | * | 10/1987 | Mackie et al. . | |
| 4,748,669 | | 5/1988 | Klayman . | |
| 4,790,014 | | 12/1988 | Watanabe et al. . | |
| 4,819,269 | | 4/1989 | Klayman . | |
| 4,836,329 | | 6/1989 | Klayman . | |
| 4,841,572 | | 6/1989 | Klayman . | |
| 4,866,774 | | 9/1989 | Klayman . | |
| 5,067,157 | * | 11/1991 | Ishida et al. | 381/13 |
| 5,177,329 | | 1/1993 | Klayman . | |
| 5,251,260 | | 10/1993 | Gates . | |
| 5,319,713 | | 6/1994 | Waller, Jr. et al. . | |
| 5,333,201 | | 7/1994 | Waller, Jr. . | |
| 5,359,665 | * | 10/1994 | Werrbach | 381/102 |
| 5,459,813 | | 10/1995 | Klayman . | |
| 5,638,452 | | 6/1997 | Waller, Jr. . | |
| 5,661,808 | | 8/1997 | Klayman . | |
| 5,668,885 | * | 9/1997 | Oda | 381/98 |

(List continued on next page.)

FOREIGN PATENT DOCUMENTS

| | | |
|---|---|---|
| 0 095 902 A1 | 12/1983 | (EP) . |
| 0 546 619 A2 | 6/1993 | (EP) . |
| 0 729 287 A2 | 2/1995 | (EP) . |
| WO 97/42789 | 11/1997 | (WO) . |
| WO 98/46044 | 10/1998 | (WO) . |

OTHER PUBLICATIONS

Philips Components, "Integrated Circuits Data Handbook: Radio, audio and associated systems, Bipolar, MOS, CA3089 to TDA1510A", Oct. 7, 1987, pp. 103–110.

*Primary Examiner*—Forester W. Isen
*Assistant Examiner*—Brian Tyrone Pendleton
(74) *Attorney, Agent, or Firm*—Knobbe, Martens, Olson & Bear LLP

(57) ABSTRACT

The present invention provides an audio enhancement apparatus and method which spectrally shapes harmonics of the low-frequency information in a pair of audio signals so that when reproduced by a loudspeaker, a listener perceives the loudspeaker as having more acoustic bandwidth than is actually provided by the loudspeaker. The perception of extra bandwidth is particularly pronounced at low frequencies, especially frequencies at which the loudspeaker system produces less acoustic output energy. In one embodiment, the invention also shifts signal from one audio signal to the other audio signal in order to obtain more bandwidth for the available loudspeaker to reduce clipping. In one embodiment, the invention also provides a combined signal path for spectral shaping of the desired harmonics and a feedforward signal path for each pair of audio signals.

42 Claims, 31 Drawing Sheets

U.S. PATENT DOCUMENTS 5,771,295 6/1998 Waller, Jr. .
5,771,296 * 6/1998 Unemura .
5,784,468 7/1998 Klayman .
5,850,453 12/1998 Klayman et al. .
5,872,851 * 2/1999 Petroff ..... 381/18
5,930,373 7/1999 Shashoua et al. .

* cited by examiner

500
SOUND CARD
510
512
514
520
530
528
536
534
526
DAC
FM/WAVETABLE SYNTHESIS
DSP
SOUND ENHANCEMENT PROGRAM
524
525
LEFT
RIGHT
540
550
548
556
554
546
545
544
MUX
522
I/O CNTRL
MAIN MEMORY (PROGRAM DATA)
504
PROCESSOR
502
STORAGE MEDIA
506
508
I/O BUS

LOW-FREQUENCY AUDIO ENHANCEMENT SYSTEM

FIELD OF THE INVENTION

This invention relates generally to audio enhancement systems and methods for improving the realism of sound reproduction. More particularly, this invention relates to apparatus and methods for enhancing the perceived low-frequency content of acoustic energy produced by an acoustic transducer, such as a loudspeaker.

BACKGROUND

The audio and multimedia industries have continually struggled to overcome the imperfections of reproduced sound. For example, it is often difficult to adequately reproduce low-frequency sounds such as bass. Various conventional approaches to improving the output of low-frequency sounds include the use of higher quality speakers with greater cone areas, larger magnets, larger housings, or greater cone excursion capabilities. In addition, conventional systems have attempted to reproduce low-frequency sounds with resonant chambers and horns that match the acoustic impedance of the loudspeaker to the acoustic impedance of free space surrounding the loudspeaker.

Not all systems, however, can simply use more expensive or more powerful speakers to reproduce low-frequency sounds. For example, some conventional sound systems such as compact audio systems and multimedia computer systems rely on small loudspeakers. In addition, to conserve costs, many audio systems use less accurate loudseakers. Such loudspeakers typically do not have the capability to properly reproduce low-frequency sounds and consequently, the sounds are typically not as robust or enjoyable as systems that more accurately reproduce low-frequency sounds.

Some conventional enhancement systems attempt to compensate for poor reproduction of low-frequency sounds by amplifying the low-frequency signals prior to inputting the signals into the loudspeakers. Amplifying the low-frequency signals delivers a greater amount of energy to the loudspeakers, which in turn, drives the loudspeakers with greater forces. Such attempts to amplify the low-frequency signals, however, can result in overdriving the loudspeakers. Unfortunately, overdriving the loudspeakers can increase the background noise, introduce distracting distortions, and damage the loudspeakers.

Still other conventional systems, in an attempt to compensate for the lack of the lower-frequencies, distort the reproduction of the higher frequencies in ways that add undesirable sound coloration.

SUMMARY OF THE INVENTION

The present invention provides a unique apparatus and method that enhances the perception of low-frequency sounds. In loudspeakers that do not reproduce certain low-frequency sounds, the invention creates the illusion that the missing low-frequency sounds do exist. Thus, a listener perceives low frequencies, which are below the frequencies the loudspeaker can actually accurately reproduce. This illusionary effect is accomplished by exploiting, in a unique manner, how the human auditory system processes sound.

One embodiment of the invention exploits how a listener mentally perceives music or other sounds. The process of sound reproduction does not stop at the acoustic energy produced by the loudspeaker, but includes the ears, auditory nerves, brain, and thought processes of the listener. Hearing begins with the action of the ear and the auditory nerve system. The human ear may be regarded as a delicate translating system that receives acoustical vibrations, converts these vibrations into nerve impulses, and ultimately into the "sensation" or perception of sound.

The human ear is known to be non-linear in its response to acoustic energy. This non-linearity of the hearing mechanism produces intermodulation distortion in the form of additional overtones and harmonics, which do not exist in the actual program material. These non-linear effects are particularly pronounced at low frequencies and these effects have a pronounced effect on how low-frequency sounds are perceived.

Advantageously, some embodiments of the invention exploit how the human ear processes overtones and harmonics of low-frequency sounds to create the perception that non-existent low-frequency sounds are being emitted from a loudspeaker. In some embodiments the frequencies in higher-frequency bands are selectively processed to create the illusion of lower-frequency signals. In other embodiments, certain higher-frequency bands are modified with a plurality of filter functions.

In addition, some embodiments of the invention are designed to improve the low-frequency enhancement of popular audio program material, such as music. Most music is rich in harmonics. Accordingly, these embodiments can modify a wide variety of music types to exploit how the human ear processes low-frequency sounds. Advantageously, music in existing formats can be processed to produce the desired effects.

This new approach produces a number of significant advantages. Because a listener perceives low-frequency sounds, which do not actually exist, the need for large speakers, greater cone excursions, or added horns is reduced. Thus, in one embodiment, small loudspeakers can appear as if they are emitting the low-frequency sounds of larger speakers. As can be expected, this embodiment produces the perception of low-frequency audio such as bass, in sound environments that are too small for large loudspeakers. Large loudspeakers are benefited as well, by creating the perception that they are producing enhanced low-frequency sounds.

In addition, with one embodiment of the invention, the small loudspeakers in hand-held and portable sound systems can create a more enjoyable perception of low-frequency sounds. Thus, the listener need not sacrifice low-frequency sound quality for portability.

In one embodiment of the invention, lower-cost speakers create the illusion of low-frequency sounds. Many low-cost loudspeakers cannot adequately reproduce low-frequency sounds. Rather than actually reproducing low-frequency sounds with expensive speaker housings, high performance components and large magnets, one embodiment uses higher frequency sounds to create the illusion of low-frequency sounds. As a result, lower-cost speakers can be used to create a more realistic and robust listening experience.

Furthermore, in one embodiment, the illusion of low-frequency sounds creates a heightened listening experience that increases the realism of the sound. Thus, instead of the reproduction of the muddy or wobbly low-frequency sounds existing in many low-cost prior art systems, one embodiment of the invention reproduces sounds that are perceived to be more accurate and clear. Such low-cost audio and audio-visual devices can include, by way of example, radios, mobile audio systems, computer games, loudspeakers, compact disc (CD) players, digital versatile disc (DVD) players, multimedia presentation devices, computer sound cards, and the like.

In one embodiment, creating the illusion of low-frequency sounds requires less energy than actually reproducing the low-frequency sounds. Thus, systems which operate on batteries or in low-power environments, can create the illusion of low-frequency sounds without consuming as much valuable energy as systems which simply amplify or boost low-frequency sounds.

Other embodiments of the invention create the illusion of lower-frequency signals with specialized circuitry. These circuits are simpler than prior art low-frequency amplifiers and thus reduce the costs of manufacturing. Advantageously, these cost less than prior art sound enhancement devices that add complex circuitry.

Still other embodiments of the invention rely on a microprocessor, which implements the disclosed low-frequency enhancement techniques. In some cases, existing processing audio components can be reprogrammed to provide the disclosed unique low-frequency signal enhancement techniques of one or more embodiments of the invention. As a result, the costs of adding low-frequency enhancement to existing systems is significantly reduced.

In one embodiment, the sound enhancement apparatus receives one or more input signals, from a host system and in turn, generates one or more enhanced output signals. In particular, the two input signals are processed to provide a pair of spectrally enhanced output signals, that when played on a loudspeaker and heard by a listener, produce the sensation of extended bass. In one embodiment, the low-frequency audio information is modified in a different manner than the high-frequency audio information.

In one embodiment, the sound enhancement apparatus receives one or more input signals and generates one or more enhanced output signals. In particular, the input signals comprise waveforms having a first frequency range and a second frequency range. The input signals are processed to provide the enhanced output signals, that when played on a loudspeaker and heard by a listener, produce the sensation of extended bass. In addition, the embodiment may modify information in the first frequency range in a different manner than information in the second frequency range. In some embodiments, the first frequency range may be bass frequencies too low for the desired loudspeaker to reproduce and the second frequency range may be midbass frequencies that the loudspeaker can reproduce.

One embodiment modifies the audio information that is common to two stereo channels in a manner different from energy that is not common to the two channels. The audio information that is common to both input signals is referred to as the combined signal. In one embodiment, the enhancement system spectrally shapes the amplitude of the phase and frequencies in the combined signal in order to reduce the clipping that may result from high-amplitude input signals without removing the perception that the audio information is in stereo.

As discussed in more detail below, one embodiment of the sound enhancement system spectrally shapes the combined signal with a variety of filters to create an enhanced signal. By enhancing selected frequency bands within the combined signal, the embodiment provides a perceived loudspeaker bandwidth that is wider than the actual loudspeaker bandwidth.

One embodiment of the sound enhancement apparatus includes feedforward signal paths for the two stereo channels and four parallel filters for the combined signal path. Each of the four parallel filters comprises a sixth order bandpass filter consisting of three series connected biquad filters. The transfer functions for these four filters are specially selected to provide phase and/or amplitude shaping of various harmonics of the low-frequency content of an audio signal. The shaping unexpectedly increases the perceived bandwidth of the audio signal when played through loudspeakers. In another embodiment, the sixth order filters are replaced by lower order Chebychev filters.

Because the spectral shaping occurs on the combined signal, which is then combined with the stereo information in the feedforward paths, the frequencies in the combined signal can be altered such that both stereo channels are affected, and some signals in certain frequency ranges are coupled from one stereo channel to the other stereo channel. As a result, the preferred embodiment can create enhanced audio sound in an entirely unique, novel, and unexpected manner.

The sound enhancement apparatus may in turn, be connected to one or more subsequent signal processing stages. These subsequent stages may provide improved soundstage or spatial processing. The output signals can also be directed to other audio devices such as recording devices, power amplifiers, loudspeakers, and the like without affecting the operation of the sound enhancement apparatus.

In yet another embodiment, the sound enhancement is provided by a signal processor configured to generate a second set of frequencies from an input signal that has a first set of frequencies. The signal processor may be implemented as hardware, software (e.g., in a Digital Signal Processor), or both. The second set of frequencies is generated so as to create the perception that the second set of frequencies contains at least some of the harmonics of the first set of frequencies. The signal processor uses a zero crossing detector driving a monostable multivibrator to provide a series of pulses. The pulses are created by zero crossings of the input signal corresponding to the first set of frequencies. The signal processor generates the second set of frequencies by delivering the series of pulses to a collection of bandpass filters.

In yet another embodiment, the sound enhancement is provided by a signal processor configured to process the input signal through a collection of bandpass filters. The outputs of selected bandpass filters are combined to produce a combined signal. The combined signal is provided to an input signal to an expander, such as an automatic gain control (AGC) amplifier. The AGC amplifier has a control input that sets the output level of the amplifier. The control input is set in response to the envelope of the combined signal.

In yet another embodiment, the combined signal is provided to a peak compressor rather than to the expander. An output of the peak compressor is provided to the input of the expander.

In some embodiments, input signals are combined to produce a combined signal, which is then enhanced to produce an enhanced combined signal. The enhanced combined signal is then combined with each of the original input signals to produce the output signals. In other embodiments, the input signals are not combined, but kept separate. The separate input signals are each enhanced separately to produce enhanced output signals. The same signal processing may be used to enhance the combined signal or the separate input signals.

BRIEF DESCRIPTION OF THE DRAWINGS

These and other aspects, advantages, and novel features of the invention will become apparent upon reading the following detailed description and upon reference to the accompanying drawings.

DETAILED DESCRIPTION OF THE PREFERRED EMBODIMENT

The present invention provides a method and system for enhancing audio signals. The sound enhancement system improves the realism of sound with a unique sound enhancement process. Generally speaking, the sound enhancement process receives two input signals, a left input signal and a right input signal, and in turn, generates two enhanced output signals, a left output signal and a right output signal.

The left and right input signals are processed collectively to provide a pair of left and right output signals. In particular, the enhanced system embodiment equalizes the differences that exist between the two input signals in a manner which broadens and enhances the perceived bandwidth of the sounds. In addition, many embodiments adjust the level of the sound that is common to both input signals so as to reduce clipping. Advantageously, some embodiments achieve sound enhancement with simplified, low cost, and easy-to-manufacture analog circuits that do not require digital signal processing.

Although the embodiments are described herein with reference to a preferred sound enhancement system, the invention is not so limited, and can be used in a variety of other contexts in which it is desirable to adapt different embodiments of the sound enhancement system to different situations.

Overview Of A Sound Enhancement System

Figure 1:
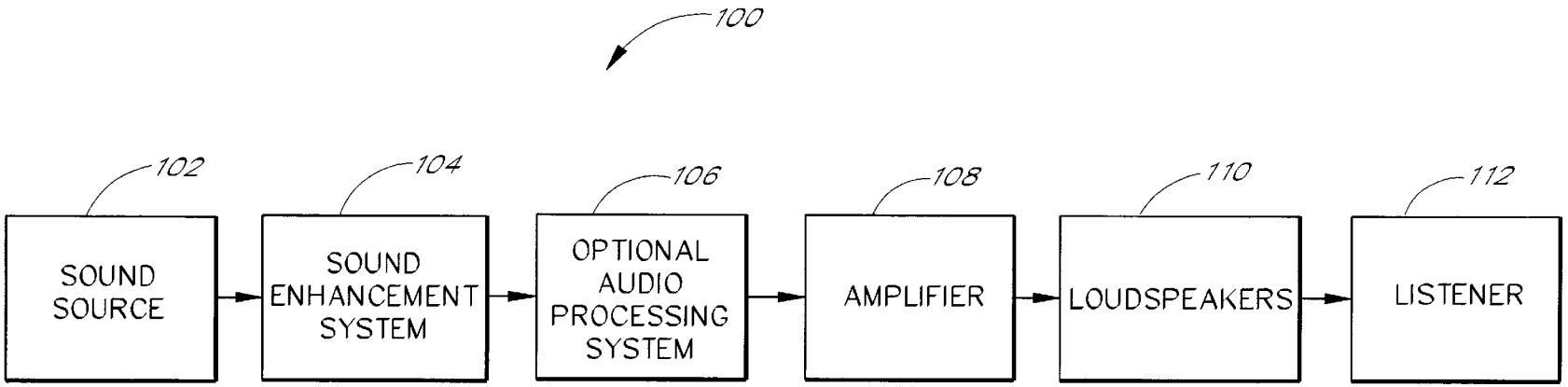
FIG. 1 is a block diagram of an audio system appropriate for use with the present invention.

FIG. 1 is a block diagram of a sound enhancement system 100 comprising a sound enhancement system 104. The sound enhancement system 100 includes a sound source 102, the sound enhancement system 104, an optional signal processing system 106, an optional amplifier 108, loudspeakers 110, and a listener 112. An output of the sound source 102 is provided to an input of the sound enhancement system 104. An output of the sound enhancement system 104 is provided to an input of the optional signal processing system 106. An output of the optional signal processing system 106 is provided to an input of an amplifier system 108. An output of the amplifier system 108 is provided to an input of a loudspeaker system 110. An acoustic output of the loudspeaker system 110 is provided to one or more listeners 112.

The signal source 102 can include, by way of example, a stereo receiver, radio, compact disc player, video cassette recorder (VCR), audio amplifiers, theater systems, televisions, laser disc players, digital versatile disc (DVD) players, devices for recording and playback of prerecorded audio, multimedia devices, computer games and the like. While the signal source 102 typically generates a set of stereo signals, it should be understood that the signal source 102 is not limited to stereo signals. Thus, in other embodiments, the signal source 102 can generate a wide variety of audio signals such as audio systems that generate monophonic or multi-channel signals.

The signal source 102 provides one or more signals (e.g., left and right stereo channels) to the sound enhancement system 104. The sound enhancement system 104 enhances the low-frequency audio information through modification of the left and right channels. In other embodiments, the left and right channel input signals need not be stereo signals and can include a wide range of audio signals, such as a Dolby Laboratories Pro-Logic system which uses a matrixing scheme to store four or more separate audio channels on just two audio recording tracks. The audio signals can also include surround sound systems, which can deliver completely separate forward and rear audio channels. One such system is Dolby Laboratories five-channel digital system dubbed "AC-3."

In one embodiment, audio information comprising the sum of left and right channels is referred to as the combined information, or the combined signal. One embodiment shapes the spectral harmonics of the frequencies in the combined signal, and then inserts portions of the shaped combined signal back into the left and right channels in order to reduce the clipping which may result from low-frequency, high-amplitude input signals in one channel or the other.

The optional audio processing system 106 may provide other audio processing including, for example, decoding, encoding, equalizing, surround-sound processing, etc. The amplifier system 108 amplifies one or more channels and provides the amplified signals to the loudspeaker system 110. The loudspeaker system includes one or more loudspeakers.

Figure 2:
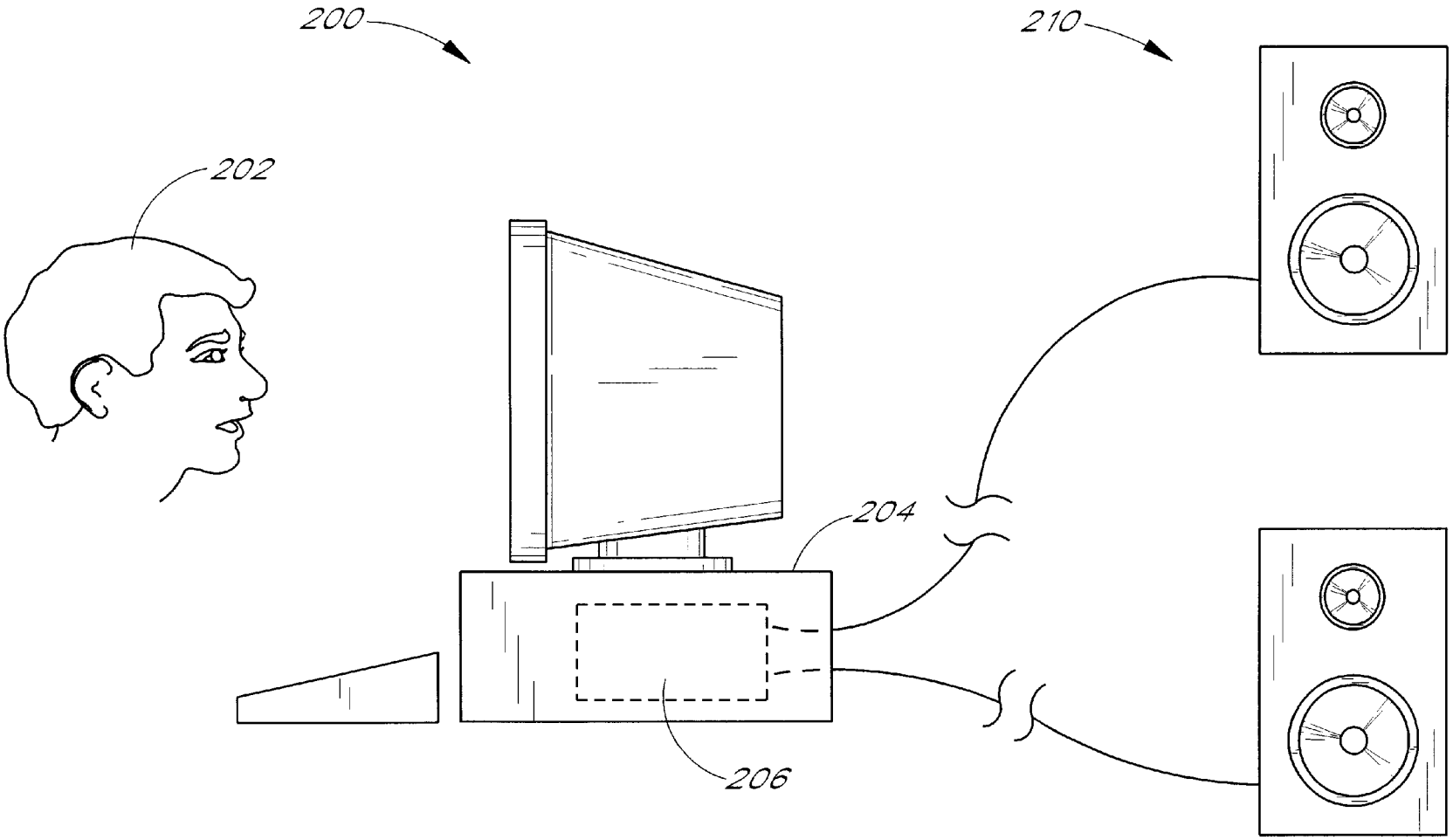
FIG. 2 is a block diagram of a multimedia computer system having a sound card and loudspeakers.

FIG. 2 illustrates a typical multimedia computer system 200 which may advantageously use an embodiment of the present invention to improve the audio performance produced by a pair of small desktop computer loudspeakers 210. The loudspeakers 210 are connected to a plug-in card 206 inside a computer unit 204. The plug-in card 206 will typically be a sound card such as the sound card shown in FIG. 5, but may also be any computer interface card that produces audio output, including a radio card, television tuner card, PCMCIA card, internal modem, plug-in Digital Signal Processor (DSP) card, etc. A computer user 202 uses the computer 204 to run a computer program that causes the plug-in card 206 to generate audio signals that are converted by the loudspeakers 210 into acoustic waves.

Figure 3:
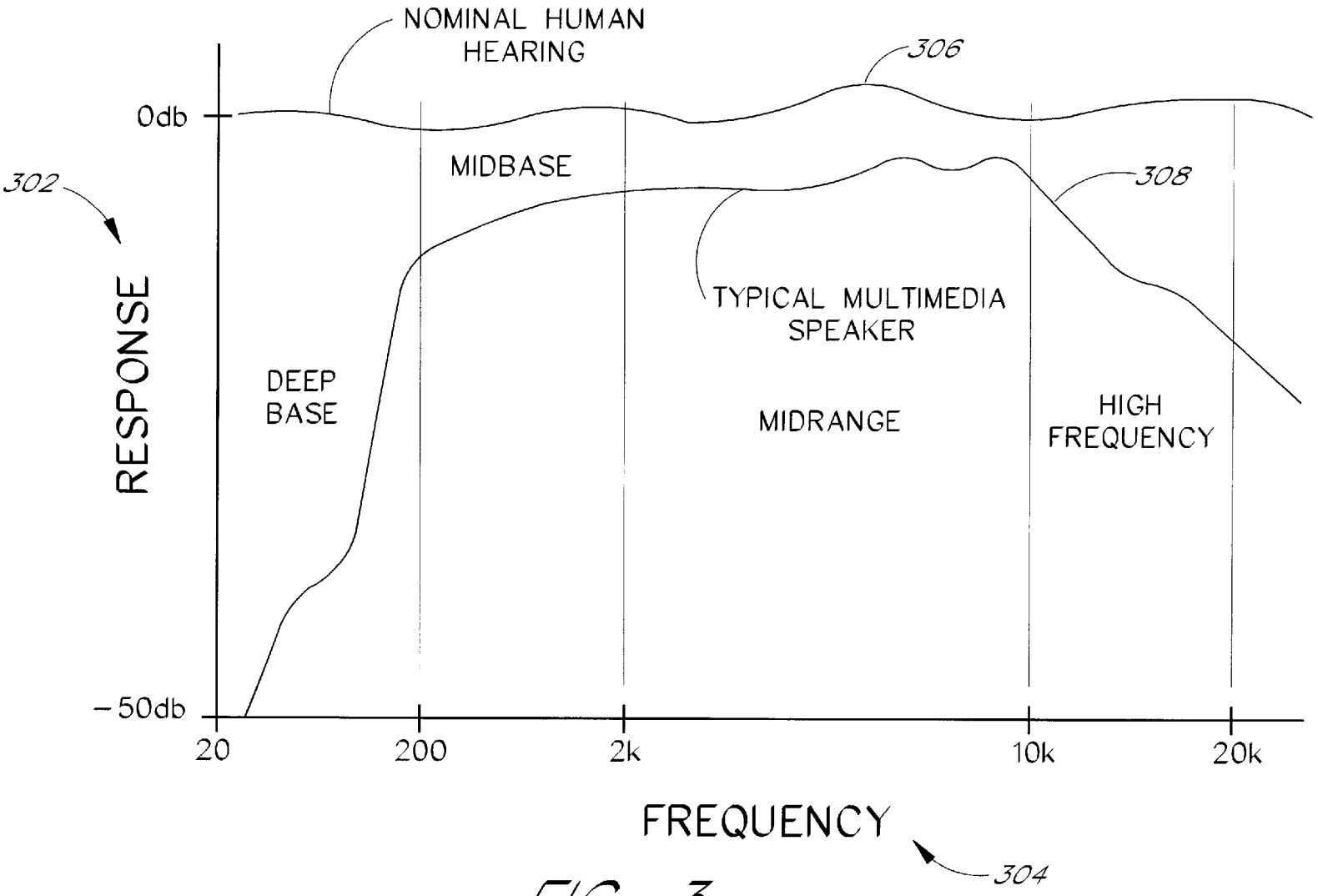
FIG. 3 is a plot of the frequency response of a typical small loudspeaker system.

The loudspeakers 210 used by a multimedia computer system are typically small desktop units that are designed to be small and inexpensive, and therefore do not have the capability to produce significant sound pressure levels at low frequencies. A typical small loudspeaker system used for multimedia computers will have an acoustic output response that rolls off at about 200 Hz. FIG. 3 shows a curve 306 corresponding approximately to the frequency response of the human ear. FIG. 3 also shows the measured response 308 of a typical small computer loudspeaker system that uses a high-frequency driver (tweeter) to reproduce the high frequencies, and a four inch midrange-bass driver (woofer) to reproduce the midrange and bass frequencies. Such a system employing two drivers is often called a two-way system. Loudspeaker systems employing more than two drivers are known in the art and will work with an embodiment of the present invention. Loudspeaker systems with a single driver are also known and will also work with the present invention. The response 308 is plotted on a rectangular plot with an X-axis showing frequencies from 20 Hz to 20 kHz. This frequency band corresponds to the range of normal human hearing. The Y-axis in FIG. 3 shows normalized amplitude response from 0 dB to −50 dB. The curve 308 is relatively flat in a midrange frequency band from approximately 2 kHz to 10 kHz, showing some rolloff above 10 kHz. In the low frequency ranges, the curve 308 exhibits a low-frequency rolloff that begins in a midbass band between approximately 200 Hz and 2 kHz such that below 200 Hz, the loudspeaker system produces very little acoustic output.

The location of the frequency bands shown in FIG. 3 are used by way of example and not by way of limitation. The actual frequency ranges of the deep bass band, midbass band, and midrange band vary according to the loudspeaker and the application for which the loudspeaker is used. The term deep bass is used, generally, to refer to frequencies in a band where the loudspeaker produces an output that is less accurate as compared to the loudspeaker output at higher frequencies, such as, for example, in the midbass band. The term midbass band is used, generally, to refer to frequencies above the deep bass band. The term midrange is used, generally, to refer to frequencies above the midbass band.

Many cone-type drivers are very inefficient when producing acoustic energy at low frequencies where the diameter of the cone is less than the wavelength of the acoustic sound wave. When the cone diameter is smaller than the wavelength, maintaining a uniform sound pressure level of acoustic output from the cone requires that the cone excursion be increased by a factor of four for each octave (factor of 2) that the frequency drops. The maximum allowable cone excursion of the driver is quickly reached if one attempts to improve low-frequency response by simply boosting the electrical power supplied to the driver.

Thus, the low-frequency output of a driver cannot be increased beyond a certain limit, and this explains the poor low-frequency sound quality of most small loudspeaker systems. The curve 308 is typical of most small loudspeaker systems that employ a low-frequency driver of approximately four inches in diameter. Loudspeaker systems with larger drivers will tend to produce appreciable acoustic output down to frequencies somewhat lower than those shown in the curve 308, and systems with smaller low-frequency drivers will typically not produce output as low as that shown in the curve 308.

As discussed above, to date, a system designer has had little choice when designing loudspeaker systems with extended low-frequency response. Previously known solutions were expensive and produced loudspeakers that were too large for the desktop. One popular solution to the low-frequency problem is the use of a sub-woofer, which is usually placed on the floor near the computer system. Sub-woofers can provide adequate low-frequency output, but they are expensive, and thus relatively uncommon as compared to inexpensive desktop loudspeakers.

Rather than use drivers with large diameter cones, or a sub-woofer, an embodiment of the present invention overcomes the low-frequency limitations of small systems by using characteristics of the human hearing system to produce the perception of low-frequency acoustic energy, even when such energy is not produced by the loudspeaker system.

The human auditory system is known to be non-linear. A non-linear system is, simply put, a system where an increase in the input is not followed by a proportional is increase in the output. Thus, for example, in the ear, a doubling of the acoustic sound pressure level does not produce a perception that the volume of the sound source has been doubled. In fact, the human ear is, to a first approximation, a square-law device that is responsive to power rather than intensity of the acoustic energy. This non-linearity of the hearing mechanism produces intermodulation frequencies that are heard as overtones or harmonics of the actual frequencies in the acoustic wave.

Figure 4A:
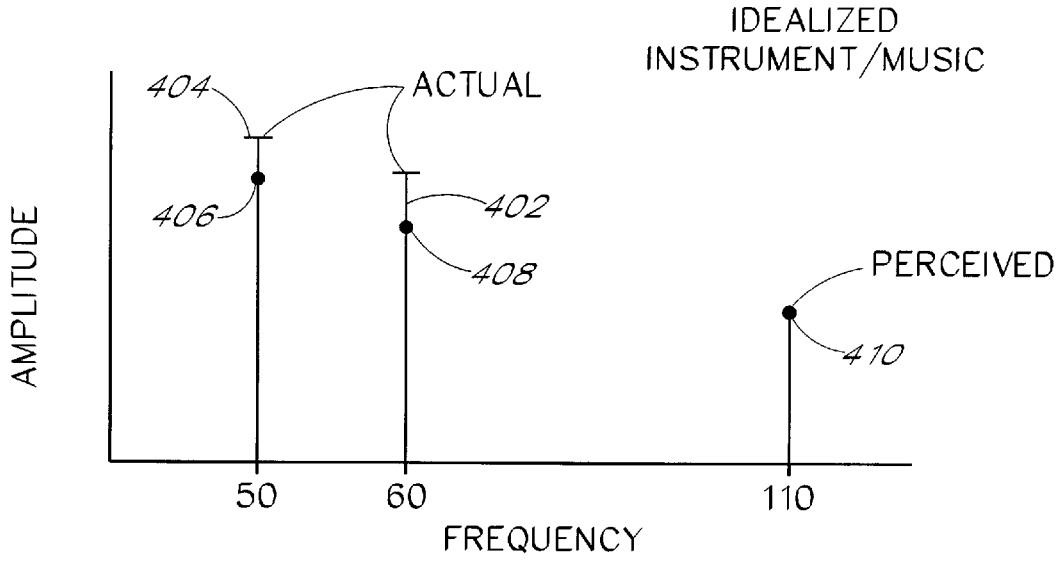
FIG. 4A illustrates the actual and perceived spectrum of a signal represented by two discrete frequencies.

The intermodulation effect of the non-linearities in the human ear is shown in FIG. 4A, which illustrates an idealized amplitude spectrum of two pure tones. The spectral diagram in FIG. 4A shows a first spectral line 404 which corresponds to acoustic energy produced by a loudspeaker driver (e.g., a sub-woofer) at 50 Hz. A second spectral line 402 is shown at 60 Hz. The lines 404 and 402 are actual spectral lines corresponding to real acoustic energy produced by the driver, and no other acoustic energy is assumed to exist. Nevertheless, the human ear, because of its inherent non-linearities, will produce intermodulation products corresponding to the sum of the two actual spectral frequencies and the difference between the two spectral frequencies.

For example, a person listening to the acoustic energy represented by the spectral lines 404 and 402 will perceive acoustic energy at 50 Hz, as shown by the spectral line 406, at 60 Hz, as shown by the spectral line 406, and at 110 Hz, as shown by the spectra line 410. The spectral line 410 does not correspond to real acoustic energy produced by the loudspeaker, but rather corresponds to a spectral line created inside the ear by the non-linearities of the ear. The line 410 occurs at a frequency of 110 Hz which is the sum of the two actual spectral lines (110 Hz=50 Hz+60 Hz). Note that the non-linearities of the ear will also create a spectral line at the difference frequency of 10 Hz (10 Hz=60 Hz−50 Hz), but that line is not perceived because it is below the range of human hearing.

Figure 4B:
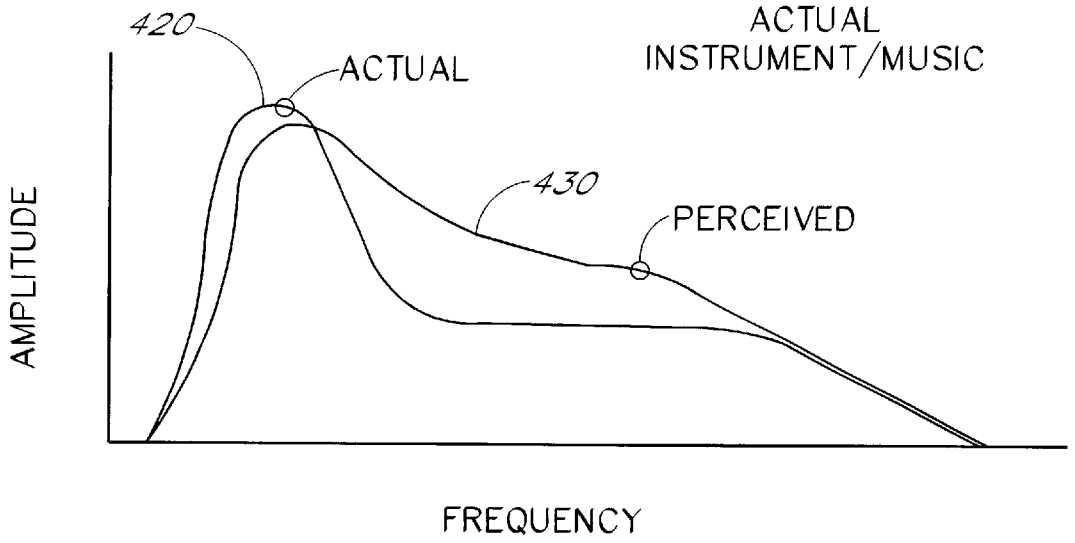
FIG. 4B illustrates the actual and perceived spectrum of a signal represented by a continuous spectrum of frequencies.

FIG. 4A illustrates the process of intermodulation inside the human ear, but it is somewhat simplified when compared to real program material, such as music. Typical program material such as music is rich in harmonics, so much so that most music exhibits an almost continuous spectrum, as shown in FIG. 4B. FIG. 4B shows the same type of comparison between actual and perceived acoustic energy, as shown in FIG. 4A, except that the curves in FIG. 4B are shown for continuous spectra. FIG. 4B shows an actual acoustic energy curve 420 and the corresponding perceived spectrum 430.

As with most non-linear systems, the non-linearity of the ear is more pronounced when the system is making large excursions (e.g., large signal levels) than for small excursions. Thus, for the human ear, the non-linearities are more pronounced at low frequencies, where the eardrum and other elements of the ear make relatively large mechanical excursions, even at lower volume levels. Thus, the FIG. 4B shows that the difference between actual acoustic energy 420, and the perceived acoustic energy 430 tends to be greatest in the lower-frequency range and becomes relatively smaller at the higher-frequency range.

As shown in FIGS. 4A and 4B, low-frequency acoustic energy comprising multiple tones or frequencies will produce, in the listener, the perception that the acoustic energy in the midbass range contains more spectral content than actually exists. The human brain, when faced with a situation where information is thought to be missing, will attempt to "fill in" missing information on a subconscious level. This filling in phenomenon is the basis for many optical illusions. In an embodiment of the present invention, the brain can be tricked into filling in low-frequency information that is not really present by providing the brain with the midbass effects of such low-frequency information.

In other words, if the brain is presented with the harmonics that would be produced by the ear if the low-frequency acoustic energy was present (e.g., the spectral line 410) then under the right conditions, the brain will subconsciously fill in the low-frequency spectral lines 406 and 408 which it think "must" be present. This filling in process is augmented by another effect of the non-linearity of the human ear known as the detector effect.

Figure 4D:
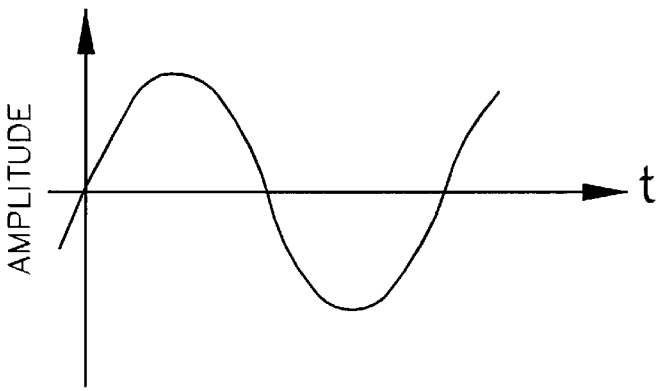
FIG. 4D illustrates the time waveform of FIG. 4C after detection by a detector.
Figure 4C:
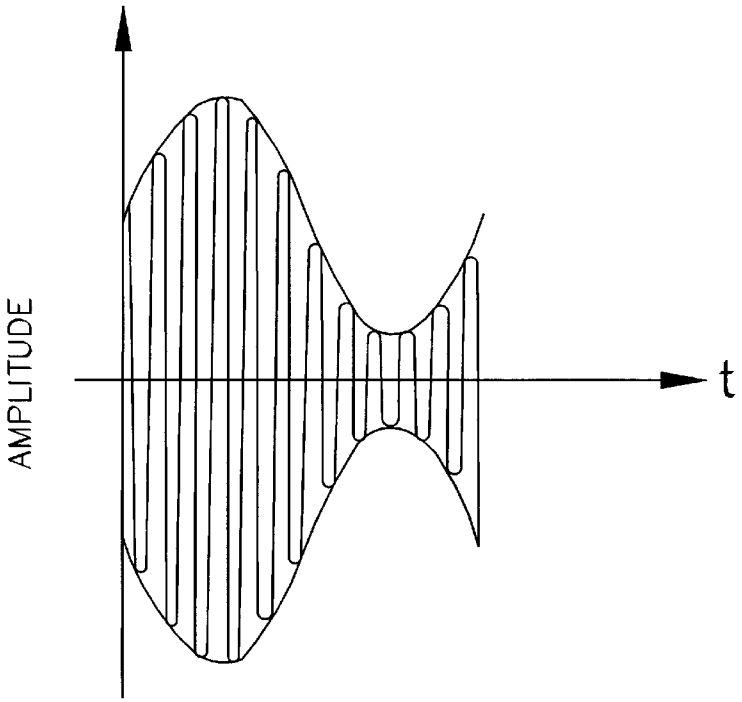
FIG. 4C illustrates a time waveform of a modulated carrier.

The non-linearity of the human ear also causes the ear to act like a detector, similar to a diode detector in an Amplitude Modulation (AM) receiver. If a midbass harmonic tone is AM modulated by a deep bass tone, the ear will demodulate the modulated midbass carrier to reproduce the deep bass envelope. FIGS. 4C and 4D graphically illustrate the modulated and demodulated signal. FIG. 4C shows, on a time axis, a modulated signal comprising a higher-frequency carrier signal (e.g. the midbass carrier) modulated by a deep bass signal.

The amplitude of the higher-frequency signal is modulated by a lower frequency tone, and thus, the amplitude of the higher-frequency signal varies according to the frequency of the lower frequency tone. The non-linearity of the ear will partially demodulate the signal such that the ear will detect the low-frequency envelope of the higher-frequency signal, and thus produce the perception of the low-frequency tone, even though no actual acoustic energy was produced at the lower frequency. As with the intermodulation effect discussed above, the detector effect can be enhanced by proper signal processing of the signals in the midbass frequency range, typically between 100–200 Hz on the low end of the range and 500 Hz on the high end of the range. By using the proper signal processing, it is possible to design a sound enhancement system that produces the perception of low-frequency acoustic energy, even when using loudspeakers that are incapable of, or inefficient at, producing such energy.

The perception of the actual frequencies present in the acoustic energy produced by the loudspeaker may be deemed a first order effect. The perception of additional harmonics not present in the actual acoustic frequencies, whether such harmonics are produced by intermodulation distortion or detection, may be deemed a second order effect.

Before describing the details of the actual signal processing used in a sound enhancement system, it is helpful to examine several implementations of the system. The sound enhancement system is not limited to multimedia computer systems and may be used with many sources of audio signals and many different types of loudspeakers, including, for example, boom-boxes, mini-component stereo systems, television systems, radios, and even larger speakers intended for home or commercial use. However, the popularity of multimedia computer systems with inadequate loudspeakers, and the possibility of implementing the sound enhancement system as a software upgrade to the multimedia computer, makes the multimedia computer and other inexpensive systems a attractive platforms for several embodiments of the present invention.

Figure 5:
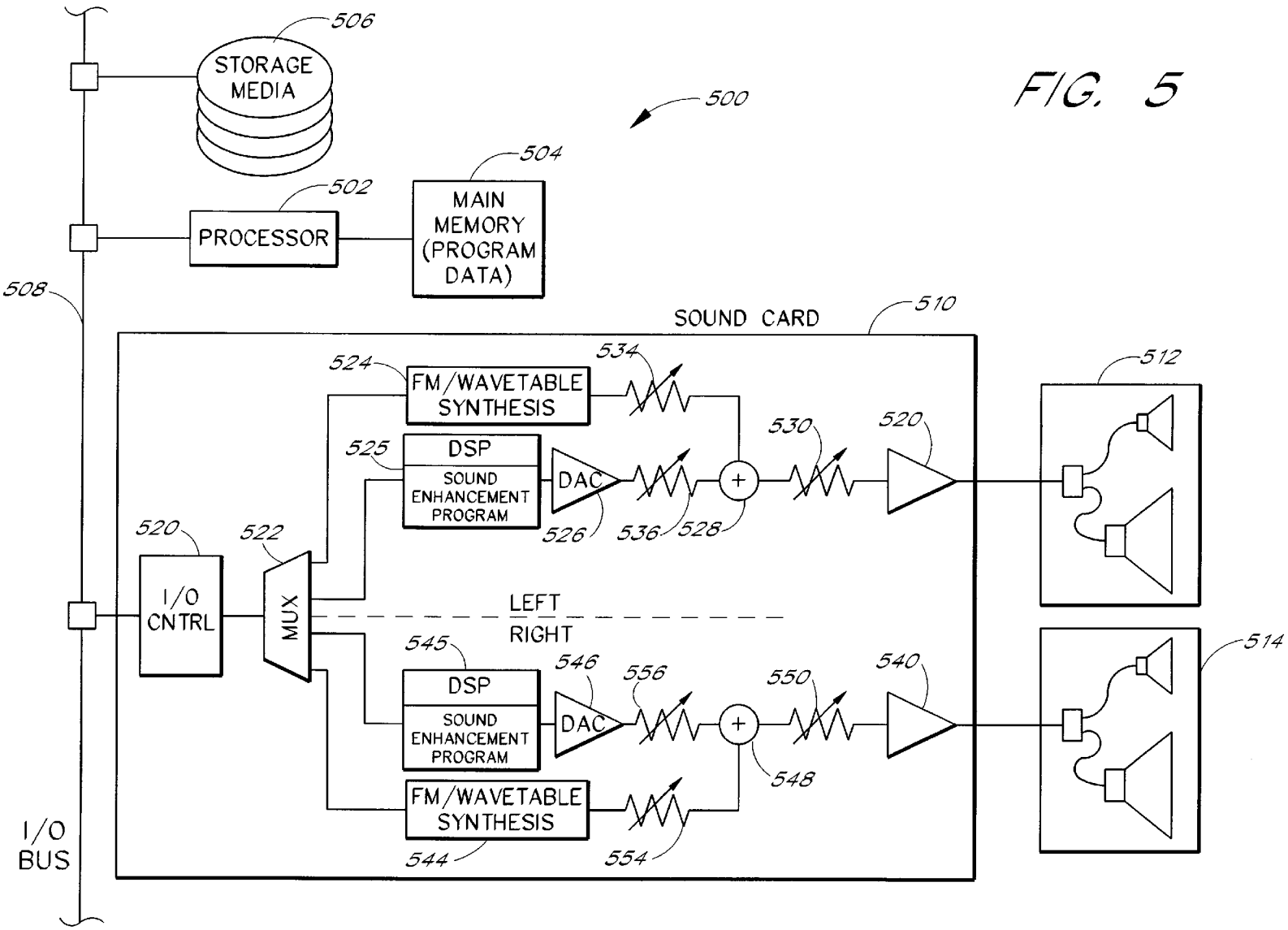
FIG. 5 is a block diagram of a typical computer system including a sound card and loudspeakers.

FIG. 5 is a block diagram illustrating a typical multimedia computer system 500 having a sound card 510, a first loudspeaker system 512, and a second loudspeaker system 514. The computer system 500 comprises a data storage medium 506, a processor 502, and the sound card 510, all connected to an input/output (I/O) bus 508. A main memory 504 for storing programs and data is typically connected to the processor 502 by a separate memory bus. The sound card 510 comprises an I/O control module 520 which is connected to the data bus 508 and provides the necessary functionality to communicate with the data bus 508. Within the sound card 510, a bi-directional data path connects the I/O control module 520 to a data router 522, which provides multiplexing and demultiplexing of data from the various internal data paths of the sound card and the I/O control module 520.

A first output of the router 522 provides data to a first synthesis module 524 which generates sounds, usually by either FM synthesis or wavetable synthesis. An output of the first synthesis module 524 is fed through a first gain control 534 to a first mixer (adder) 528. A second output of the router 522 provides data to an input of a first Digital Signal Processor (DSP) 525. An output of the first DSP 525 is provided to an input of a first digital-to-analog converter (DAC) 526. The DSP 525 is optional and not found on all sound cards. On cards without the DSP 525, an output of the router 522 may be connected directly to the input of the first digital-to-analog converter 526. An output of the first DAC 526 is connected through a gain control 536 to an input of the mixer 528. An output of the mixer 528 is connected through a gain control 530 to a first power amplifier 520. An output of the first power amplifier 520 is provided to the loudspeaker system 512.

A third output of the router 522 provides data to a second synthesis module 544. An output of the second synthesis module 544 is fed through a gain control 554 to a second mixer 548. A third output of the router 522 provides data to an input of a second Digital Signal Processor (DSP) 545. An output of the second DSP 545 is provided to an input of a second DAC 526. The DSP 545 is optional, and if not provided, an output of the router 522 may be connected directly to the input of the second DAC converter 546. In some sound cards, a single DSP, which combines the DSP 525 and the DSP 545, may be provided. An output of the second DAC 546 is connected through a gain control 556 to an input of the mixer 548. An output of the mixer 548 is connected through a gain control 550 to a second power amplifier 540. An output of the power amplifier 540 is provided to the loudspeaker system 514.

The internal structure of the sound card 510 has been simplified to more effectively illustrate the use of the sound card to implement various embodiments and features of the present invention. The sound card may also have additional capabilities such as inputs connected to analog-to-digital converters (ADCs) (not shown) to allow a user to produce sampled digital data from an analog audio source. The sound card 510 may also provide input/output ports for connecting to joysticks, and MDI input/output ports for connecting to musical instruments that have MIDI ports. The sound card 510 may also provide a line input port and a line output port, as well as input ports for audio input from devices such as CD players and Digital Audio Tape (DAT) drives. The sound card 510 may also provide DSP capabilities for programming the action of the synthesizers 524 and 544. The synthesizers 524 and 544 may be programmed by using the DSPs 525 and 544 or the sound card 510 may provide other DSP resources for programming the action of the synthesizers 524 and 544. Some embodiments of the present invention may comprise software that runs on the DSP processors provided by the sound card 510, as shown in FIG. 5. Alternatively, the entire sound card functionality may be realized in a single chip, such as a digital signal processor found on the motherboard of a personal computer, and connected directly to a data bus, memory bus, multimedia bus, Universal Serial Bus, FireWire Bus, or other Input/Output bus.

A multimedia program loaded into the memory 504 and running on the processor 502 uses the sound card 510 to generate audio signals which are converted into sounds (acoustic energy) by the loudspeakers 512 and 514. Audio signals may be generated by sending commands to the synthesizers 524 and 544. Audio signals generated by the first synthesizer 524 are passed through the gain control stage 534, to the mixer 528, through the gain control 530, through the power amplifier 520 and subsequently turned into acoustic energy by the loudspeaker 512. A similar signal processing path, comprising the gain controls 556 and 550, the mixer 548 and the power amplifier 540 is provided for audio signals generated by the second synthesizer 544.

A multimedia program may also generate audio signals from digitized audio data by direct digital-to-analog conversion using the DACs 526 and 546. Digitized audio data may be stored on the storage media 506, or in the main memory 504. The storage media 506 may be any apparatus for storing data, including a disk drive, Compact Disc (CD), DVD, DAT drive, etc. Digitized audio data stored on the storage medium may be stored in any raw form, including Pulse Code Modulation (PCM), or any compressed form, including Adaptive Pulse Code Modulation (ADPCM). Digitized audio data stored on a hard disk or other storage medium (e.g., a CD-ROM) that provides a file system under the Microsoft Windows operating environment is generally stored in a file format known to those skilled in the art as a "wave" file having a file name *.wav (where the "*" indicates a wildcard file name).

Figure 6A:
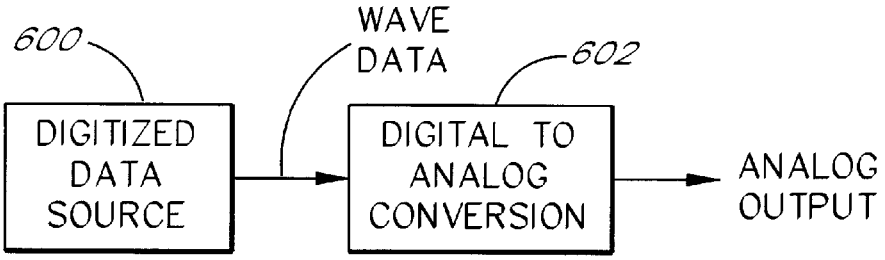
FIG. 6A (PRIOR ART)
FIG. 6A is a block diagram of a digital sound system.

FIG. 6A is a block diagram that illustrates the process of creating sounds from a digital source 600. The digital source 600 may be any source of digitized audio including, by way of example, an analog-to-digital converter, DSP, compact disc player, laser disc players, digital versatile disc (DVI)D) players, devices for recording and playback of prerecorded audio, multimedia devices, computer programs, wave files, computer games and the like. Digital data is provided by the digital source 600 to a digital-to-analog converter 602, which converts the digital data into an output analog signal. The converter 602 provides the output analog signal to other analog devices such as power amplifiers, loudspeakers, other signal processors, etc.

Figure 6B:
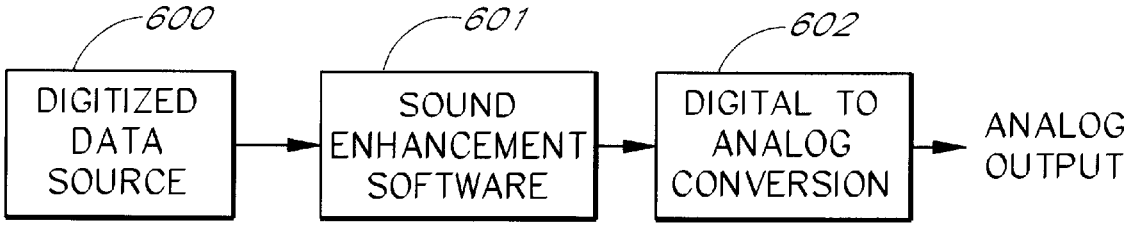
FIG. 6B is a block diagram of a digital sound system with sound enhancement processing.

FIG. 6B is a block diagram that illustrates a sound enhancement system in accordance with one embodiment of the present invention. In the FIG. 6B, data from the digital source 600 is provided to a sound enhancement block 601 which performs signal processing on the digitized sound to modify the digitized sounds to improve the perceived low-frequency response of a loudspeaker. The modified digital data from the sound enhancement block 601 is provided to the digital-to-analog conversion block 602 where the digital data is converted into analog signals. The analog signals from the block 602 are provided to other analog devices such as loudspeakers, power amplifiers, or other signal processing devices. Implementation of the signal processing in the block 601 may be provided by a general purpose digital computer, such as the processor 502, or by a DSP, such as the DSPs 525 and 545.

For example, the processing may be accomplished with software loaded into a computer's memory, with a DSP manufactured by Texas Instruments Inc. (such as the TMS320xx series), with DSPs provided by other manufacturers, with multimedia processors such as the MPACT multimedia processor supplied by Chromatic Research Inc. or with processors such as a Pentium processor, a Pentium Pro processor, an 8051 processor, a MIPS processor, a Power PC processor, an ALPHA processor, etc.

In one embodiment, the signal processing block 601 is implemented wholly in software on the processor 502. Digital data (e.g. data from a wave file) produced by a computer program running on the processor 502 is provided to a separate signal processing program which provides the functionality represented by the block 601. The separate signal processing program modifies the digital data and provides the modified digital data to the digital-to-analog converter block 602 which may be part of the sound card 510. This pure software embodiment provides a low cost method for a user on a multimedia computer system, such as the user 202 shown in FIG. 2, to extend the apparent low-frequency response of the loudspeakers attached to the multimedia computer.

In an alternative software embodiment, the processing represented by the block 601 is provided by a DSP in a sound card attached to a computer. Thus, for example, the processing represented by the signal processing block 601 may be implemented by the DSP 525 and the DSP 545 in the sound card 510 shown in FIG. 5. The functionality represented by the DSP 525 and the DSP 545 may be combined in a single DSP. Software embodiments of the present invention are attractive because they can be implemented at little cost.

Figure 7:
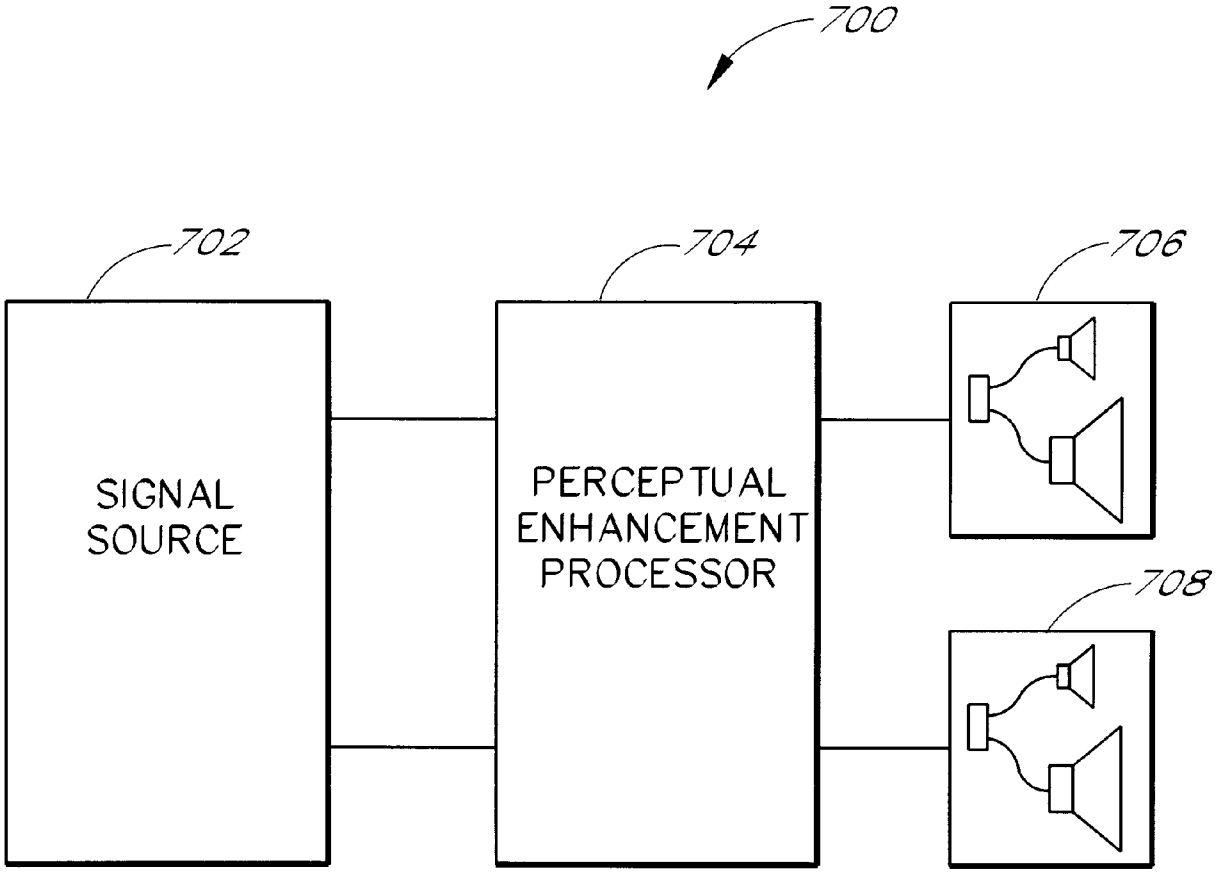
FIG. 7 is a block diagram of a hardware embodiment of the present invention wherein the sound enhancement function is provided by a sound enhancement unit

However, hardware embodiments are also within the scope of the present invention. FIG. 7 is a block diagram of a hardware embodiment of the present invention wherein the sound enhancement function is provided by a sound enhancement unit 704. The sound enhancement unit 704 receives audio signals from a signal source 702. The signal source 702 may be any signal source, including the signal source 102 shown in FIG. 1, or the sound card 510 shown in FIG. 5. The sound enhancement unit 704 performs signal processing to modify the received audio signals in and produces audio outputs which may be provided to loudspeakers, amplifiers, or other signal processing devices.

Signal Processing

Figure 8:
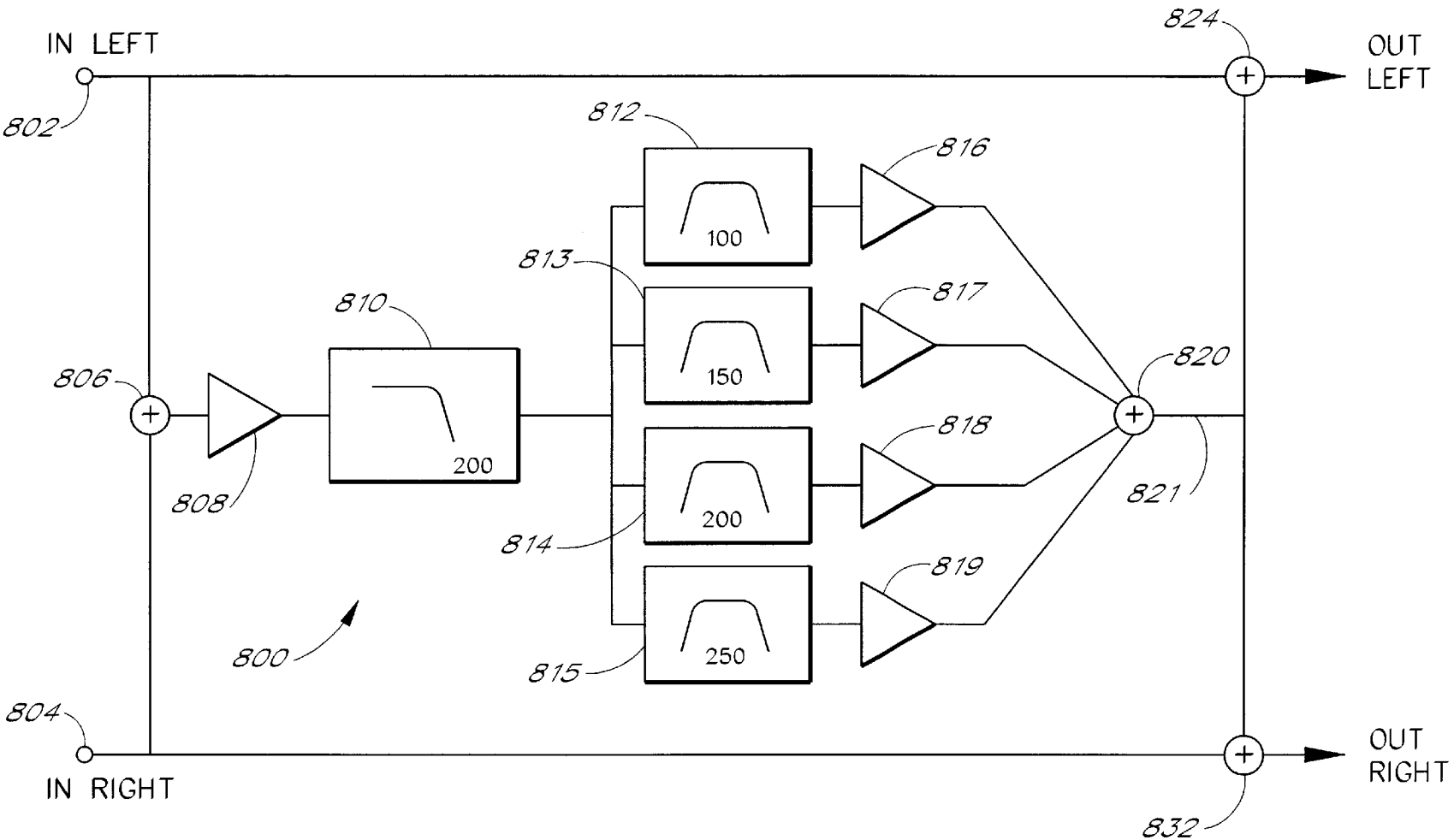
FIG. 8 illustrates one embodiment of the signal processing used to shape the spectrum of an input signal to enhance the perception of low-frequency sounds.

FIG. 8 is a block diagram 800 of one embodiment of the low-frequency enhancement signal processing performed by the various signal processing blocks such as the sound enhancement unit 704 shown in FIG. 7, the sound enhancement block 601 shown in FIG. 6B, and the sound enhancement system 104 shown in FIG. 1. FIG. 8 may also be used as a flowchart to describe a program running on a DSP or other processor which implements the signal processing operations of an embodiment of the present invention.

FIG. 8 shows two inputs, a left-channel input 802 and a right-channel input 804. The two channels of signal processing shown in FIG. 8 will be conveniently described in terms of a left channel and a right channel in accordance with normal stereo left and right channels, however, the invention is not so limited and includes systems with more than two channels and systems in which the channels do not correspond to stereo left and right channels.

The inputs 802 and 804 are both provided to an adder 806 which produces an output that is a combination of the two inputs, the combination being the linear sum of the two inputs. An output of the adder 806 is provided to an amplifier 808. The gain of the amplifier 808 can be adjusted to a desired value. The adder 806 and the amplifier 808 can also be combined into a single summing amplifier that provides summing of the two inputs and gain.

An output of the amplifier 808 is provided to a lowpass filter 810. An output of the lowpass filter 810 is provided to a first bandpass filter 812, a second bandpass filter 813, a third bandpass filter 814, and a fourth bandpass filter 815. The output of each bandpass filter 812–815 is provided to an input of an amplifier 816–819 respectively, such that each bandpass filter drives one amplifier. An output of each of the amplifiers 816–819 is connected to an adder 820 which produces an output that is the sum of the outputs of the amplifiers.

The output of the amplifier 820 is provided to a first input of a left-channel adder 824 and the output of the amplifier 820 is provided to a first input of a right-channel adder 832. The left-channel input 802 is provided to a second input of the left-channel adder 824 and the right-channel input 804 is provided to a second input of the right-channel adder 832. The outputs of the left-channel adder 824, and the right-channel adder 832 are, respectively, the left and right-channel outputs of the signal processing block diagram 800.

The rolloff frequency and rate of the lowpass filter 810 are chosen to provide a suitable number of midbass harmonics above the lowest frequency that can reasonably be produced by the multimedia speakers. The bandpass filters 812–815 are chosen to shape the spectrum of the signal produced by the lowpass filter 810 in order to emphasize the harmonics of the low-frequency signals that will not be adequately reproduced by the loudspeakers. In one embodiment, the lowpass filter 810 is a second order Chebychev filter, having a rolloff of 12 dB/octave and a rolloff frequency of 200 Hz. Typically the bandpass filters will be stagger-tuned to frequencies of 100 Hz, 150 Hz, 200 Hz, and 250 Hz. In one embodiment, the bandpass filters 812–815 are second order Chebychev filters implemented as shown in FIG. 9.

Figure 9:
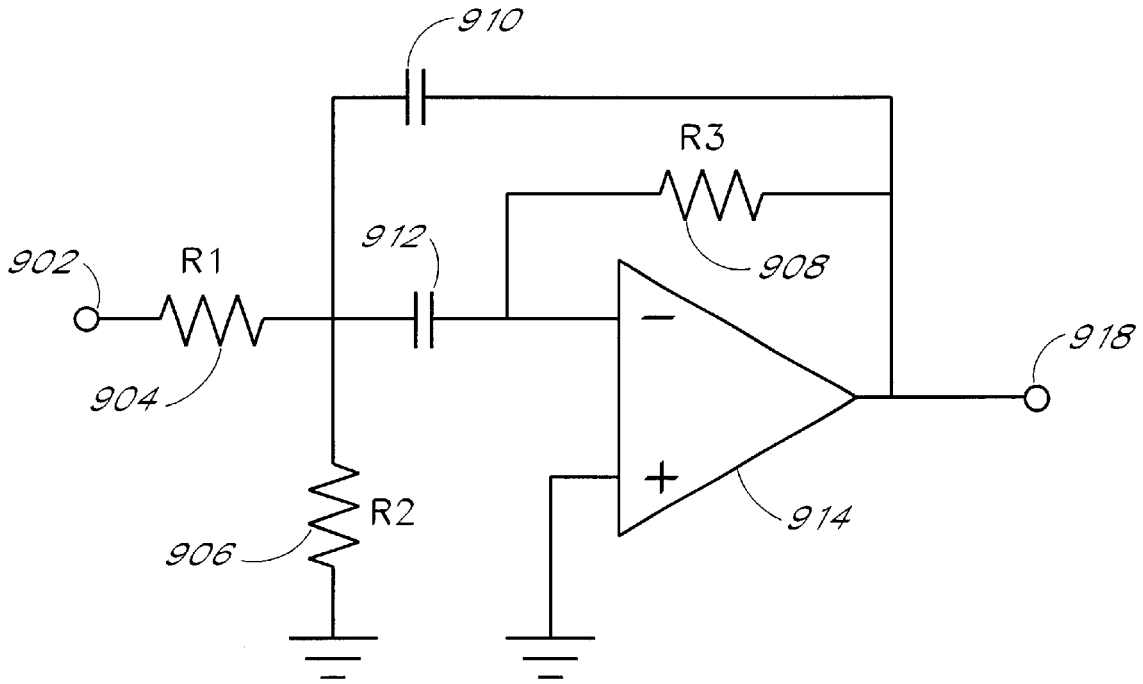
FIG. 9 is a circuit diagram of a bandpass filter used in some embodiments of the present invention.

FIG. 9 is a circuit diagram of an second order Chebychev filter having an input 902 and an output 918. The input 902 is provided to a first terminal of a resistor RI 904. A second terminal of the resistor R1 904 is provided to a first terminal of a resistor R2 906, a first terminal of an input capacitor 912, and a first terminal of a feedback capacitor 910. A second terminal of the input capacitor 912 is connected to an inverting input of an operational amplifier (op-amp) 914 and to a first terminal of a resistor R3 908. A non-inverting input of the op-amp 914 is connected to ground. An output of the op-Damp 918 is connected to a second terminal of the feedback capacitor 910, a second terminal of the feedback resistor 908 and the output 918. In one embodiment, the input capacitor 912 and the feedback capacitor 910 are both 0.1 microFarad capacitors.

Figure 10:
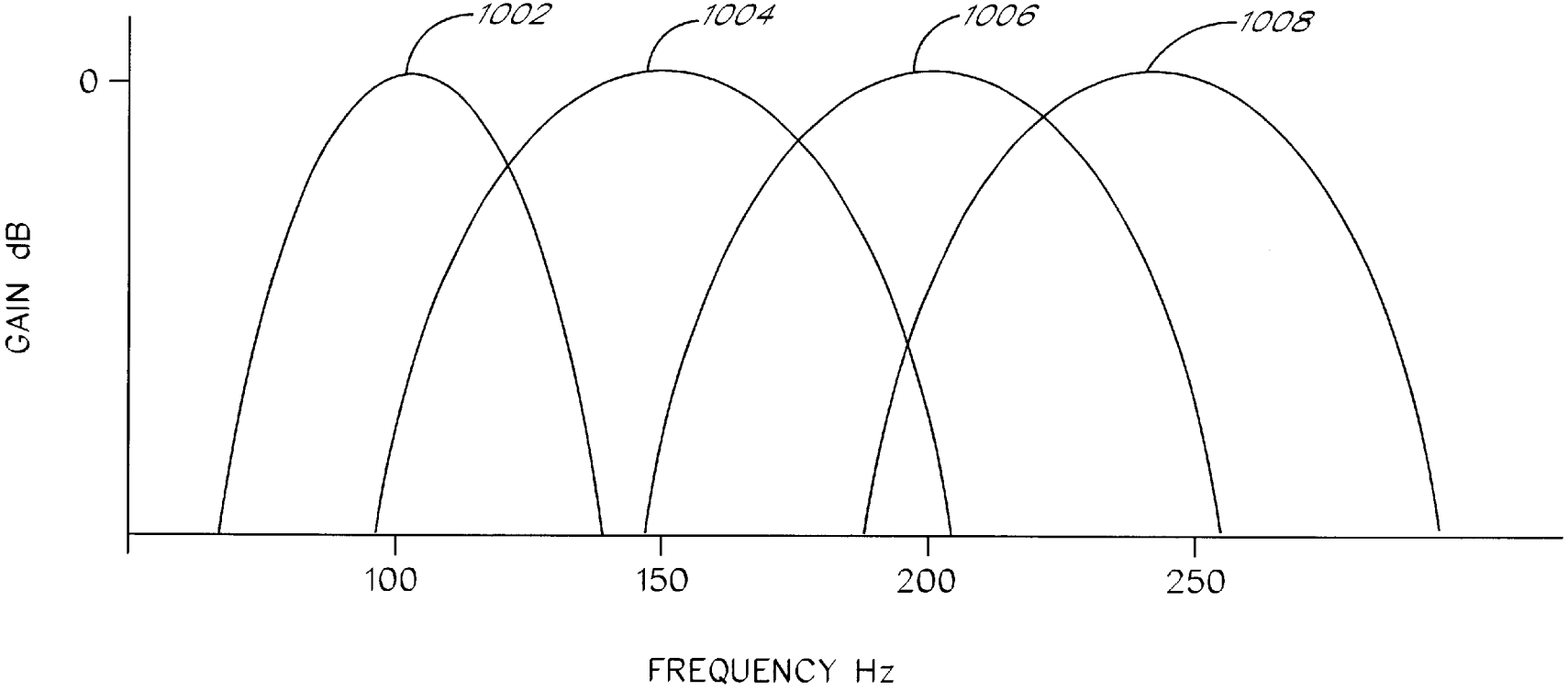
FIG. 10 is a plot of the transfer functions of the bandpass filters used in the signal processing diagram shown in FIG. 8.

Table 1 lists the center frequencies and circuits values used for the bandpass filters 812–815 according to the circuit shown in FIG. 9. FIG. 10 illustrates the general shape of the transfer functions of the bandpass filters. FIG. 10 shows the bandpass transfer functions 1002, 1004, 1006, and 1008, corresponding to the bandpass filters 812–815 respectively.

TABLE 1

| Filter | Frequency (Hz) | R1 (KΩ) | R2 (KΩ) | R3 (KΩ) |
|---|---|---|---|---|
| 812 | 100 | 31.6 | 4.53 | 63.4 |
| 813 | 150 | 21.0 | 3.09 | 42.46 |
| 814 | 200 | 15.8 | 2.26 | 31.6 |
| 815 | 250 | 12.7 | 1.82 | 25.5 |

The amplifiers 816, 817, 818, and 819 are set to a gain of two. Thus, the output of the mixer 820, and the signal 821, is an audio signal comprising the sum of the left and right stereo channels which have been filtered and processed in approximately the 100 Hz to 250 Hz range. This processed signal is added to the feedforward paths of the left and right stereo channels by the mixers 824 and 832 respectively. Since the signal 821 contains both left and right-channel information, adding the signal 821 back into the left and right channels will introduce some left-channel audio signal into the right channel, and vice versa. Thus, the effect is to equalize the two channels somewhat.

Figure 11:
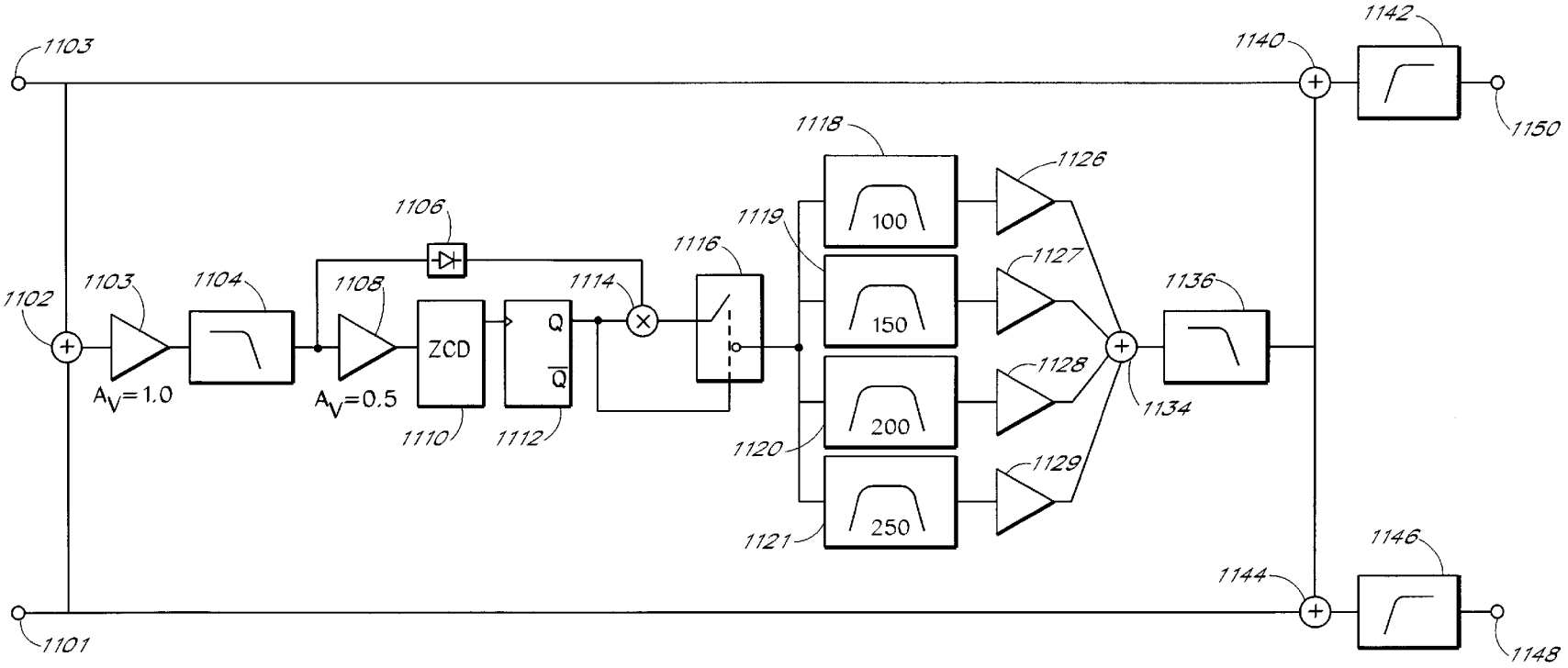
FIG. 11 is a signal processing block diagram of a perceptual enhancement system that uses a zero crossing detector.

FIG. 11 illustrates another signal processing embodiment of the sound enhancement system. The embodiment shown in FIG. 11, is in many ways similar to the embodiment of FIG. 8, except that in FIG. 11, the four bandpass filters are driven by a monostable multivibrator 1112 which is triggered by a zero crossing detector 1110. FIG. 11 shows two inputs, a left-channel input 1103 and a right-channel input 1101. As with FIG. 8, the two channels of signal processing shown in FIG. 11 will be described in terms of a left channel and a right channel as a convenience, but not as a limitation.

The inputs 1103 and 1101 are both provided to an adder 1102 which produces an output that is a combination of the two inputs, the combination being the linear sum of the two inputs. An output of the adder 1102 is provided to an amplifier 1103 having a gain of one. The gain of the amplifier 1103 can, however, be adjusted to any desired value. An output of the amplifier 1103 is provided to a lowpass filter 1104 having a frequency cutoff of approximately 100 Hz. An output of the lowpass filter 1104 is provided to a peak detector 1106 and an amplifier 1108 having a gain of approximately 0.05. The peak detector 1106 has a decay time constant of 0.25 milliseconds. An output of the amplifier I 108 is provided to the zero crossing detector (ZCD) 1110. An output of the ZCD 1110 is provided to a trigger input of the monostable 1112 such that the monostable 1112 is triggered each time the output of the lowpass filter 1404 passes through zero.

When triggered, the monostable 1112 produces a 150 millisecond pulse. A non-inverted output of the monostable 1112 is provided to a first input of a multiplier 1114 and to a control input of a SPST (single-pole single-throw) voltage controlled switch 1116, so that the switch 1116 is closed whenever the non-inverted output of the monostable 1112 is high A second input of the multiplier is provided by an output of the peak detector 1106. An output of the multiplier 1114 is provided to a first terminal of the switch 1114. A second terminal of the switch 1114 is provided to first bandpass filter 1118, a second bandpass filter 1119, a third bandpass filter 1120, and a fourth bandpass filter 1121. The output of each bandpass filter 1118–1121 is provided to an input of an amplifier 1126–1129 respectively, such that each bandpass filter drives one amplifier, each amplifier effectively having a gain of two. An output of each of the amplifiers 1126–1129 is provided to a mixer 1134 which produces an output that is the sum of the outputs of the amplifiers 1126–1129. The output of the mixer 1134 is provided to an input of a lowpass filter 1136 having a cutoff frequency of approximately 200 Hz. The highpass filters 1142 and 1144 both have a cutoff frequency of approximately 125 Hz.

An output of the mixer 1134 is provided to a first input of a left-channel adder 1140 and first input of a right-channel adder 1144. The left-channel input 1103 is provided to a second input of the left-channel adder 1140, and the right-channel input 1101 is provided to a second input of the right-channel adder 1144. The output of the left-channel adder 1140 is provided to an input of a highpass filter 1142, and an output of the highpass filter 1142 is provided to a left-channel output 1150. The output of the right-channel adder 1144 is provided to an input of a highpass filter 1146, and an output of the highpass filter 1146 is provided to a left-channel output 1148.

The system of FIG. 11 generates pulses based on the zero crossings of the output of the lowpass filter 1104. The pulses are provided to the filters 1118–1121, and thereby cause the filters to "ring" producing harmonic frequencies, primarily in the 100 to 300 Hz range. Since the pulses are generated by the zero crossings of the input lowpass filtered input signal, the harmonics generated by the filters 1118–1121 are harmonics of the low-frequency components of the input waveform Thus, the system of FIG. 11 generates harmonic content similar to what would be generated by the human ear if the low-frequency information was converted to acoustic energy. The generated harmonics are mixed with the normal left and right-channel information by the adders 1140 and 1144, highpass filtered to remove the remaining low-frequency signals, and then sent to the loudspeakers. The added harmonics will be interpreted by the brain of a listener as corresponding to lower-frequency content in the acoustic wave.

In yet another embodiment of the present invention, the amplifiers which are driven by the bandpass filters (e.g., the amplifiers 816–819 in FIG. 8) are replaced with automatic gain control blocks that are controlled by the magnitude of the low-frequency content of the input audio signal. Before examining the signal processing elements used to accomplish said gain control, it is helpful to first examine the effect of gain control on the input and output audio signals in order to gain a better understanding of the process. This embodiment enhances the midbass harmonics (e.g., the harmonics between approximately 100 Hz and 250 Hz) in two ways. The spectrum in this region will be lifted and flattened according to the amount of energy in the input signal that is at frequencies too low for the speaker to reproduce (e.g., frequencies below 100 Hz). When there is little energy in the frequencies below 100 Hz, the spectrum will be changed very little. When there is much energy in the frequencies below 100 Hz, the spectrum will be significantly lifted and flattened in the midbass region. The lifting and flattening is accomplished by means of an enhancement factor which is generated using automatic gain control (AGC) circuits. Note that the frequencies comprising the midbass region will vary and the frequency ranges given herein are provided by way of example and not intended to be a limitation.

Figure 12A:
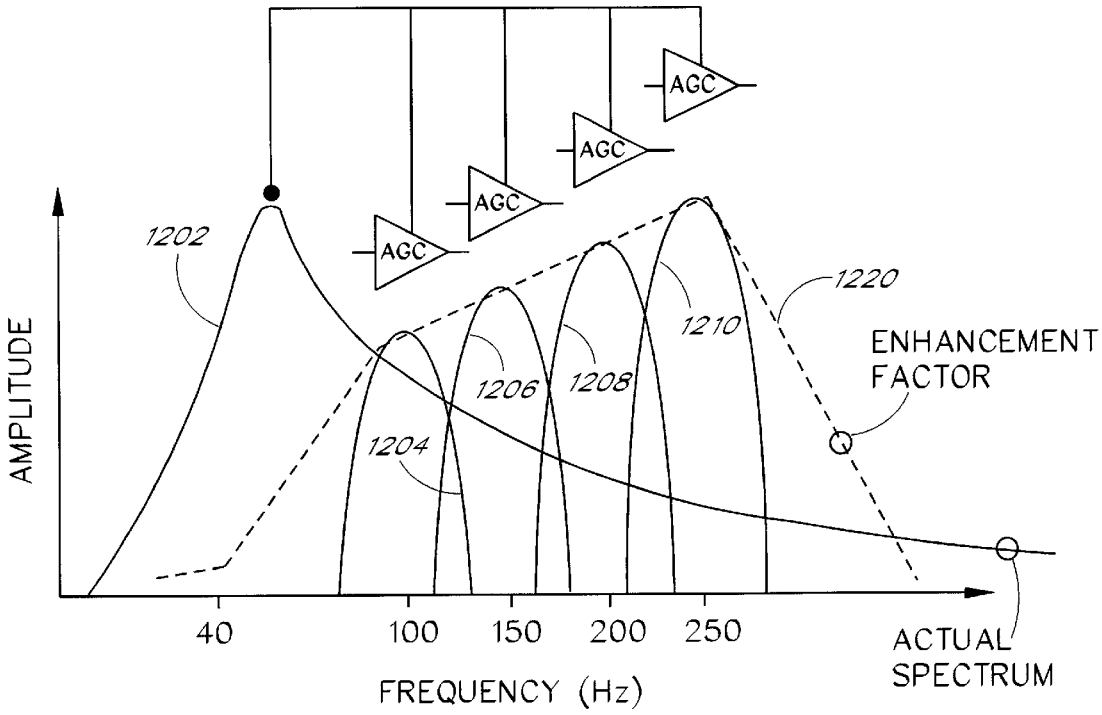
FIG. 12A illustrates an enhancement transfer function which has been generated using a number of automatic gain control circuits connected to the bandpass filters shown in FIG. 8, the enhancement transfer function corresponding to an input signal having significant low-frequency energy.

FIG. 12A shows how, in the presence of an input signal 1202 having a large low-frequency component, controlling of the gain of four stagger-tuned bandpass filters is used to generate an enhancement factor 1220 to accomplish this goal. The example input signal 1202, shown in the frequency domain, has a large peak near 40 Hz (e.g., the lowest note on a bass guitar). The amplitude of the spectrum of 1202 tapers down to smaller and smaller values with increasing frequency. Four bandpass curves 1204, 1206, 1208 and 1210 are used to represent the transfer functions of four bandpass filters tuned approximately to 100 Hz, 150 Hz, 200 Hz, and 250 Hz. The gain of each bandpass filter (represented by the height of each of the curves 1204, 1206, 1208 and 1210 is assumed to be controlled by a separate AGC. Each AGC is, in turn, controlled by the amplitude of the curve 1202 below 100 Hz (the sub-bass region).

Figure 12B:
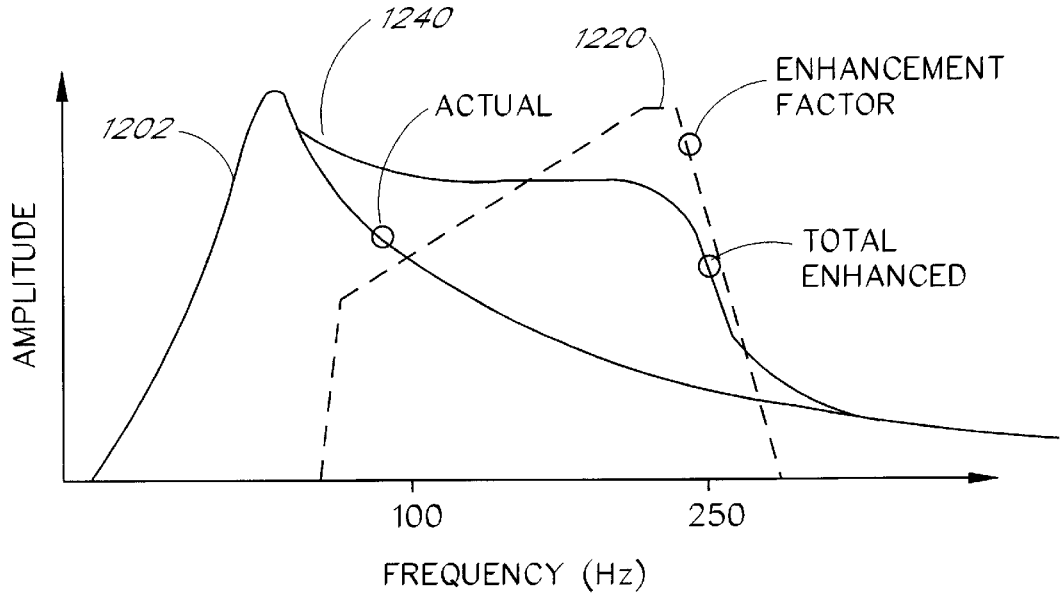
FIG. 12B illustrates the resulting total spectrum produced by the enhancement transfer function shown in FIG. 12A.

In frequency ranges where the input audio spectrum has almost as much amplitude as the sub-bass region, then the AGC gain will be almost unity, as seen in the curve 1204. In frequency ranges where the input audio spectrum has much less amplitude than the sub-bass region, then the AGC gain will increase, as seen in the curve 1210. The enhancement factor 1220 is essentially the composite transfer functions represented by the curves 1204, 1206, 1208, and 1210. FIG. 12B shows the effect of applying the enhanced factor 1220 to the input waveform 1202 to produce an enhanced waveform 1240. Since the waveform 1202 has a large sub-bass amplitude, the enhanced waveform 1240, as compared to the input waveform 1202, is significantly lifted and flattened in the midbass region.

Figure 12C:
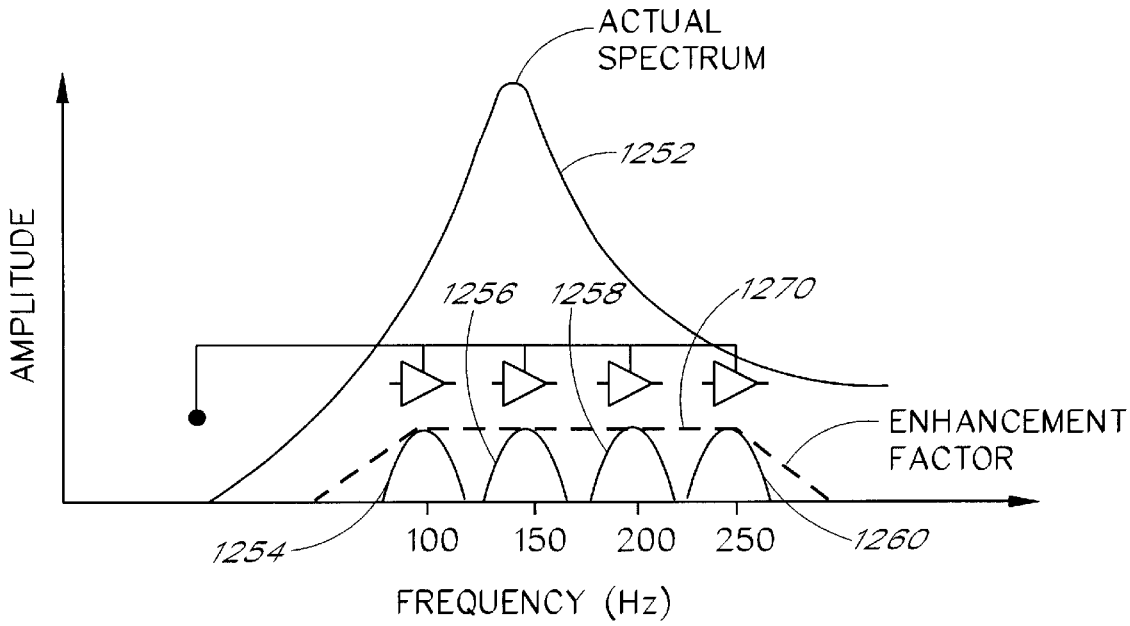
FIG. 12C illustrates an enhancement transfer function which has been generated using a number of automatic gain control circuits connected to the bandpass filters shown in FIG. 8, the enhancement transfer function corresponding to an input signal with very little low-frequency energy.
Figure 12D:
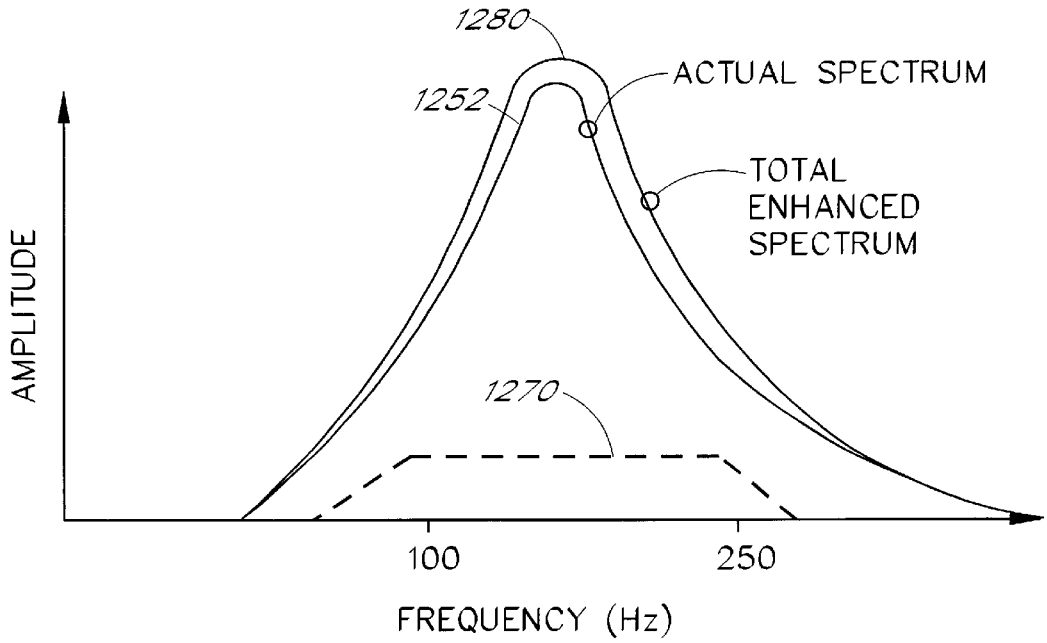
FIG. 12D illustrates the resulting total spectrum produced by the enhancement transfer function shown in FIG. 12C.

FIGS. 12C and 12D show the same process as shown in FIGS. 12A and 12B, where an enhancement factor 1270 is generated from an input waveform 1252. Unlike the waveform 1202, the waveform 1252 has little low-frequency energy, and thus, the enhancement factor 1270 is smaller. An output waveform 1280 shown in FIG. 12D is almost identical to the input waveform 1252 because the enhancement factor 1280 is so small.

Figure 13:
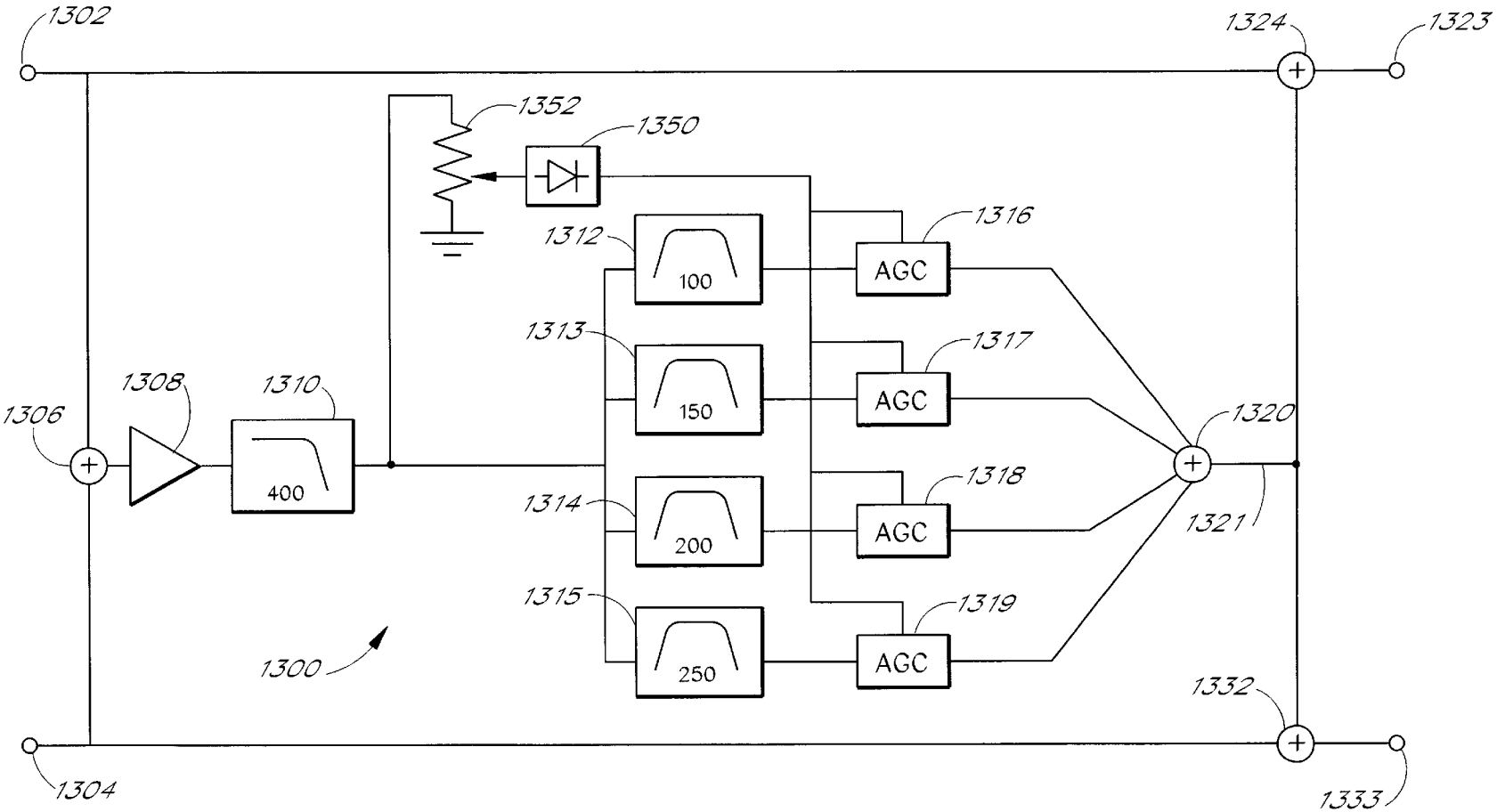
FIG. 13 is a signal processing block diagram of a system that produces the enhancement transfer functions shown in FIG. 12.

FIG. 13 is a block diagram 1300 of one embodiment of the low-frequency enhancement signal processing system which uses AGC to generate an enhancement factor. FIG. 13 may also be used as a flowchart to describe a program running on a DSP or other processor which implements the signal processing operations of an embodiment of the present invention. FIG. 13 shows two inputs, a left-channel input 1302 and a right-channel input 1304. As with previous embodiments, left and right are used as a convenience, not as a limitation. The inputs 1302 and 1304 are both provided to an adder 1306 which produces an output that is a combination of the two inputs.

An output of the adder 1306 is provided to an input of an amplifier 1308 having a gain of unity. An output of the amplifier 1308 is provided to a lowpass filter 1310 having a cutoff frequency of approximately 400 Hz. An output of the lowpass filter 1310 is provided to a first terminal of a potentiometer 1352, a first bandpass filter 1312, a second bandpass filter 1313, a third bandpass filter 1314, and a fourth bandpass filter 1315. The output of each bandpass filter 1312–1315 is provided to an audio signal input of an AGC 1316–1319 respectively, such that each bandpass filter drives one AGC. An output of each of the AGCs 1316–1319 is connected to an adder 1320 which produces an output that is the sum of the outputs of the amplifiers.

A second terminal of the potentiometer 1352 is connected to ground and a wiper of the potentiometer is connected to a peak detector 1350. An output of the peak detector 1350 is provided to a control input of each of the AGCs 1316–1319.

The output of the amplifier 1320 is provided to a first input of a left-channel adder 1324 and the output of the amplifier 1320 is provided to a first input of a right-channel adder 1332. The left-channel input 1302 is provided to a second input of the left-channel adder 1324 and the right-channel input 1304 is provided to a second input of the right-channel adder 1332. The outputs of the left-channel adder 1324 and the right-channel adder 1332 are, respectively, a left-channel output 1323 and a right-channel output 1333 of the signal processing block 1300. In one embodiment, the bandpass filters 1312–1315 are substantially identical to the bandpass filters 812–815 as shown in FIG. 9 and Table 1.

The AGC 1316 (as well as the AGCs 1317-1319), is essentially a linear amplifier with an internal servo feedback loop. The servo automatically adjusts the amplitude of the output signal to match the amplitude of a signal on the control input. Thus, it is the control input, not the amplifier signal input, that determines the average amplitude of the output signals. If the input signal is reduced in amplitude, then the servo will increase the forward gain of the AGC 1316 so that the output signal level remains constant.

Figure 14A:
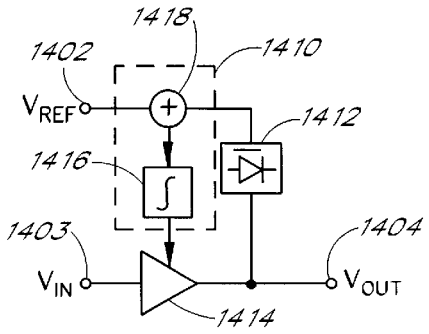
FIG. 14A is a block diagram of an automatic gain control amplifier.

FIG. 14A is a block diagram of one embodiment of the AGCs 1318–1319, comprising an audio input 1403, a control input 1402, and an audio output 1404. The audio input 1463 is provided to an input of gain controlled amplifier 1414. An output of the amplifier 1414 is provided to the audio output 1404 and a negative peak detector 1412. An output of the negative peak detector is provided to a first input of an adder 1418 and the control input 1402 is provided to a second input of the adder 1418. An output of the adder 1418 is provided to a input of an integrator 1416, and an output of the integrator 1416 is provided to a gain control input of the amplifier 1414. Together the adder 1418 and the integrator 1416 form a summing integrator 1410.

Figure 14B:
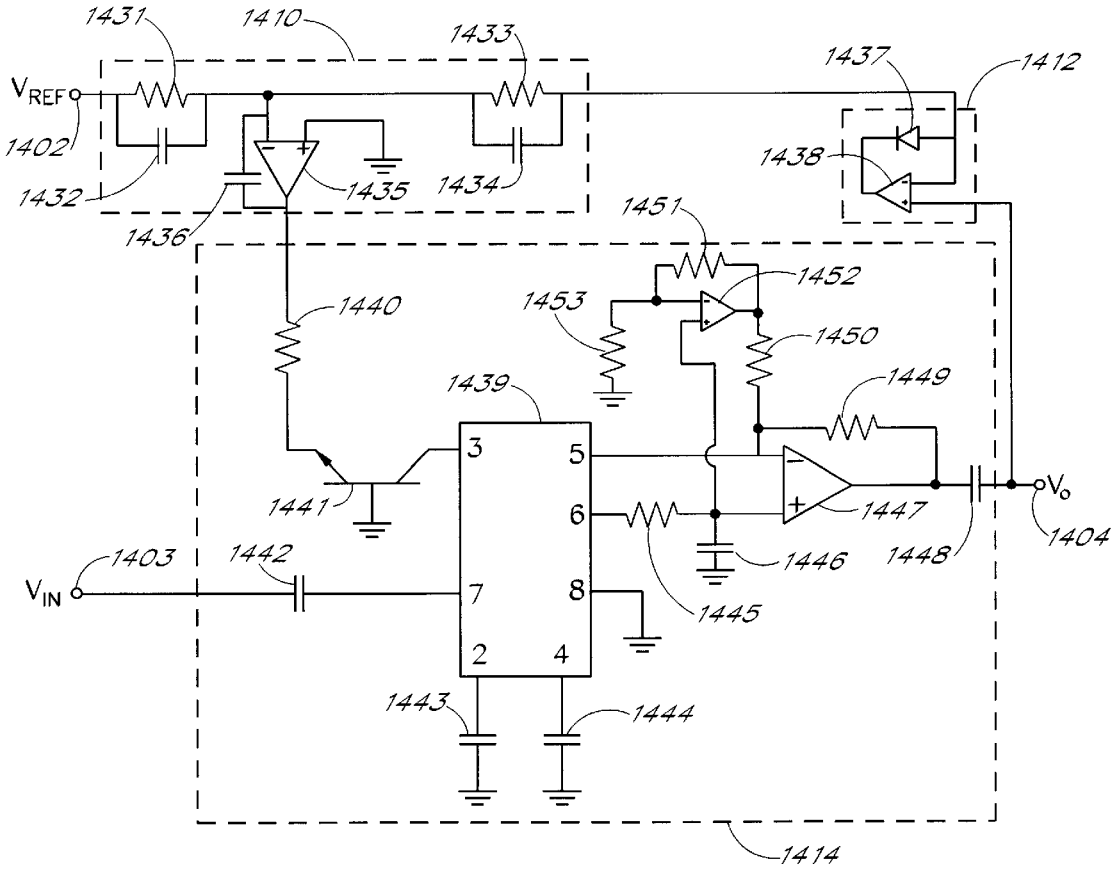
FIG. 14B is a circuit diagram of an automatic grain control amplifier corresponding to the block diagram shown in FIG. 14A.

FIG. 14B is one embodiment of a circuit diagram of the AGC shown in FIG. 14A. As shown in FIG. 14B, the gain controlled amplifier 1414 comprises an NE572 compandor 1439 having signal pins 2–8 listed in Table 2. The audio input 1403 is provided to a first terminal of an input capacitor 1442. A second terminal of the input capacitor is connected to pin 7 of the compandor 1439. The input capacitor 1442 capacitor comprises the parallel combination of a 2.2 mf (microFarad) capacitor and a 0.01 mf capacitor. The pin 2 of the compandor 1403 is connected through a 10.0 mf capacitor 1443 to ground. The pin 4 of the compandor 1403 is connected through a 1.0 mf capacitor 1444 to ground. The pin 8 of the compandor 1439 is grounded. The pin 6 of the compandor 1439 is connected to a first terminal of a 1.0 KΩ resistor 1445 A second terminal of the resistor 1445 is connected to a 2.2 mf capacitor 1446, a non-inverting input of an op-amp 1447 and a non-inverting input of an op-amp 1452. A second terminal of the capacitor 1446 is grounded. The pin 5 of the compandor 1439 is connected to an inverting input of the op-amp 1447, a first terminal of a 17.4 KΩ feedback resistor 1449 and a first terminal of a 17.4 KΩ input resistor 1450. An output of the op-amp 1447 is connected to a second terminal of the feedback resistor 1449 and a first terminal of an output capacitor 1448. An output of the op-amp 1452 is connected to a second terminal of the input resistor 1450. A 10.0 KΩ feedback resistor is connected between an inverting input and the output of the op-amp 1452. A 10.0 KΩ input resistor connects the inverting input of the op-amp 1452 to ground.

The gain control input of the amplifier 1414 is provided to a first terminal of a 3.0 KΩ input resistor 1440. A second terminal of the resistor 1440 is connected to the emitter of a small-signal transistor 1441, which may be a 2N2222. The base of the transistor is connected to ground, and the collector of the transistor 1441 is connected to pin 3 of the compandor 1439.

The negative peak detector 1412 comprises an op-amp 1438 and a diode 1437. The input of the negative peak detector 1412 is connected to a non-inverting input of the op-amp 1438. An output of the op-amp 1438 is connected to the cathode of the diode 1437. The anode of the diode 1437 is connected to an inverting input of the op-amp 1437 and to the output of the peak detector 1412. The peak detector 1350, shown in FIG. 13 may be constructed in a manner similar to the negative peak detector 1412, except that the diode 1437 is reversed for the peak detector 1350.

The first input of the summing integrator 1410 is provided to a first terminal of the parallel combination of a 100.0 KΩ resistor 1431 and a 4.7 mf capacitor 1432. The second input of the summing integrator 1410 is provided to a first terminal of the parallel combination of a 100.0 KΩ resistor 1433 and a 4.7 mf capacitor 1434. The second terminals of both parallel combinations are connected to an inverting input of an op-amp 1435. A non-inverting input of the op-amp 1435 is grounded, and a 0.33 mf feedback capacitor 1436 is connected between the inverting input of the op-amp 1435 and the output of the op-amp 1435. The output of the op-amp 1435 is the output of the summing integrator 1410.

The NE572 is a dual-channel, high-performance gain control circuit in which either channel may be used for dynamic range compression or expansion. Each channel has a full-wave rectifier to detect the average value of input signal, a linearized, temperature-compensated variable gain cell and a dynamic time constant buffer. The buffer permits independent control of dynamic attack and recovery time with minimum external components and improved low-frequency gain control ripple distortion. Pin-outs for the NE572 are listed in Table 2 (where n,m designates channels A,B). The NE572 is used in the present embodiments as an inexpensive, low-noise, low distortion, gain controlled amplifier. One skilled in the art will recognize that other gain-controlled amplifiers can be used as well.

TABLE 2

| Pin | Function |
|---|---|
| 1, 15 | Tracking Trim |
| 2, 14 | Recovery |
| 3, 13 | Rectifier input |
| 4, 12 | Attack |
| 5, 11 | Vout |
| 6, 10 | THD trim |
| 7, 9 | Vin |
| 8 | Ground |
| 16 | Vcc |

Figure 15:
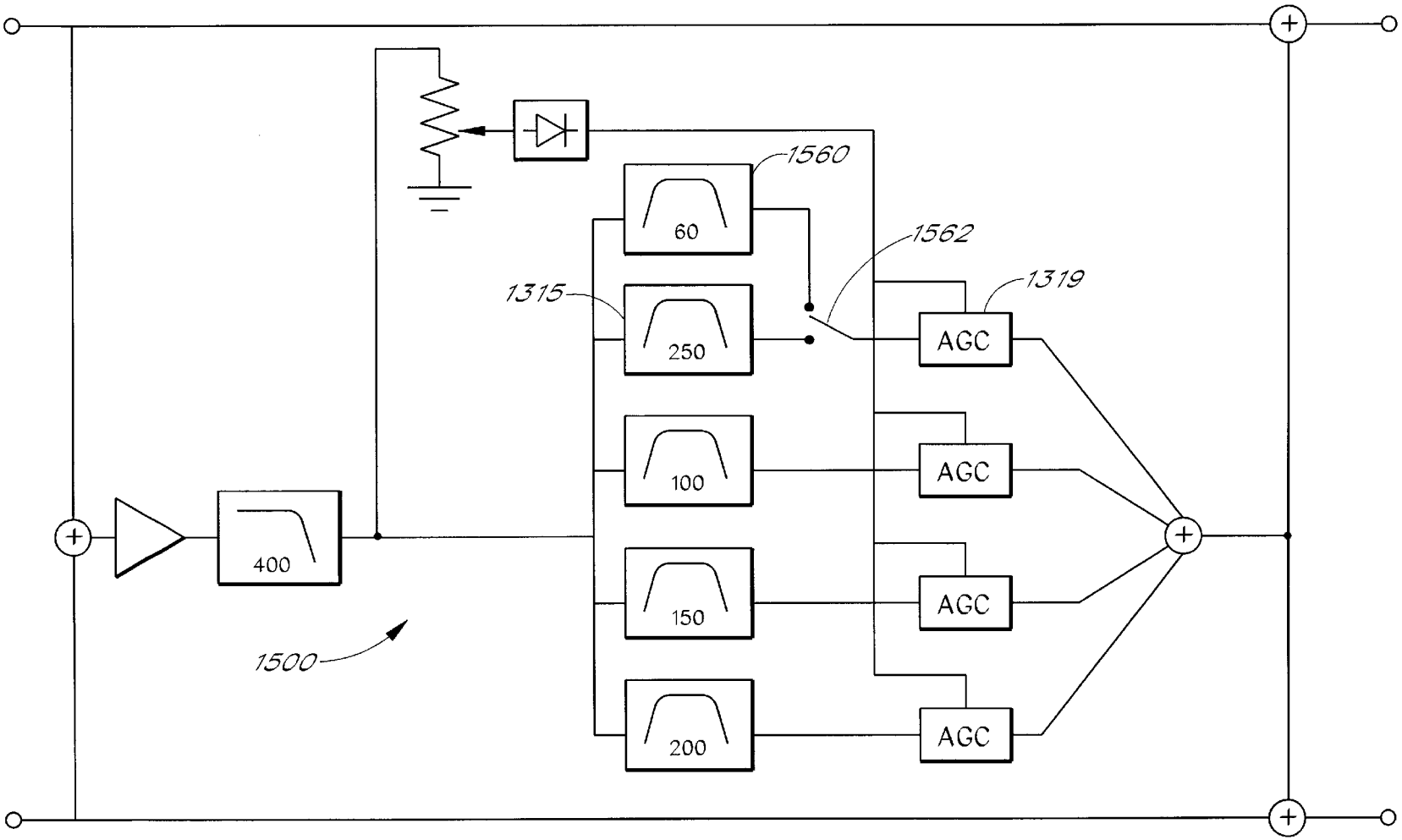
FIG. 15 is a signal processing block diagram of a system that provides enhancement transfer functions as shown in FIG. 12 with selectable frequency response.

FIG. 15 is a diagram of a signal processing system 1500 of one embodiment of the low-frequency enhancement system which provides selectable frequency ranges. FIG. 15 may also be used as a flowchart to describe a program running on a DSP or other processor which implements the signal processing operations of an embodiment of the present invention. The selectable frequency range feature embodied in the system 1500 is applicable to all of the previous embodiments. For simplicity, however, the system 1500 is shown as a modification of the signal processing system 1300 shown in FIG. 13, and thus only the differences between the system 1300 and the system 1500 will be described herein. In the system 1500, the output of the bandpass filter 1315 is not connected directly to the input of the AGC 1319, as in the system 1300, but rather, the output of the bandpass filter 1315 is provided to a first throw of a single pole double throw (SPDT) switch 1562. The pole of the switch 1562 is provided to the signal input of the AGC 1319. An input of a bandpass filter 1560 is connected to the input of the bandpass filter 1315 so that the bandpass filters 1560 and 1315 receive the same input signals. An output of the bandpass filter 1560 is provided to a second throw of the SPDT switch 1562.

The bandpass filter 1560 is desirably tuned to a frequency below 100 Hz, such as 60 Hz. When the switch 1562 is on a fist position, corresponding to the first throw, it selects the bandpass filter 1315 and causes the system 1500 to operate identically to the system 1300, providing bandpass filters at 100, 150, 200, and 250 Hz. When the switch 1562 is in a second position, corresponding to the second throw, it deselects the bandpass filter 1315 and selects the bandpass filter 1560, thus providing bandpass filters at, say, 60, 100, 150, and 200 Hz.

Thus, the switch 1562 desirably allows a user to select the frequency range to be enhanced. A user with a loudspeaker system that provides small woofers, such as woofer of three to four inches in diameter, will typically select the upper frequency range provided by the bandpass filters 1312–1315 which are tuned to 100, 150, 200, and 250 Hz respectively. A user with a loudspeaker system that provides somewhat larger woofers, such as woofers of approximately five inches in diameter or larger, will typically select the lower frequency range provided by the bandpass filters 1560 and 1312–1314 which are tuned to 60, 100, 150, and 200 Hz respectively. One skilled in the art will recognize that more switches could be provided to allow selection of more bandpass filters and more frequency ranges. Selecting different bandpass filters to provide different frequency ranges is a desirable technique because the bandpass filters are inexpensive and because different bandpass filters can be selected with a single throw switch.

Bass Enhancement Expander

Figure 16A:
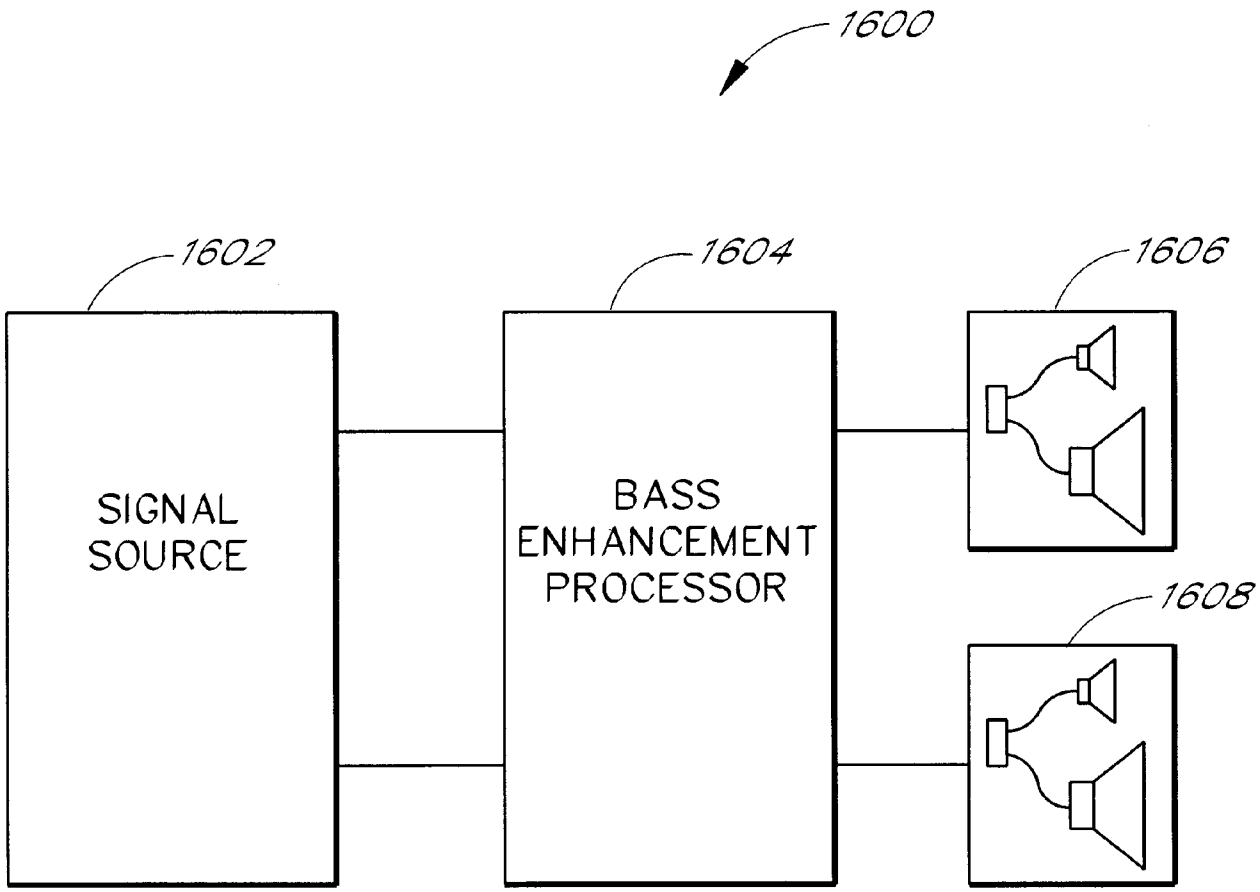
FIG. 16A is a block diagram of a sound system with bass enhancement processing.

FIG. 16A is a block diagram of a sound system wherein the sound enhancement function is provided by a bass enhancement unit 1604. The bass enhancement unit 1604 receives audio signals from a signal source 1602. The signal source 1602 may be any signal source, including the signal source 102 shown in FIG. 1, or the sound card 510 shown in FIG. 5. The bass enhancement unit 1604 performs signal processing to modify the received audio signals to produce audio output signals. The audio output signals may be provided to loudspeakers, amplifiers, or other signal processing devices.

Figure 16B:
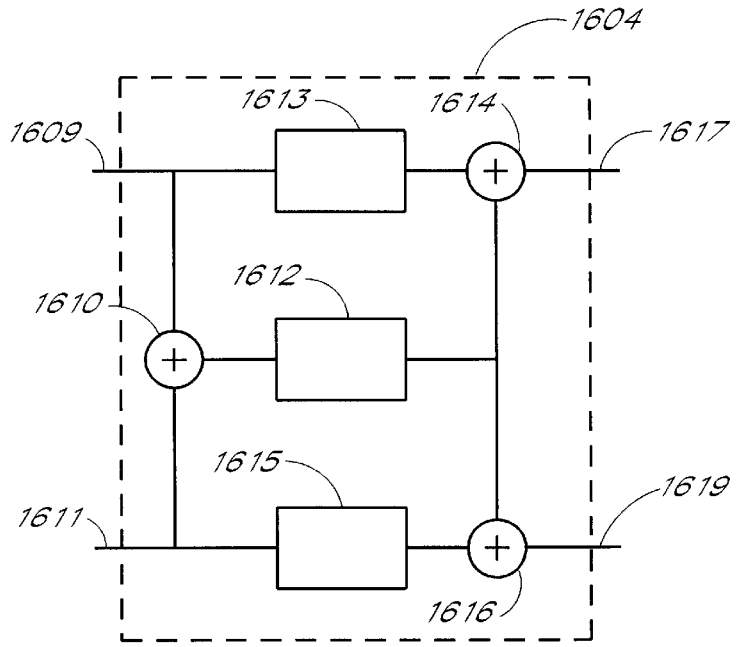
FIG. 16B is a block diagram of a bass enhancement processor that combines multiple channels into a single bass channel.

FIG. 16B is a block diagram of a topology for a two-channel bass enhancement unit 1644 having a first input 1609, a second input 1611, a first output 1617 and a second output 1619. The first input 1609 and first output 1617 correspond to a first channel. The second input 1611 and second output 1619 correspond to a second channel. The first input 1609 is provided to a first input of a combiner 1610 and to an input of a signal processing block 1613. An output of the signal processing block 1613 is provided to a first input of a combiner 1614. The second input 1611 is provided to a second input of the combiner 1610 and to an input of a signal processing block 1615. An output of the signal processing block 1615 is provided to a first input of a combiner 1616. An output of the combiner 1610 is provided to an input of a signal processing block 1612. An output of the signal processing block 1612 is provided to a second input of the combiner 1614 and to a second input of the combiner 1616. An output of the combiner 1614 is provided to the first output 1617. An output of the second combiner 1616 is provided to the second output 1619.

Signals from the first and second inputs 1609 and 1611 are combined and processed by the signal processing block 1612. The output of the signal processing block 1612 is a signal, that when combined with the outputs of the signal processing blocks 1613 and 1615, respectively, produces the bass enhanced outputs 1617 and 1619.

Figure 16C:
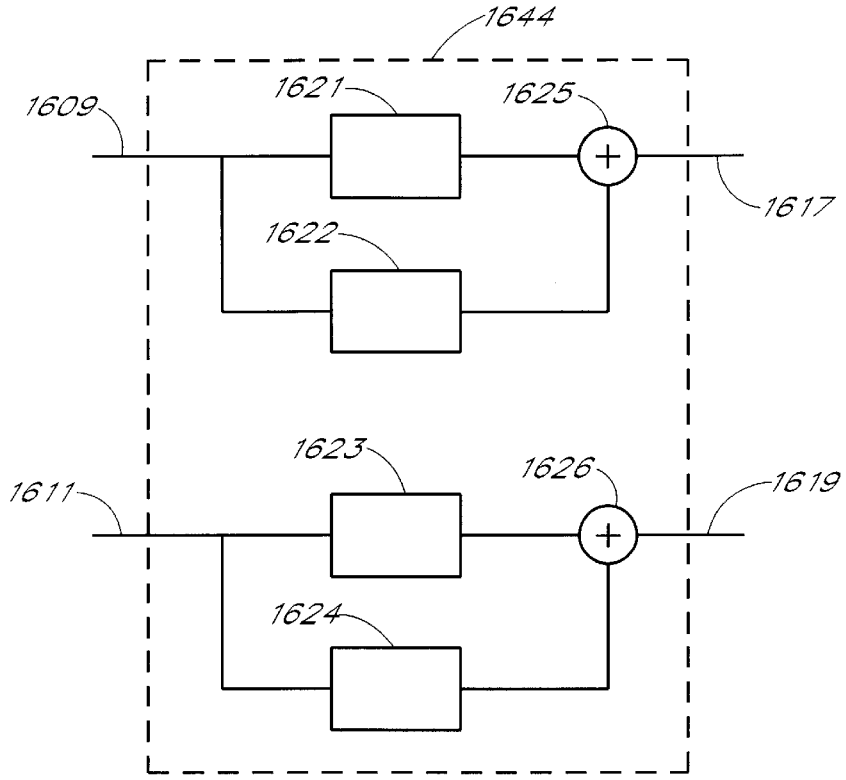
FIG. 16C is a block diagram of a bass enhancement processor that processes multiple channels separately.

FIG. 16C is a block diagram of another topology for a two-channel bass enhancement unit 1604. In FIG. 16C, the first input 1609 is provided to an input of a signal processing block 1621 and to an input of a signal processing block 1622. An output of the signal processing block 1621 is provided to a first input of a combiner 1625 and an output of the signal processing block 1622 is provided to a second input of the combiner 1625. The second input 1611 is provided to an input of a signal processing block 1623 and to an input of a signal processing block 1624. An output of the signal processing block 1623 is provided to a first input of a combiner 1626 and an output of the signal processing block 1624 is provided to a second input of the combiner 1626. An output of the combiner 1625 is provided to the first output 1617 and an output of the second combiner 1626 is provided to the second output 1619.

Unlike the topology shown in FIG. 16B, the topology shown in FIG. 16C does not combine the two input signals 1609 and 1611, but, rather, the two channels are kept separate, and the bass enhancement processing is performed on each channel.

Figure 17:
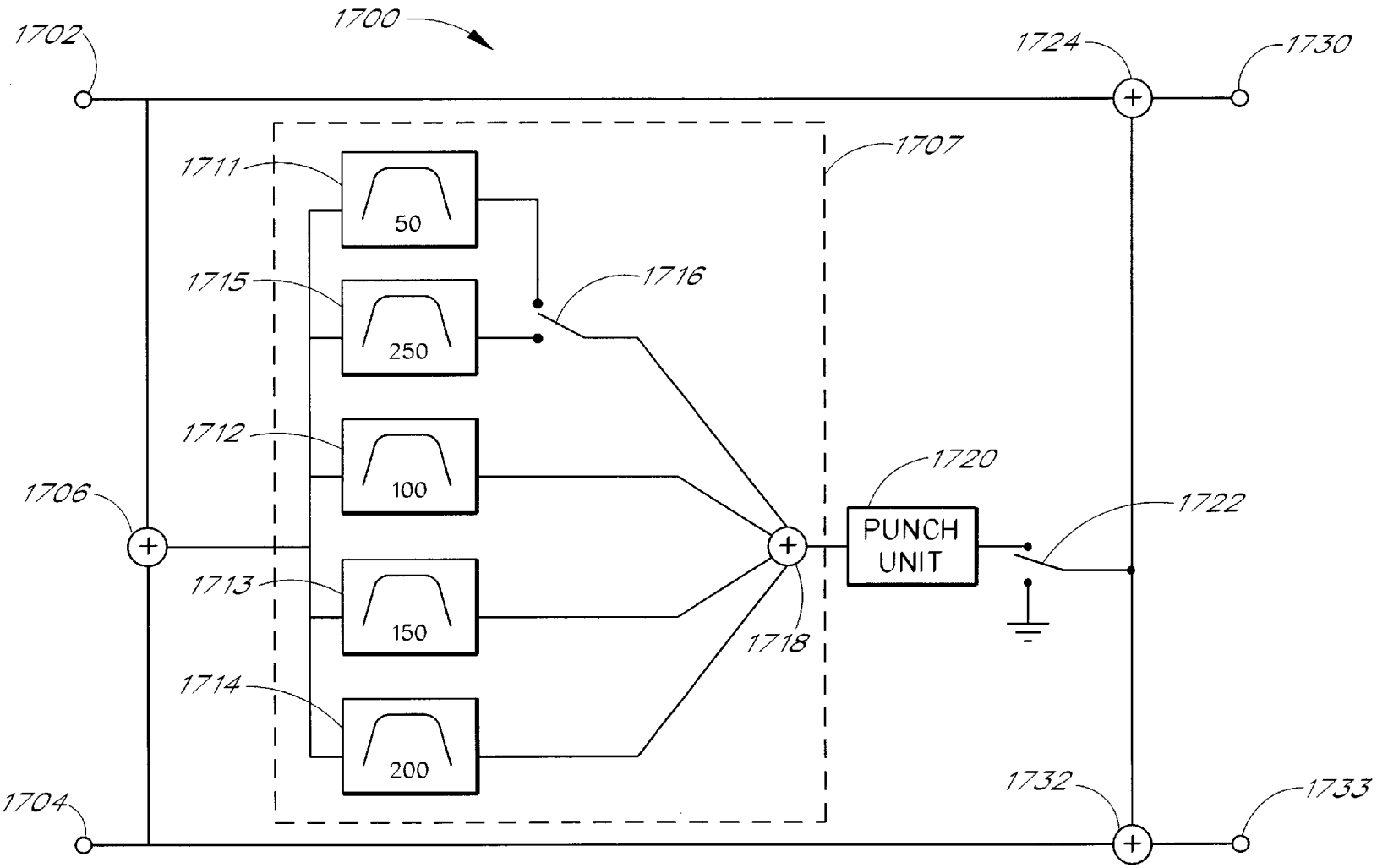
FIG. 17 is a signal processing block diagram of a system that provides bass enhancement with selectable frequency response.

FIG. 17 is a block diagram 1700 of one embodiment of the bass enhancement system 1604 shown in FIG. 16A. The bass enhancement system 1700 uses a bass punch unit 1720 to generate a time-dependent enhancement factor. FIG. 17 may also be used as a flowchart to describe a program running on a DSP or other processor which implements the signal processing operations of an embodiment of the present invention. FIG. 17 shows two inputs, a left-channel input 1702 and a right-channel input 1704. As with previous embodiments, left and right are used as a convenience, not as a limitation. The inputs 1702 and 1704 are both provided to an adder 1706 that produces an output that is a combination of the two inputs.

The output of the adder 1706 is provided to a first bandpass filter 1712, a second bandpass filter 1713, a third bandpass filter 1714, a fourth bandpass filter 1715, and a fifth bandpass filter 1711. The output of the bandpass filter 1715 is provided to a first throw of a single pole double throw (SPDT) switch 1716. The output of the bandpass filter 1711 is provided to a second throw of the SPDT switch 1716. The pole of the switch 1716 is provided to an input of the adder 1718. The output of each bandpass filter 1712–1714 is provided to a separate input of an adder 1718.

An output of the adder 1718 is provided to an input of the bass punch unit 1720. An output of the bass punch unit 1720 is provided to a first throw of a single-pole double-throw (SPDT) switch 1722. A second throw of the SPDT switch 1722 is provided to ground. The throw of the SPDT switch 1722 is provided to a first input of a left-channel adder 1724 and to a first input of a right-channel adder 1732. The left-channel input 1702 is provided to a second input of the left-channel adder 1724 and the right-channel input 1704 is provided to a second input of the right-channel adder 1732. The outputs of the left-channel adder 1724 and the right-channel adder 1732 are, respectively, a left-channel output 1730 and a right-channel output 1733 of the signal processing block 1700. The switches 1722 and 1716 are optional and may be replaced by fixed connections.

The filtering operations provided by the filters 1711–1715 and the combiner 1718 may be combined into a composite filter 1707 as shown in FIG. 17. For example, in an alternative embodiment, the filters 1711–1715 are combined into a single bandpass filter having a passband that extends from approximately 40 Hz to 250 Hz. For processing bass frequencies, the passband of the composite filter 1707 preferably extends from approximately 20 to 100 Hz at the low-end, and from approximately 150 to 350 Hz at the high-end. The composite filter 1707 may have other filter transfer functions as well, including, for example, a highpass filter, a shelving filter, etc. The composite filter may also be configured to operate in a manner similar to a graphic equalizer and attenuate some frequencies within its passband relative to other frequencies within its passband.

As shown, FIG. 17 corresponds approximately to the topology shown in FIG. 16B, where the signal processing blocks 1613 and 1615 have a transfer function of unity and the signal processing block 1612 comprises the composite filter 1707 and the bass punch unit 1720. However, the signal processing shown in FIG. 17 is not limited to the topology shown in FIG. 16B. The elements of FIG. 17 may also be used in the topology shown in FIG. 16C, where the signal processing blocks 1621 and 1623 have a transfer function of unity and the signal processing blocks 1622 and 1624 comprise the composite filter 1707 and the bass punch unit 1720. Although not shown in FIG. 17, the signal processing blocks 1613, 1615, 1621, and 1623 may provide additional signal processing, such as, for example, high pass filtering to remove low bass frequencies, high pass filtering to remove frequencies processed by the bass punch unit 1702, high frequency emphasis to enhance the high frequency sounds, additional mid bass processing to supplement the bass punch circuit, etc.

Other combinations are contemplated as well.

Figure 18:
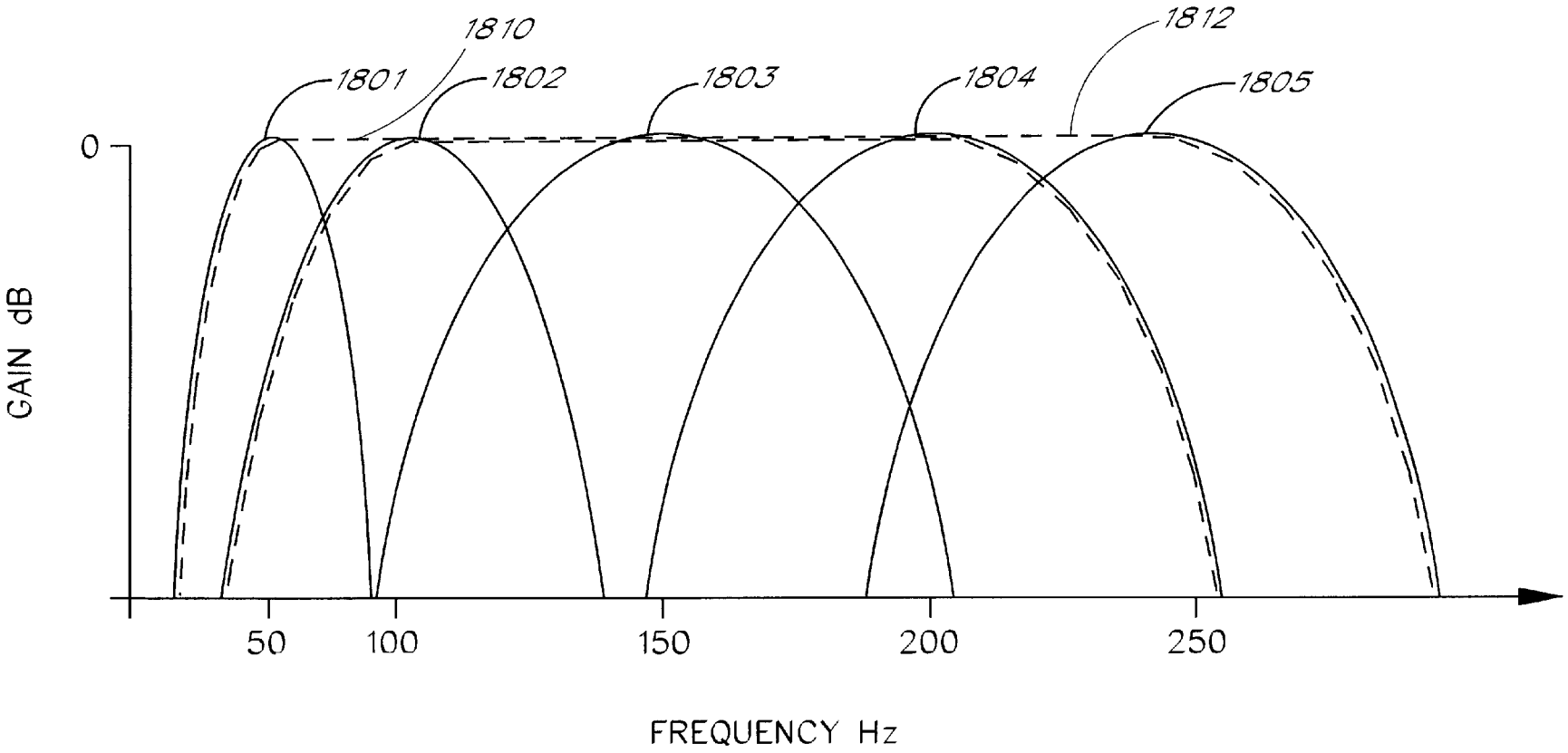
FIG. 18 is a plot of the transfer functions of the bandpass filters used in the signal processing diagram shown in FIG. 17.

FIG. 18 is a frequency-domain plot that shows the general shape of the transfer functions of the bandpass filters 1711–1715. FIG. 18 shows the bandpass transfer functions 1801–1805, corresponding to the bandpass filters 1711–1715 respectively. The transfer functions 1801–1805 are shown as bandpass functions centered at 50, 100, 150, 200, and 250 Hz respectively.

In one embodiment, the bandpass filter 1711 is tuned to a frequency below 100 Hz, such as 50 Hz. When the switch 1716 is in a first position, corresponding to the first throw, it selects the bandpass filter 1711 and deselects the bandpass filter 1715, thereby providing bandpass filters at 50, 100, 150, and 200 Hz. When the switch 1716 is in a second position, corresponding to the second throw, it deselects the bandpass filter 1711 and selects the bandpass filter 1715, thus providing bandpass filters at, 100, 150, 200, and 250 Hz.

Thus, the switch 1716 desirably allows a user to select the frequency range to be enhanced. A user with a loudspeaker system that provides small woofers, such as woofer of three to four inches in diameter, will typically select the upper frequency range provided by the bandpass filters 1712–1715 which are tuned to 100, 150, 200, and 250 Hz respectively. A user with a loudspeaker system that provides somewhat larger woofers, such as woofers of approximately five inches in diameter or larger, will typically select the lower frequency range provided by the bandpass filters 1711–1714, which are tuned to 50, 100, 150, and 200 Hz respectively. One skilled in the art will recognize that more switches could be provided to allow selection of more bandpass filters and more frequency ranges. Selecting different bandpass filters to provide different frequency ranges is a desirable technique because the bandpass filters are inexpensive and because different bandpass filters can be selected with a single-throw switch.

In one embodiment, the bass punch unit 1720 uses an Automatic Gain Control (AGC) comprising a linear amplifier with an internal servo feedback loop. The servo automatically adjusts the average amplitude of the output signal to match the average amplitude of a signal on the control input. The average amplitude of the control input is typically obtained by detecting the envelope of the control signal. The control signal may also be obtained by other methods, including, for example, lowpass filtering, bandpass filtering, peak detection, RMS averaging, mean value averaging, etc.

Figure 19:
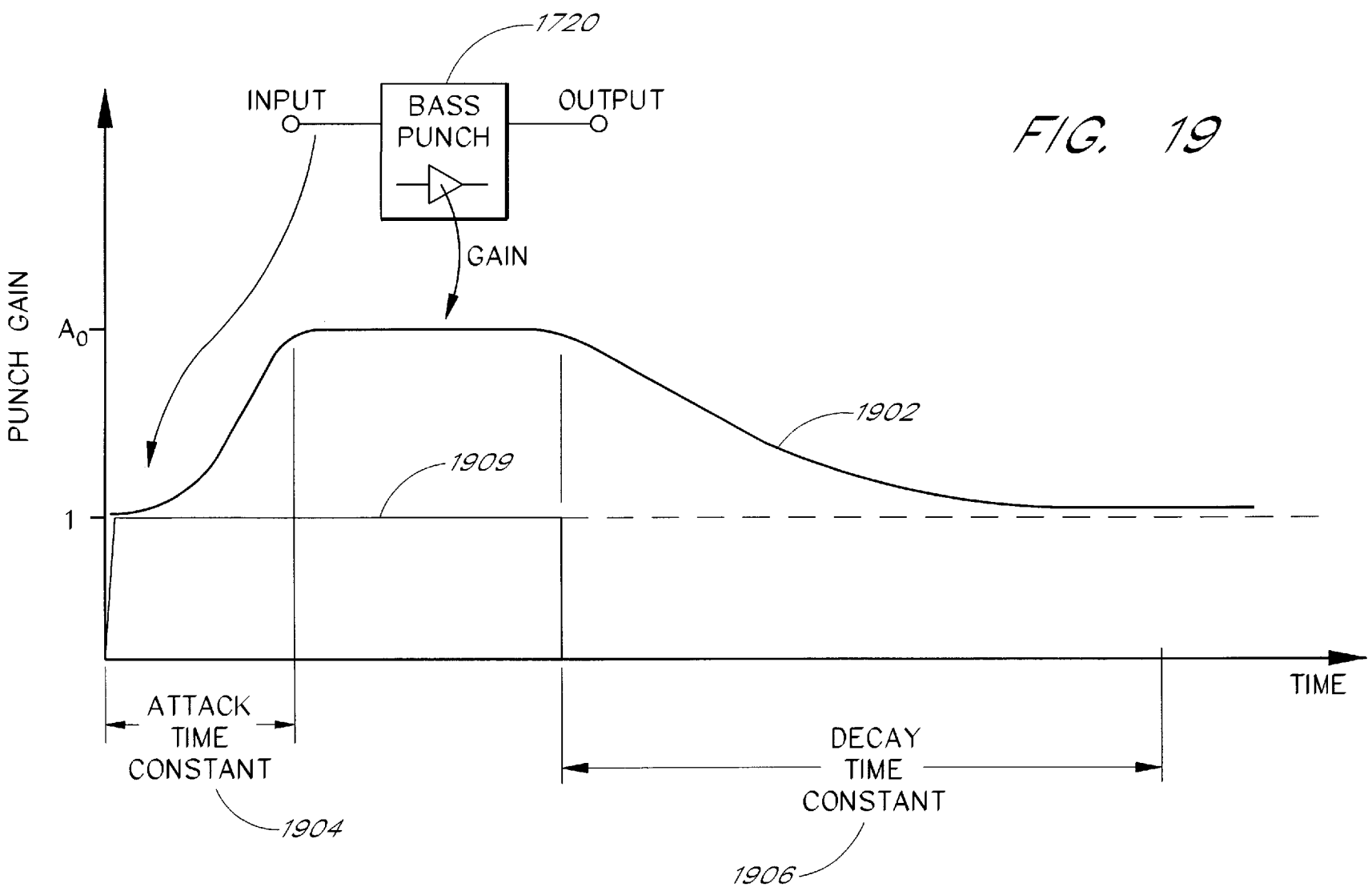
FIG. 19 is a time-domain plot showing the time-amplitude response of the punch circuit.

In response to an increase in the amplitude of the envelope of the signal provided to the input of the bass punch unit 1720, the servo loop increases the forward gain of the bass punch unit 1720. Conversely, in response to a decrease in the amplitude of the envelope of the signal provided to the input of the bass punch unit 1720, the servo loop increases the forward gain of the bass punch unit 1720. In one embodiment, the gain of the bass punch unit 1720 increases more rapidly that the gain decreases. FIG. 19 is a time domain plot that illustrates the gain of the bass punch unit 1720 in response to a unit step input. One skilled in the art will recognize that FIG. 19 is a plot of gain as a function of time, rather than an output signal as a function of time. Most amplifiers have a gain that is fixed, so gain is rarely plotted. However, the automatic gain control (AGC) in the bass punch unit 1720 varies the gain of the bass punch unit 1720 in response to the envelope of the input signal.

The unit step input is plotted as a curve 1909 and the gain is plotted as a curve 1902. In response to the leading edge of the input pulse 1909, the gain rises during a period 1904 corresponding to an attack time constant. At the end of the time period 1904, the gain 1902 reaches a steady-state gain of $A_0$. In response to the trailing edge of the input pulse 1909 the gain falls back to zero during a period 1906 corresponding to a decay time constant 1906.

Figure 20:
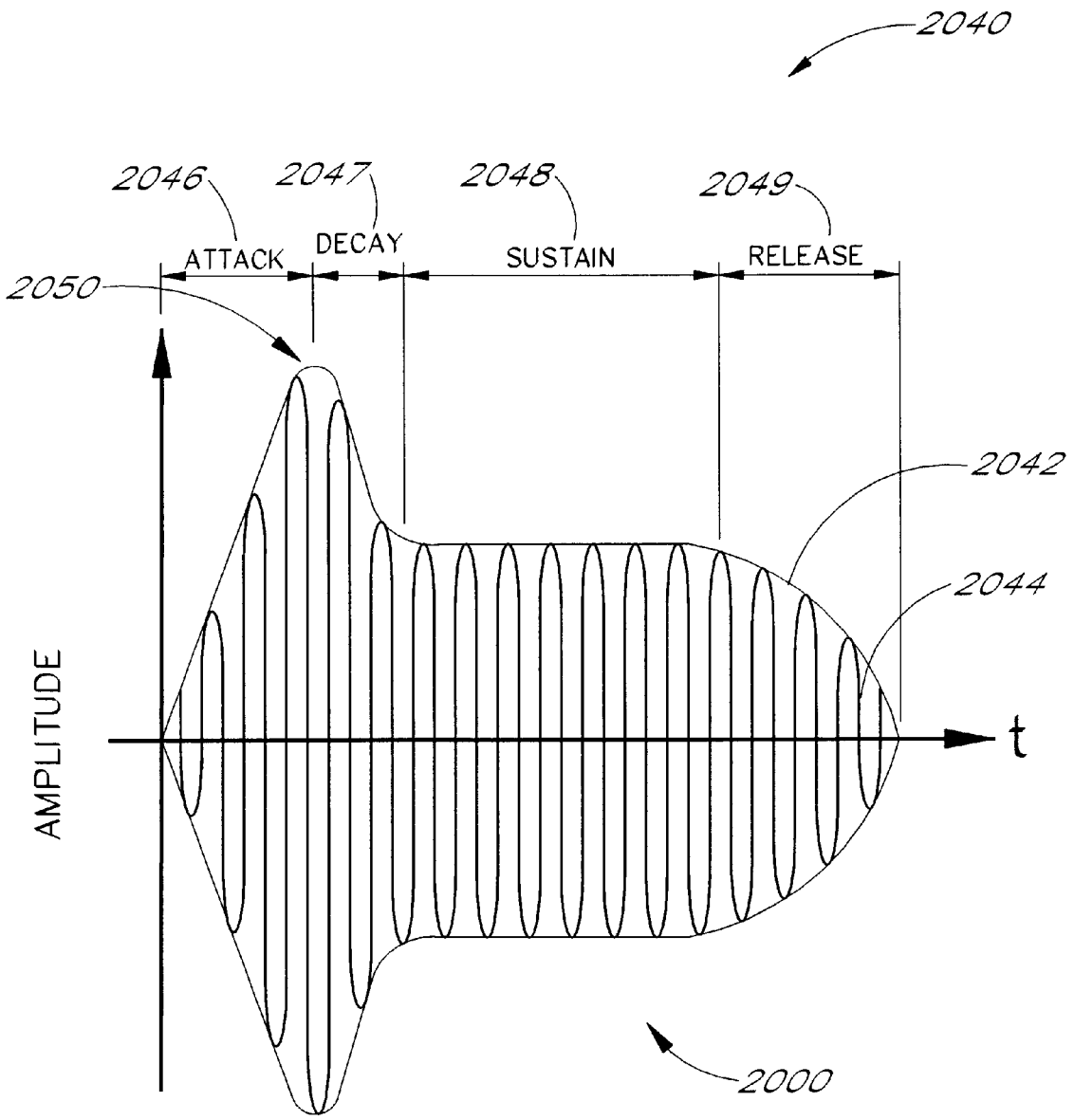
FIG. 20 is a time-domain plot showing the signal and envelope portions of a typical bass note played by an instrument, wherein the envelope shows attack, decay, sustain and release portions.

The attack time constant 1904 and the decay time constant 1906 are desirably selected to provide enhancement of the bass frequencies without overdriving other components of the system such as the amplifier and loudspeakers. FIG. 20 is a time-domain plot 2000 of a typical bass note played by a musical instrument such as a bass guitar, bass drum, synthesizer, etc. The plot 2000 shows a higher-frequency portion 2004 that is amplitude modulated by a lower-frequency portion having a modulation envelope 2042. The envelope 2042 has an attack portion 2046, followed by a decay portion 2047, followed by a sustain portion 2048, and finally, followed by a release portion 2049. The largest amplitude of the plot 2000 is at a peak 2050, which occurs at the point in time between the attack portion 2046 and the decay portion 2047.

As stated, the waveform 2044 is typical of many, if not most, musical instruments. For example, a guitar string, when pulled and released, will initially make a few large amplitude vibrations, and then settle down into a more or less steady state vibration that slowly decays over a long period. The initial large excursion vibrations of the guitar string correspond to the attack portion 2046 and the decay portion 2047. The slowly decaying vibrations correspond to the sustain portion 2048 and the release portions 2049. Piano strings operate in a similar fashion when struck by a hammer attached to a piano key.

Piano strings may have a more pronounced transition from the sustain portion 2048 to the release portion 2049, because the hammer does not return to rest on the string until the piano key is released. While the piano key is held down, during the sustain period 2048, the string vibrates freely with relatively little attenuation. When the key is released, the felt covered hammer comes to rest on the key and rapidly damps out the vibration of the string during the release period 2049.

Similarly, a drumhead, when struck, will produce an initial set of large excursion vibrations corresponding to the attack portion 2046 and the decay portion 2047. After the large excursion vibrations have died down (corresponding to the end of the decay portion 2017) the drumhead will continue to vibrate for a period of time corresponding to the sustain portion 2048 and release portion 2049. Many musical instrument sounds can be created merely by controlling the length of the periods 2046–2049.

As described in connection with FIG. 4C, the amplitude of the higher-frequency signal is modulated by a lower-frequency tone (the envelope), and thus, the amplitude of the higher-frequency signal varies according to the frequency of the lower frequency tone. The non-linearity of the ear will partially demodulate the signal such that the ear will detect the low-frequency envelope of the higher-frequency signal, and thus produce the perception of the low-frequency tone, even though no actual acoustic energy was produced at the lower frequency. The detector effect can be enhanced by proper signal processing of the signals in the midbass frequency range, typically between 50–150 Hz on the low end of the range and 200–500 Hz on the high end of the range. By using the proper signal processing, it is possible to design a sound enhancement system that produces the perception of low-frequency acoustic energy, even when using loudspeakers that are incapable of producing such energy.

The perception of the actual frequencies present in the acoustic energy produced by the loudspeaker may be deemed a first order effect. The perception of additional harmonics not present in the actual acoustic frequencies, whether such harmonics are produced by intermodulation distortion or detection may be deemed a second order effect.

However, if the amplitude of the peak 2050 is too high, the speakers (and possibly the power amplifier) will be overdriven. Overdriving the loudspeakers will cause a considerable distortion and may damage the loudspeakers.

The bass punch unit 1720 desirably provides enhanced bass in the midbass region while reducing the overdrive effects of the peak 2050. The attack time constant 1904 provided by the bass punch unit 1720 limits the rise time of the gain through the bass punch unit 1720. The attack time constant of the bass punch unit 1720 has relatively less effect on a waveform with a long attack period 2046 (slow envelope risetime) and relatively more effect on a waveform with a short attack period 2046 (fast envelope risetime).

FIG. 21 A shows a time-domain plot of the gain of the bass punch unit 1720 in relation to an envelope 2104 of an input waveform with a long attack period 2046. One skilled in the art will recognize that only the envelope 2104 of the input waveform is plotted in FIG. 21A and not the actual waveform (the relationship between an actual waveform and its envelope is discussed in connection with FIGS. 4C and 20). The input waveform having an envelope 2104 is provided to the bass punch unit 1720 and the bass punch unit 1720 produces an output waveform with an envelope 2106. For reference, FIG. 21C is a time-domain plot of the gain of the bass punch unit 1720. The time axis of FIG. 21A is aligned with the time axis of FIG. 21C to further illustrate that the attack period of the envelope 2104 is long in comparison to the attack time of the bass punch unit 1720.

Because the increase in gain of the bass punch unit 1720, which is controlled by the attack time, can "keep up" with the attack portion of the input envelope 2104, the bass punch unit 1720 has relatively less shaping effect on the risetime of the envelope 2104 other than to provide some gain. Thus, the output envelope 2106 is similar to the input envelope 2104 but with increased gain. As a result, the actual output signal corresponding to the output envelope 2106 is similar to the actual input signal corresponding to the input envelope 2104, but with increased gain.

FIG. 21 B shows a time-domain plot of an input envelope 2114 having a short attack period. The input envelope 2114 is provided to the bass punch unit 1720 and the bass punch circuit 1720 produces an output envelope 2116. The time axis of FIG. 21C is aligned with the time axis of FIGS. 21A and 21B to further illustrate that the attack period of the envelope 2114 is short in comparison to the attack time of the bass punch unit 1720.

Since the increase in gain of the bass punch unit 1720, which is controlled by the attack time, cannot "keep up" with the attack portion of the input envelope 2114, the rise time of the output envelope 2116 is similar to the risetime of the input waveform 2114. Thus, the maximum amplitude of the output waveform 2116 is similar to the maximum amplitude of the input envelope 2114. The output envelope 2116, being limited by the attack time, desirably does not include increased gain added by the punch unit 1720 because the attack period of the input waveform happens too fast for the bass punch unit 1720 to track. This minimized the possibility that the increased gain provided by the punch unit 1720 will overdrive the amplifier or loudspeakers. However, by the time the input envelope 2116 reaches a more or less steady state value, during the sustain period 2048, the gain of the punch unit 1720 has "caught up" with the input envelope and thus during the sustain period, the amplitude of the output envelope 2116 is larger than the amplitude of the input envelope 2114.

Figure 21A:
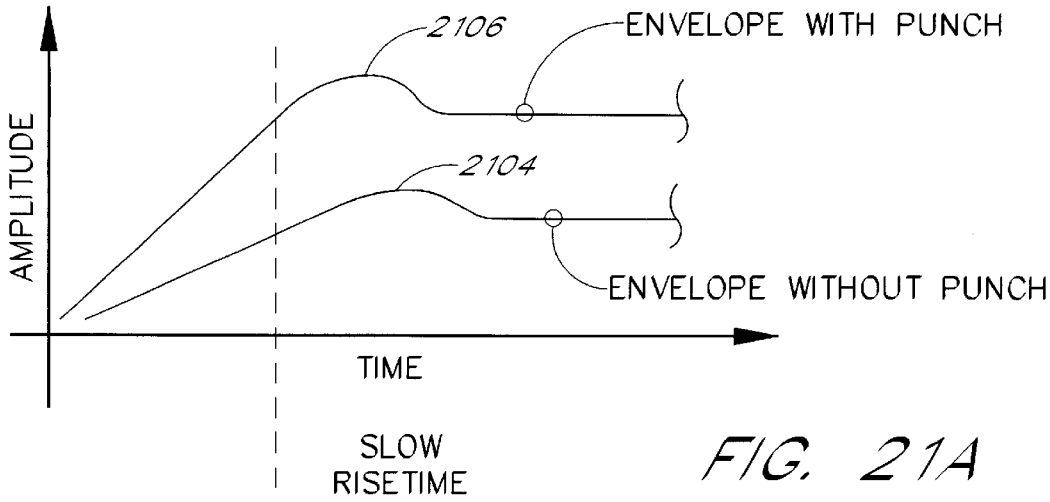
FIG. 21A is a time-domain plot showing the effect of the bass punch circuit on an envelope with a slow attack.
Figure 21B:
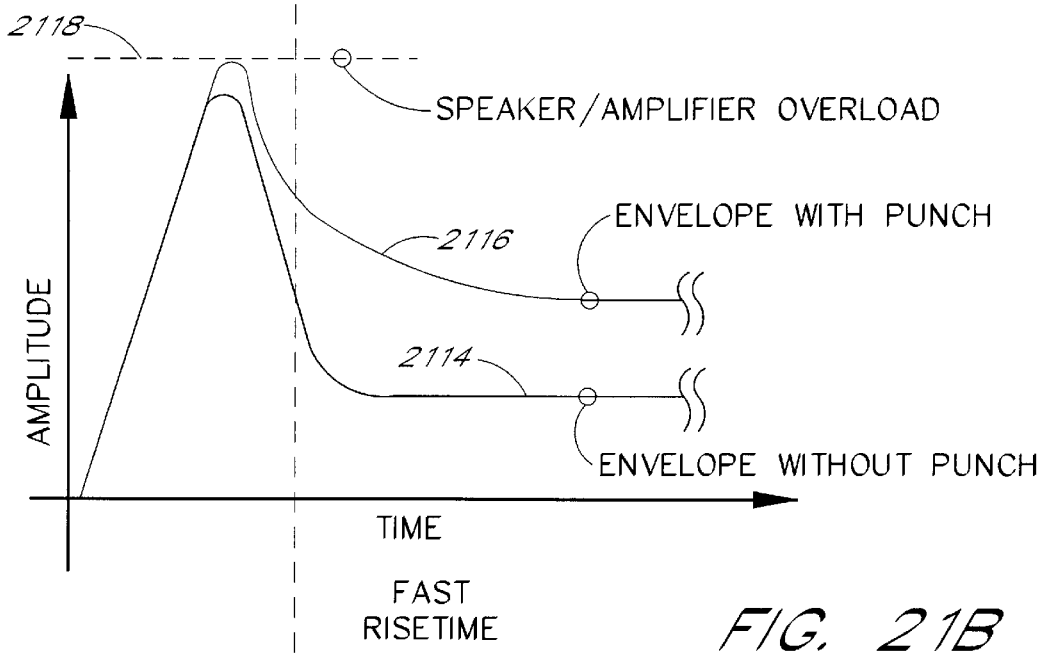
FIG. 21B is a time-domain plot showing the effect of the bass punch circuit on an envelope with a fast attack.
Figure 21C:
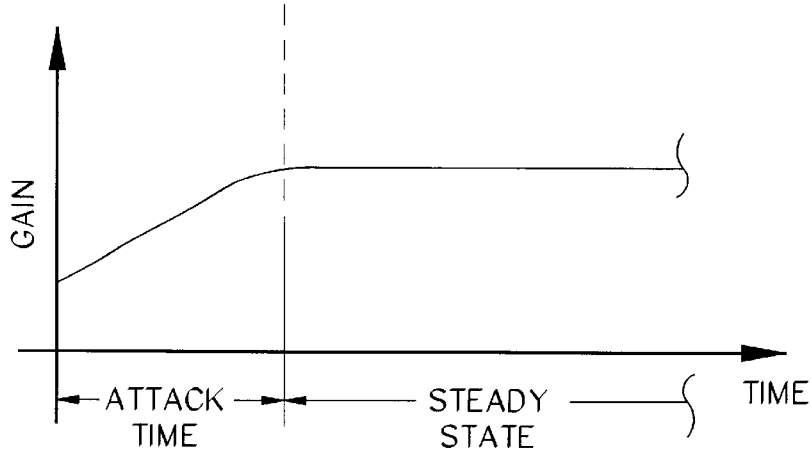
FIG. 21C is a time-domain plot of the attack time in connection with FIGS. 21A and 21B.

As shown in FIG. 21B, the action of the bass punch unit 1720 provides relatively higher gain in the long-term gain while desirably providing relatively lower gain in the short-term gain in order to reduce the chances of over-amplifying transients and pulses in the input signal that would overdrive the loudspeakers. FIG. 21B shows an amplitude line 2118 corresponding to the amplitude that will overdrive the loudspeakers (and/or power amplifiers). The peak amplitude of the input envelope 2114 is similar to the line 2118, because, during the attack time period, the gain of the bass 1720 has not reached its maximum value.

Figure 21D:
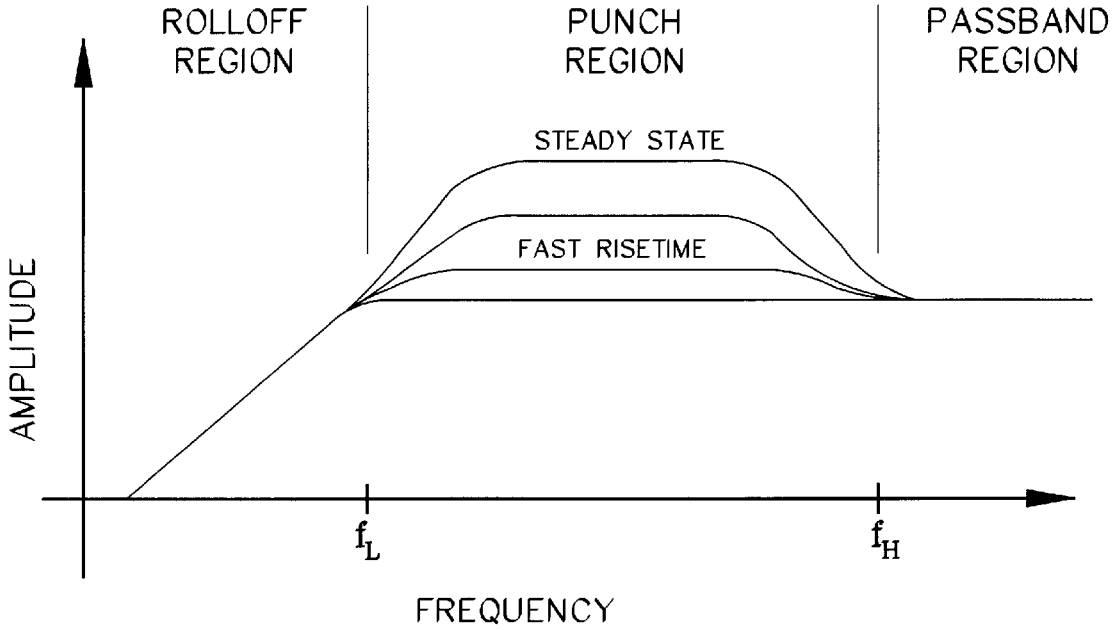
FIG. 21D is a frequency-domain plot showing amplitude response curves for the bass enhancement system shown in FIG. 17 that includes the bass punch transfer functions shown in FIGS. 21A–D.

FIG. 21D shows a frequency-domain plot of the amplitude response of the bass enhancement circuit 1700. The frequency selection provided by the filters 1711–1715 limits the action of the bass punch unit 1720 to a punch frequency region primarily bounded by a lower frequency $f_L$ and an upper frequency $f_L$. The frequency region below $f_L$ is a rolloff region. In the rolloff region, the bass enhancement circuit 1700 provides a transfer function that is close to unity. This is termed the rolloff region because typical small loudspeakers produce little acoustic output in this region. The region above the frequency $f_H$ is a passband region where the bass enhancement circuit provides a transfer function that is close to unity.

In the punch region, the bass enhancement circuit 1700 provides a time-dependent gain, owing to the time dependent gain of the bass punch circuit 1720. FIG. 21D shows a family of gain curves in the punch frequency region, corresponding to input signals with different envelope rise-times. For input signals with a relatively fast envelope risetime, the gain of bass enhancement circuit 1700 in the punch frequency region is smaller than the gain for a signal with a slowly varying (approximately steady state) envelope.

Figure 22:
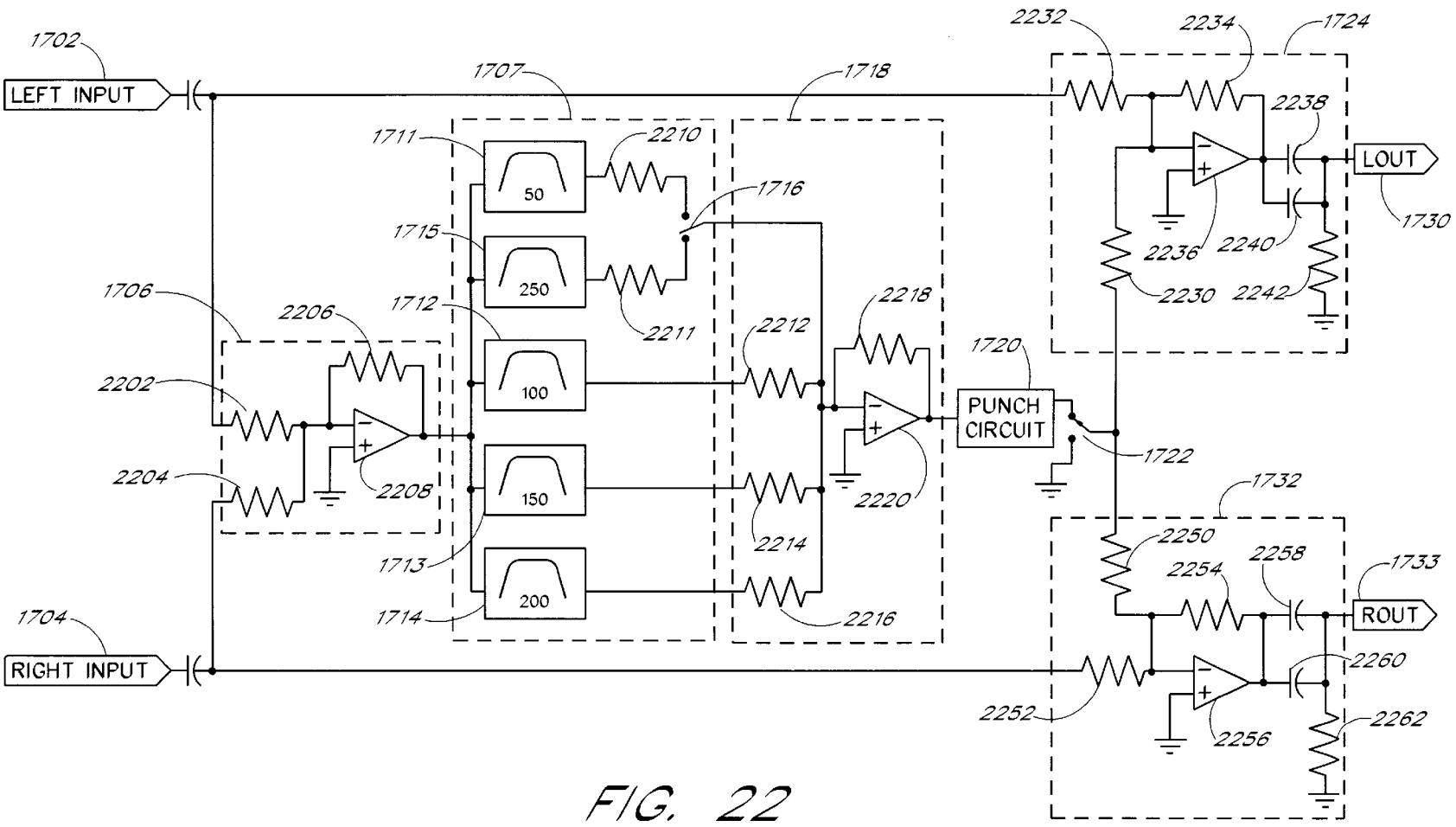
FIG. 22 shows one embodiment of a circuit diagram that implements the bass enhancement system shown in FIG. 17.

FIG. 22 is a circuit schematic showing one embodiment of the bass enhancement circuit 1700. The inputs 1702 and 1704 are provided to the first and second terminals of the adder 1706. DC-blocking capacitors may be tied in series with the inputs 1702 and 1704 to provide a DC block at the inputs of the bass enhancement circuit 1700.

The first terminal of the adder 1706 corresponds to a first terminal of a resistor 2202 and the second terminal of the adder 1706 corresponds to the first terminal of a resistor 2204. A second terminal of the resistor 2202 and a second terminal of the resistor 2204 are provided to an inverting input of an op-amp 2208. A non-inverting input of the op-amp 2208 is provided to ground. An output of the op-amp is provided to the first terminal of a feedback resistor 2206. A second terminal of the feedback resistor 2206 is provided to the inverting input of the op-amp 2208. The output of the op-amp 2206 corresponds to the output of the adder 1706.

In one embodiment, the DC-blocking capacitors are 4.7 uF capacitors, and the resistors 2202, 2204, and 2206 are 100 k-ohm resistors.

The filters 1711–1715 use the topology shown in FIG. 9, using TL074 op-amps manufactured by Texas Instruments Inc., and the resistor component values given in Table 3.

TABLE 3

| Filter | Center Frequency (Hz) | R1 (KΩ) | R2 (KΩ) | R3 (KΩ) |
|---|---|---|---|---|
| 1711 | 50 | 53.6.0 | 7.5 | 105.0 |
| 1712 | 100 | 31.6 | 4.53 | 63.4 |
| 1713 | 150 | 21.0 | 3.09 | 42.46 |
| 1714 | 200 | 15.8 | 2.26 | 31.6 |
| 1715 | 250 | 12.7 | 1.82 | 25.5 |

The output of the bandpass filter 1711 is provided to a first terminal of a resistor 2210. The output of the bandpass filter 1715 is provided to a first terminal of a resistor 2211. A second terminal of the resistor 2210 is provided to the first throw of the SPDT switch 1716 and a second terminal of the resistor 2211 is provided to the second throw of the switch 1716. The pole of the SPDT switch 1716 is provided to a first terminal of the adder 1718. The first terminal of the adder 1718 is provided to an inverting input of an op-amp 2220.

The outputs of the bandpass filters 1712–1714 are provided to a second, a third, and a fourth input of the adder 1718, respectively. The first input of the adder 1718 corresponds to the first terminal of a resistor 2210. The second input of the adder 1718 corresponds to the first terminal of a resistor 2212. The third input of the adder 1718 corresponds to the first terminal of a resistor 2214. The fourth input of the adder 1718 corresponds to the first terminal of a resistor 2216. A second terminal of each of the resistors 2210, 2212, 2214, and 2216 are provided to an inverting input of an op-amp 2220. An output of the op-amp 2220 is provided to a first terminal of a feedback resistor 2218. A second terminal of the feedback resistor 2218 is provided to the inverting input of the op-amp 2220. A non-inverting input of the op-amp 2220 is provided to ground. The output of the op-amp 2220 corresponds to the output of the adder 1718. The adder 1718 may also be implemented using, for example, digital signal processing, transistors, etc. The bandpass filters 1711–1715 and the adder 1718 may also be combined by providing a filter (e.g. a bandpass filter) with a transfer function similar to the transfer function achieved by summing the response of the bandpass filters 1711–1715.

In one embodiment, the resistors 2211, 2212, 2214, and 2214 are 100 k-ohm resistors and the resistor 2210 is a 69.8 k-ohm resistor. The op-amp 2220 is a TL074 and the feedback resistor 2218 is a 13.0 k-ohm resistor. One skilled in the art will recognize that the adder 1718 provides a weighted sum, wherein the outputs of the filters 1712–1715 all have a weight of approximately 0.13 and the output of the filter 1711 has a weight of approximately 0.186. The frequencies from the filter 1711, having a center frequency of 50 Hz, are provided at a lesser amplitude to avoid overdriving a small speaker with large, low-frequency, signals. Other weighting functions may be used as well, including, for example, a non-uniform weighting function, a uniform weighting function, etc. The weighting function may also be accomplished by using bandpass or other filters having a weighted transfer function in combination with an adder.

The pole of the SPDT switch 1722 is provided to the first input of the left-channel adder 1724 and to the first input of the right-channel adder 1732. The first input of the left-channel adder corresponds to a first terminal of a resistor 2230. The second input of the left-channel adder corresponds to a first terminal of a resistor 2232. A second terminal of the resistor 2230 and a second terminal of the resistor 2232 are provided to an inverting input of an op-amp 2236. A non-inverting input of the op-amp 2236 is provided to ground. An output of the op-amp 2236 is provided to a first terminal of a capacitor 2238, to a first terminal of a capacitor 2240, and to a first terminal of a feedback resistor 2234. A second terminal of the feedback resistor 2234 is provided to the inverting input of the op-amp 2236. A second terminal of the capacitor 2238 and a second terminal of the capacitor 2240 are provided to a first terminal of an output resistor 2242. The firs terminal of the output resistor is provided to the left-channel output 1730. A second terminal of the output resistor 2242 is provided to ground.

The first input of the left-channel adder corresponds to a first terminal of a resistor 2250. The second input of the right-channel adder corresponds to a first terminal of a resistor 2252. A second terminal of the resistor 2250 and a second terminal of the resistor 2252 are provided to an inverting input of an op-amp 2256. A non-inverting input of the op-amp 2256 is provided to ground. An output of the op-amp 2256 is provided to a first terminal of a capacitor 2258, to a first terminal of a capacitor 2260, and to a first terminal of a feedback resistor 2254. A second terminal of the feedback resistor 2254 is provided to the inverting input of the op-amp 2256. A second terminal of the capacitor 2258 and a second terminal of the capacitor 2260 are provided to a first terminal of an output resistor 2262. The first terminal of the output resistor 2262 is provided to the right-channel output 1733. A second terminal of the output resistor 2262 is provided to ground.

In one embodiment, the resistors 2232, 2234, 2252, and 2254 are 100 k-ohm resistors, the resistors 2230 and 2250 are 33.2 k-ohm resistors, and the resistors 2242 and 2262 are 10 k-ohm resistors. The capacitors 2238 and 2258 are 4.7 uF capacitors and the capacitors 2240 and 2260 are 0.01 uF capacitors. The op-amps 2236 and 2256 are TL074. One skilled in the art will recognize that the adders 1724 and 1732 each produce a weighted sum wherein the first input of each adder (the input provided by the pass punch unit 1720) has a weight of approximately 3.01 and the second input of each adder has a weight of approximately 1.0.

Figure 23:
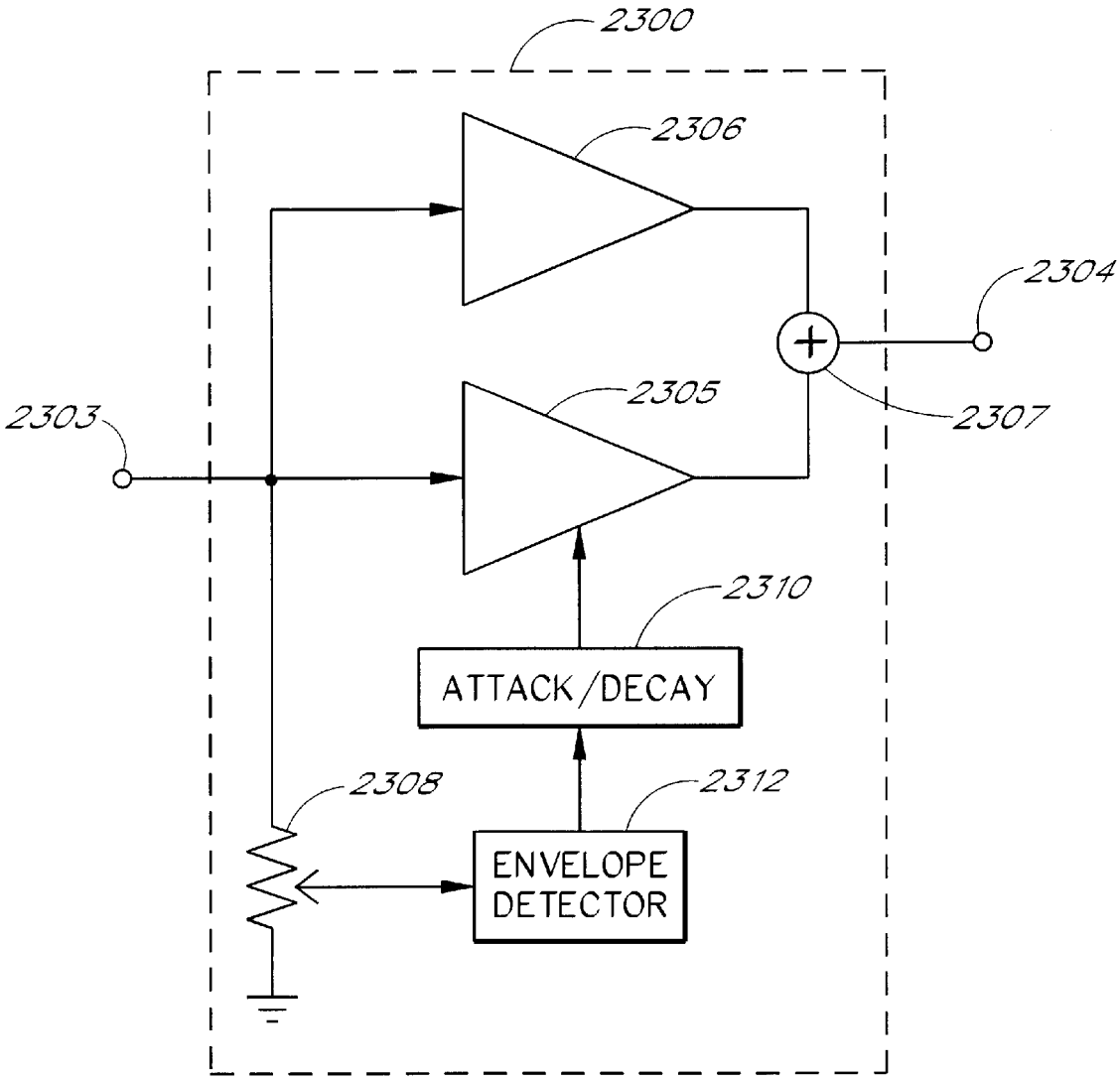
FIG. 23 is a block diagram of one embodiment of a bass punch circuit.
Figure 24:
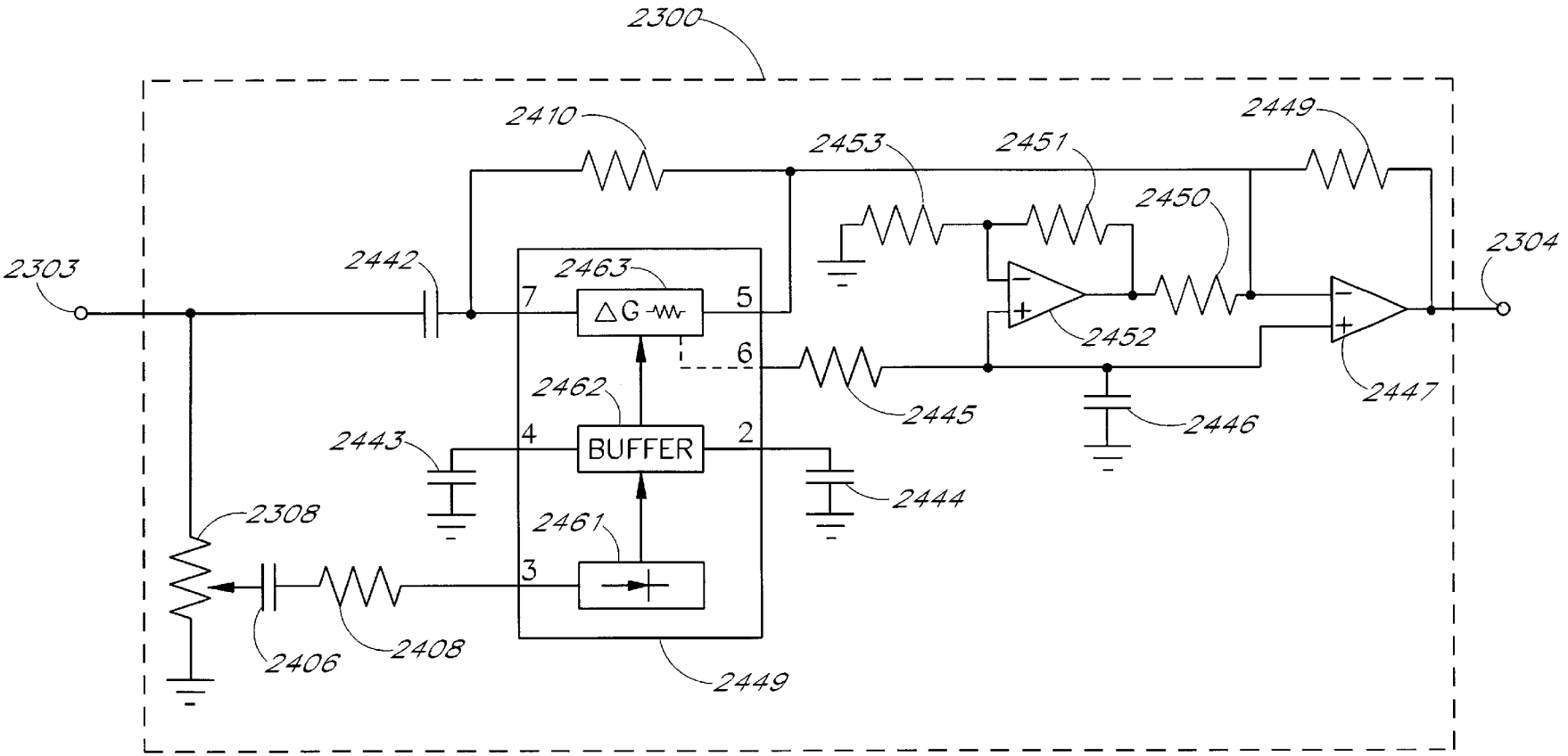
FIG. 24 is a circuit diagram of one implementation of the bass punch circuit shown in FIG. 23.

A block diagram of one embodiment of the bass punch unit 1720 is shown in FIG. 23 as a block diagram 2300, and a corresponding circuit diagram is shown in FIG. 24. In FIG. 23, an input 2303 is provided to a first input of a fixed gain amplifier 2306, to a first input of a variable gain amplifier 2305, and to a first fixed terminal of a potentiometer 2308. A second fixed terminal of the potentiometer 2308 is provided to ground, and a wiper terminal of the potentiometer 2308 is provided to an input of an envelope detector 2312. An output of the envelope detector 2312 is provided to an attack/decay buffer 2310. An output of the attack/decay buffer 2310 is provided to a gain control input of the gain-controlled amplifier 2305. An output of the fixed gain amplifier 2306 is provided to a first input of an output adder 2307 and an output of the variable gain amplifier 2305 is provided to a second input of the output adder 2307. An output of the output adder 2307 is provided to a bass punch output 2304.

The fixed gain amplifier 2306 provides a unity gain feedforward path to the output adder 2307. Thus, even if the gain of the gain-controlled 2308 is zero, the feedforward path will provide the base punch circuit 2300 with a minimum gain of 1.0. The potentiometer 2308 is connected as a voltage divider to select a portion of the input signal. The selected portion is provided to the envelope detector 2312. The output of the envelope detector is a signal that approximates the envelope of the input signal. The envelope signal is provided to the attack/decay buffer. When the envelope signal has a positive slope (rising edge) the attack/decay buffer provides a signal to increase the gain of the gain-controlled amplifier at a rate given by the attack time constant. When the envelope signal has a negative slope (falling edge) the attack/decay buffer provides a signal to decrease the gain of the gain-controlled amplifier at a rate given by the decay time constant.

The bass punch unit 2300 shown in FIG. 23 is an expander because the gain of the unit 2300, and thus the output level, is controlled by the input signal. As the average amplitude of the input signal increased, the gain increases. Conversely, as the average input signal level decreases, the gain decreases. Maximum expansion of the input signal is produced when the potentiometer 2308 is positioned such that all of the input signal is selected and provided to the envelope detector 2312. Minimum expansion occurs, and the gain drops to unity, when the potentiometer 2308 is positioned such that none of the input signal is selected (i.e., the input to the envelope detector 2312 is grounded). Increasing the amount of expansion will increase the perception of bass, but will also increase the chances of overdriving the loudspeakers. The potentiometer 2308 is desirably positioned to provide sufficient expansion of the input signal to enhance the perception of bass without unduly increasing the chances of overdriving the loudspeakers.

FIG. 24 is a circuit diagram illustrating one embodiment of the bass punch unit 2300. In FIG. 24, the input 2303 is provided to a first terminal of a capacitor 2442 and to the first fixed terminal of the potentiometer 2308. A second fixed terminal of the potentiometer 2308 is provided to ground, and a wiper terminal of the potentiometer 2308 is provided to a first terminal of a capacitor 2406. A second terminal of the capacitor 2406 is provided to a first terminal of a resistor 2408 and a second terminal of the resistor 2408 is provided to an envelope detector input (pin 3) of a gain control circuit 2449. In one embodiment, the gain control circuit 2449 is an NE572 as discussed in connection with FIG. 14 and Table 2. A first terminal of an attack timing capacitor 2443 is provided to an attack control input (pin 4) of the gain control circuit 2449 and a second terminal of the attack timing capacitor 2443 is provided to ground. A first terminal of a decay timing capacitor 2444 is provided to a decay control input (pin 2) of the gain control circuit 2449 and a second terminal of the decay timing capacitor 2444 is provided to ground.

A second terminal of the capacitor 2442 is provided to a $V_{in}$ terminal (pin 7) of the gain control circuit 2449 and to a first terminal of a resistor 2410. A second terminal of the resistor 2410 is provided to a $V_{out}$ terminal (pin 5) of the gain control circuit 2449 and to an inverting input of an op-amp 2447. A non-inverting input of the op-amp 2447 is provided to a terminal of a grounded capacitor 2446, to a non-inverting input of an op-amp 2452, and to a first terminal of a resistor 2445. A second terminal of the resistor 2445 is provided to a THD terminal (pin 6) of the gain control circuit 2449.

An output of the op-amp 2447 is provided to the output 2304 and to a first terminal of a feedback resistor 2449. A second terminal of the feedback resistor 2449 is provided to the inverting input of the op-amp 2447.

An inverting input of the op-amp 2452 is provided to a terminal of a grounded resistor 2453 and to a first terminal of a feedback resistor 2451. A second terminal of the feedback resistor 2451 is provided to an output of the op-amp 2452 and to a first terminal of a resistor 2450. A second terminal of the resistor 2450 is provided to the inverting input of the op-amp 2447.

In one embodiment, the potentiometer 2308 is a 1.0 k-ohm linear potentiometer. The capacitors 2442, 2406, and 2446 are 2.2 uF capacitors. The attack timing capacitor is a 1.0 uF capacitor and the decay timing capacitor 2444 is a 10 uF capacitor. The resistor 2408 is a 3.1 k-ohm resistor, and the resistor 2445 is a 1.0 k-ohm resistor. The resistors 2453 and 2451 are 10 k-ohm resistors, and the resistors 2410, 2449, and 2450 are 17.4 k-ohm resistors.

The gain control circuit 2449 includes an envelope detector 2461, an attack/decay buffer 2462, and a gain element 2463. As in the block diagram in FIG. 23, an output of the envelope detector 2461 is provided to the attack/decay buffer 2462, and an output of the attack/decay buffer 2462 controls the gain element 2463. The attack and delay time constants are controlled by resistor-capacitor (RC) networks. The attack/decay buffer 2462 provides an internal 10 k-ohm resistor for the attack RC network and an internal 10 k-ohm resistor for the decay RC network. The 1.0 uF attack capacitor 2443 produces an attack time constant of approximately 40 ms (milliseconds). The 10 uF decay capacitor 2444 produces a decay time constant of 400 ms. In other embodiments the attack time constant may range from 5 ms to 400 ms and the decay time constant may range from 100 ms to 1000 ms.

The gain element 2463 is similar to an electronically variable resistor and used in connection with the feedback circuit of the op-amp 2447 to vary the gain of the op-amp 2447. The op-amp 2452 provides a DC bias. The unity gain feedforward path is provided by the resistor 2410.

The bass punch unit 1720 also acts to modify and enhance the audio waveform by enhancing the harmonics of some low-frequency sounds and by enhancing the fundamentals of other low frequency sounds. By enhancing the harmonics of some low-frequency sounds, the bass punch unit 1720 exploits the way in which the human ear processes overtones and harmonics of the low-frequency sounds to create the perception that the low-frequency sounds are being emitted from a loudspeaker. The bass punch unit 1720 produces the perception that the loudspeaker is producing many low-frequency sounds, even low-frequency sounds that are poorly reproduced by the loudspeakers. In addition, the action of the bass punch unit 1720 provides relatively higher gain in the long-term gain while desirably providing relatively lower gain in the short-term gain in order to reduce the chances of over-amplifying transients and pulses in the input signal that would overdrive the loudspeakers. In response to an increase in the input signal over time, the gain of the bass punch unit 1720 increases according to an attack time constant. In response to a decrease in the input signal over time, the gain of the bass punch unit decreases according to a decay time constant. The action of the attack time constant and the decay time serves to reduce the amplification of short term increases in the input signal and thus reduce the chances of overdriving the speakers.

Bass Punch with Peak Compression

As shown in FIGS. 20 and 21B, an attack portion of a note played by a bass instrument (e.g., a bass guitar) will often begin with an initial pulse of relatively high amplitude. This peak may, in some cases, overdrive the amplifier or loudspeaker causing distorted sound and possibly damaging the loudspeaker or amplifier. The bass enhancement processor provides a flattening of the peaks in the bass signal while increasing the energy in the bass signal, thereby increasing the overall perception of bass.

The energy in a signal is a function of the amplitude of the signal and the duration of the signal. Stated differently, the energy is proportional to the area under the envelope of the signal. Although the initial pulse of a bass note may have a relatively large amplitude, the pulse often contains little energy because it is of short duration. Thus, the initial pulse, having little energy, often does not contribute significantly to the perception of bass. Accordingly, the initial pulse can usually be reduced in amplitude without significantly affecting the perception of bass.

Figure 25:
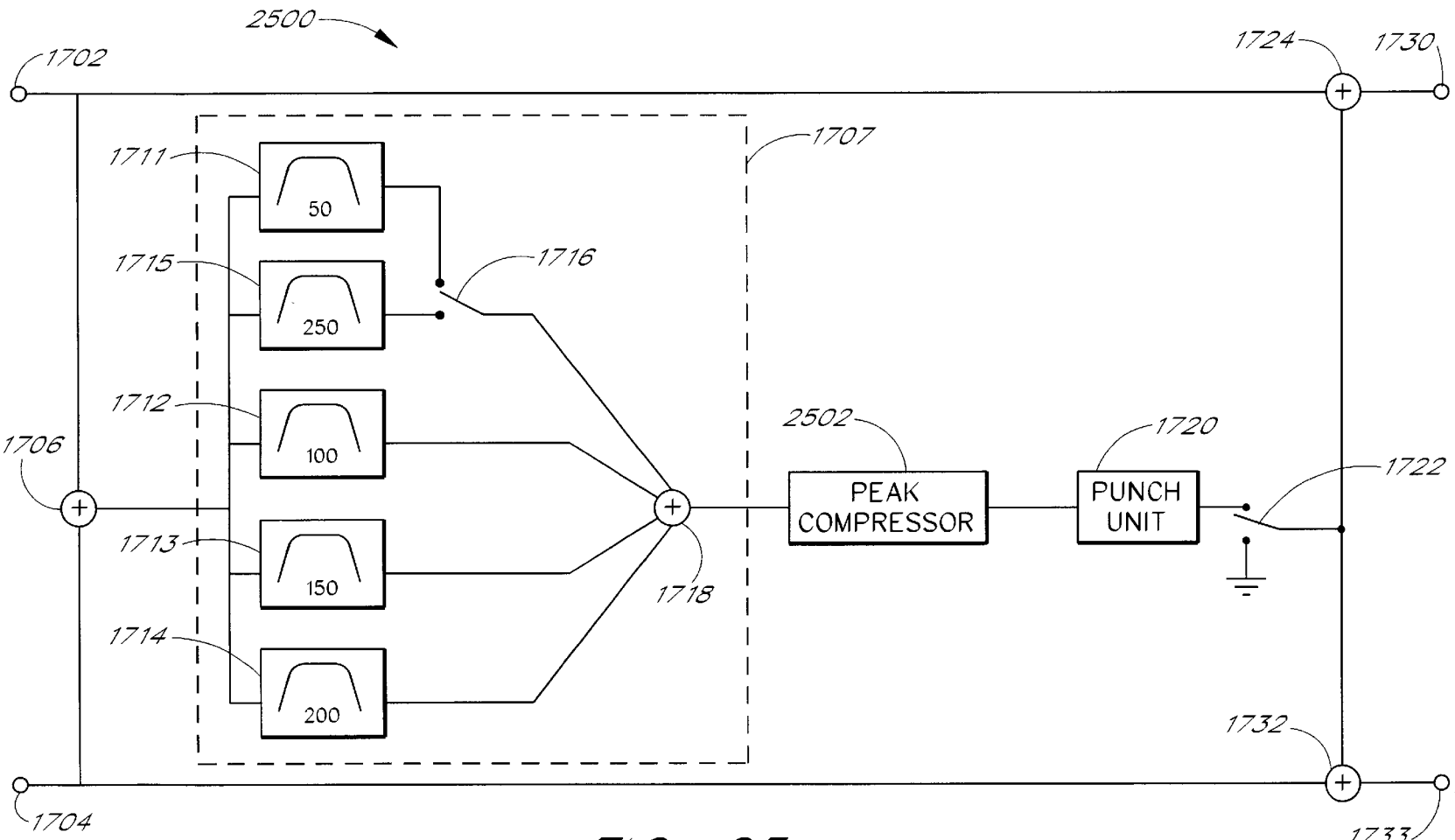
FIG. 25 is a signal processing block diagram of a system that provides bass enhancement using a peak compressor and a bass punch circuit.

FIG. 25 is a signal processing block diagram of a bass enhancement system 2500 that provides bass enhancement using a peak compressor to control the amplitude of pulses, such as the initial pulse, bass notes. In the system 2500, a peak compressor 2502 is interposed between the combiner 1718 and the punch unit 1720. The output of the combiner 1718 is provided to an input of the peak compressor 2502, and an output of the peak compressor 2502 is provided to the input of the bass punch unit 1720.

The comments above relating FIG. 17 to FIGS. 16B and 16C apply to the topology shown in FIG. 25 as well. For example, as shown, FIG. 25 corresponds approximately to the topology shown in FIG. 16B, where the signal processing blocks 1613 and 1615 have a transfer function of unity and the signal processing block 1612 comprises the composite filter 1707, the peak compressor 2502, and the bass punch unit 1720. However, the signal processing shown in FIG. 25 is not limited to the topology shown in FIG. 16B. The elements of FIG. 25 may also be used in the topology shown in FIG. 16C. Although not shown in FIG. 25, the signal processing blocks 1613, 1615, 1621, and 1623 may provide additional signal processing, such as, for example, high pass filtering to remove low bass frequencies, high pass filtering to remove frequencies processed by the bass punch unit 1702 and the compressor 2502, high frequency emphasis to enhance the high frequency sounds, additional mid bass processing to supplement the bass punch circuit 1720 and peak compressor 2502, etc. Other combinations are contemplated as well.

The peak compression unit 2502 "flattens" the envelope of the signal provided at its input. For input signals with a large amplitude, the apparent gain of the compression unit 2502 is reduced. For input signals with a small amplitude, the apparent gain of the compression unit 2502 is increased. Thus the compression unit reduces the peaks of the envelope of the input signal (and fills in the troughs in the envelope of the input signal). Regardless of the signal provided at the input of the compression unit 2502, the envelope (e.g., the average amplitude) of the output signal from the compression unit 2502 has a relatively uniform amplitude.

Figure 26:
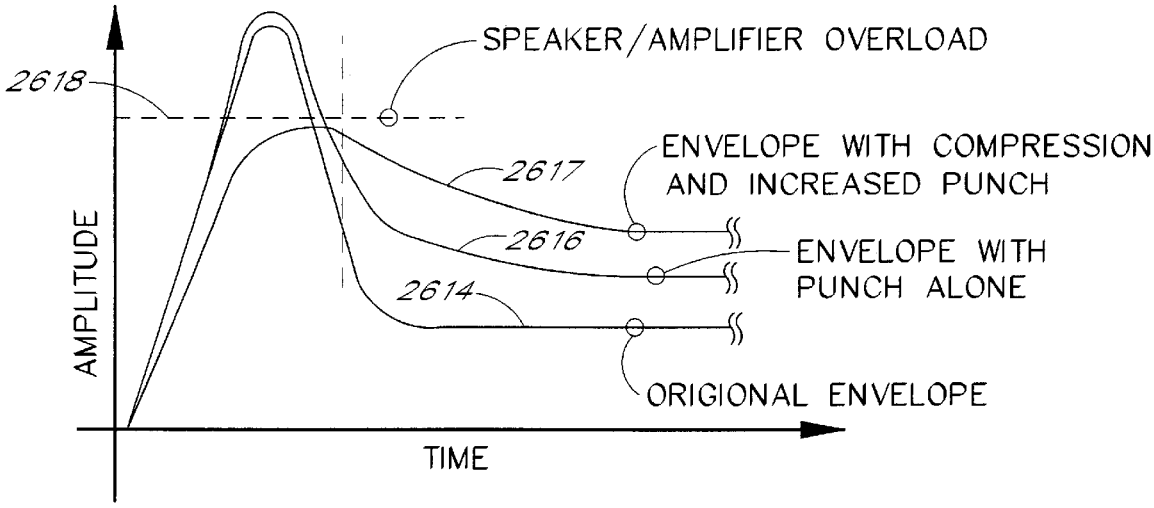
FIG. 26 is a time-domain plot showing the effect of the peak compressor on an envelope with a fast attack.

FIG. 26 is a time-domain plot showing the effect of the peak compressor on an envelope with an initial pulse of relatively high amplitude. FIG. 26 shows a time-domain plot of an input envelope 2614 having an initial large amplitude pulse followed by a longer period of lower amplitude signal. An output envelope 2616 shows the effect of the bass punch unit 1720 on the input envelope 2614 (without the peak compressor 2502). An output envelope 2617 shows the effect of passing the input signal 2614 through both the peak compressor 2502 and the punch unit 1720.

As shown in FIG. 26, assuming the amplitude of the input signal 2614 is sufficient to overdrive the amplifier or loudspeaker, the bass punch unit does not limit the maximum amplitude of the input signal 2614 and thus the output signal 2616 is also sufficient to overdrive the amplifier or loudspeaker.

The pulse compression unit 2502 used in connection with the signal 2617, however, compresses (reduces the amplitude of) large amplitude pulses. The compression unit 2502 detects the large amplitude excursion of the input signal 2614 and compresses (reduces) the maximum amplitude so that the output signal 2617 is less likely to overdrive the amplifier or loudspeaker.

Since the compression unit 2502 reduces the maximum amplitude of the signal, it is possible to increase the gain provided by the punch unit 1720 without significantly reducing the probability that the output signal 2617 will overdrive the amplifier or loudspeaker. The signal 2617 corresponds to an embodiment where the gain of the bass punch unit 1720 has been increased. Thus, during the long decay portion, the signal 2617 has a larger amplitude than the curve 2616.

As described above, the energy in the signals 2614, 2616, and 2617 is proportional to the area under the curve representing each signal. The signal 2617 has more energy because, even though it has a smaller maximum amplitude, there is more area under the curve representing the signal 2617 than either of the signals 2614 or 2616. Since the signal 2617 contains more energy, a listener will perceive more bass in the signal 2617.

Thus, the use of the peak compressor in combination with the bass punch unit 1720 allows the bass enhancement system to provide more energy in the bass signal, while reducing the likelihood that the enhanced bass signal will overdrive the amplifier or loudspeaker.

Peak compressors are known in the art. For example, a datasheet for the NE572 discussed above discloses a compression circuit (albeit a rather complicated circuit).

Figure 27:
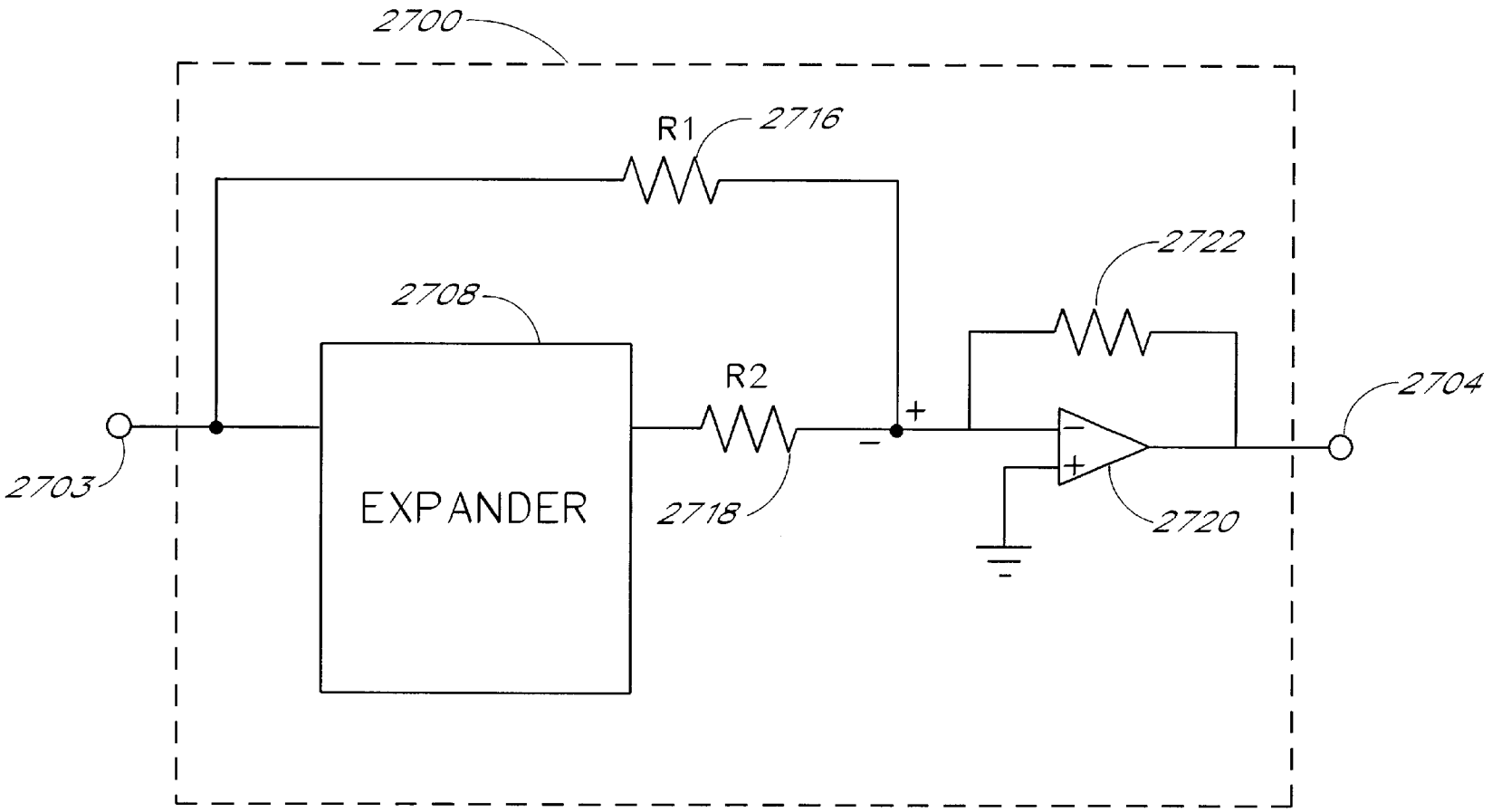
FIG. 27 is a circuit diagram of one embodiment of a peak compressor.

FIG. 27 is a block diagram of one embodiment of a peak compressor circuit 2700 having an input 2703 and an output 2704. The signal at the output 2704 is a compressed version of the signal at the input 2703. In a novel combination, the peak compressor 2700 provides compression by using an expander. The expander circuit used in the compressor 2700 is similar to the expander used for the bass punch circuit 2300.

In an expander, such as the expander shown in FIG. 24, the total (i.e., expanded) output signal is the sum of the input signal plus an expansion signal. As the amplitude of the input signal increases, then the amplitude of the expansion signal increases, and thus the output (the sum of the two) increases. By contrast, the output signal of the compressor 2700 is the input signal minus the expansion signal. As the input signal gets larger, the expansion signal gets larger as well, however, the difference between the two (the compressor output) gets smaller. This is the nature of a compressor, as the input signal gets larger, the apparent gain of the compressor is reduced. For input signals with a relatively small amplitude, the compressor has a relatively large gain. But, for input signals with a relatively large amplitude, the compressor has a relatively small gain.

In FIG. 27, the input 2703 is provided to an input of an inverting expander 2708 and to a first terminal of a resistor 2716. An output of the inverting expander 2708 is provided to a first terminal of a resistor 2718.

A second terminal of the resistor 2716 and a second terminal of the resistor 2718 are both provided to an inverting input of an op-amp 2720. A feedback resistor 2722 is connected between the inverting input of the op-amp 2720 and an output of the op-amp 2720. A non-inverting input of the op-amp 2720 is provided to ground. The output of the op-amp 2720 is provided to the output 2704.

The inverting expander 2708 is an expander having an expander input and an expander output that is inverted (negated) with respect to the expander input. A non-inverting expander may be used as well by passing the input (or the output) of the expander through an inverting amplifier. The attack and decay time constants preferably are similar to the attack and decay time constants of the bass punch unit 1720. In one embodiment, the expander 2708 comprises the expander 2300 shown in FIG. 24.

The inverting input of the op-amp 2720 is actually a summing junction where the input signal (provided through the resistor 2716) is "added" to the expanded signal (provided through the resistor 2718). Subtraction occurs at the summing junction because the output of the expander 2708 is negated with respect to the input of the expander. The output of the compressor 2700 is thus a weighted sum of the input signal (weighted by the resistor 2716) minus the expanded signal (weighted by the resistor 2718). Denoting the resistor 2716 as R1, and the resistor 2718 as R2, then typically R1 should be greater than R2.

Other Embodiments

While certain specific embodiments of the invention have been described, these embodiments have been presented by way of example only, and are not intended to limit the scope of the present invention. For example, the present invention is not limited to embodiments where the input channels are combined to produce a combined channel, which is then modified to produce enhanced bass. No combination of channels is required, and the enhancement signal processing may be performed on the separate input channels. Various embodiments used biquad and Chebychev filters, however, the invention is not limited to these filter alignments. Thus, other filter alignments may be used as well. Further, the filtering may be accomplished by using combinations of lowpass and highpass filters rather than the bandpass filters described. Accordingly, the breadth and scope of the present invention should be defined only in accordance with the following claims and their equivalents.

What is claimed is:

1. An audio system for processing left and right stereo signals containing audio information intended for reproduction by left and right loudspeakers, said left and right loudspeakers capable of reproducing midbass and higher frequencies more accurately than bass frequencies, said audio system configured to enhance the reproduction of bass information by said left and right loudspeakers, said audio system comprising:

a left audio signal and a right audio signal;

a first electronic adder which combines said left and right audio signals to create a mono signal, said mono signal having a set of bass frequencies and a set of midbass frequencies;

a first filter in communication with said first electronic adder, said first filter configured to select said midbass frequencies;

a compressor in communication with said first filter, said compressor configured to control an amplitude of said midbass frequencies according to a forward gain of said compressor, wherein control of said forward gain of said compressor is based at least in part on an envelope of said midbass frequencies provided to an input of said compressor such that an increase in an amplitude of said envelope tends to reduce said forward gain of said compressor;

a bass punch unit in communication with said compressor, said bass punch unit configured to shape said midbass frequencies to produce a modified mono signal, said modified mono signal configured to enhance the perceived bass of said system when said midbass frequencies are reproduced on right and left loudspeakers, said bass punch unit having a punch forward gain, wherein control of said punch forward gain is based at least in part on an envelope of an input provided to said bass punch unit such that an increase in an amplitude of said envelope tends to increase said punch forward gain;

a second electronic adder which combines said modified mono signal with said left audio signal to create a modified left output signal; and a third electronic adder which combines said modified mono signal with said right audio signal to create a modified right output signal, wherein said modified right output signal and said modified left output signal drive said left and right loudspeakers.

2. The audio enhancement system of claim 1, wherein said fire filter comprises a plurality of bandpass filters.

3. The audio enhancement system of claim 2, wherein outputs of two or more of said bandpass filters are combined.

4. The audio enhancement system of claim 2, wherein said bass punch unit comprises an automatic gain control.

5. The audio enhancement system of claim 1, wherein a gain of said bass punch unit is responsive to an envelope of said midbass frequencies.

6. The audio enhancement system of claim 5, wherein said bass punch unit modifies said midbass frequencies in response to said envelope.

7. An apparatus for enhancing audio, comprising:

an input signal;

a filter to select a selected portion of said input signal, said selected portion having an envelope portion and a modulated portion;

a signal processor having an input configured to receive said selected portion and to modify an amplitude of said selected portion in response to said envelope portion to produce a modified signal; and a combiner to combine said modified signal with said input signal to produce an output signal.

8. An apparatus for enhancing audio, comprising:

a first combiner to combine at least a portion of a first signal with at least a portion of a second signal to create a combined signal;

a first signal processor configured to select a portion of said combined signal to produce a selected signal;

a second signal processor configured to modify an amplitude of said selected signal in response to at least a portion of an envelope of said selected signal to produce a modified signal a second combiner to combine said modified combined signal with said first signal to produce a first output signal; and a third combiner to combine said modified combined signal with said second signal to produce a second output signal.

9. The apparatus of claim 8, wherein said second signal processor comprises an automatic gain control.

10. The apparatus of claim 8, wherein said second signal processor enhances frequencies in a second frequency range relative to frequencies in a first frequency range.

11. The apparatus of claim 8, wherein said first signal processor comprises a plurality of filters.

12. The apparatus of claim 8, wherein said first signal processor comprises a plurality of bandpass filters.

13. The apparatus of claim 8, wherein said second signal processor comprises an expander with a gain that increases at a rate related to an attack time constant.

14. The apparatus of claim 13, wherein said gain decreases at a rate related to a decay time constant.

15. The apparatus of claim 14, wherein said attack time constant is longer than said decay time constant.

16. The apparatus of claim 14, wherein said attack time constant is approximately 5–50 milliseconds.

17. The apparatus of claim 8, wherein said second signal processor comprises an expander.

18. The apparatus of claim 8, wherein said second signal processor comprises a compressor.

19. The apparatus of claim 18, wherein said compressor comprises an expander.

20. The apparatus of claim 19, wherein said compressor further comprises a combiner, said combiner configured to combine an output of said expander and an input of said expander to produce a compressed signal.

21. The apparatus of claim 8, wherein said second signal processor comprises a compressor and an expander.

22. The apparatus of claim 8, wherein said first signal processor comprises a switch, said switch having a first position and a second position, said first position configured to select at least a first portion of said combined signal to produce said selected signal, said second position configured to select at least a second portion of said combined signal to produce said selected signal.

23. The apparatus of claim 8, wherein said first signal processor comprises a switch, said switch configured to select an output of one or more bandpass filters to produce a portion of said selected signal.

24. An apparatus for enhancing audio data, comprising:

a first combiner module to combine at least a portion of a first audio data stream with at least a portion of a second audio data stream to create a combined data stream which has a first set of frequencies and a second set of frequencies;

a first processing module configured to process said combined data stream to produce a first processed data stream;

a bass processing module configured to modify an amplitude of said first processed data stream according to at least a portion of a waveform envelope of said first processed data stream to produce a bass-enhanced data stream; and a second combiner module to combine said bass-enhanced data stream with said first audio data stream to produce an output data stream.

25. The apparatus of claim 24, further comprising a second processing module configured to process said first audio data stream before combining said first audio data stream with said bass enhanced data stream.

26. The apparatus of claim 25, wherein said second processing module comprises a highpass filter.

27. The apparatus of claim 25, wherein said second processing module comprises a lowpass filter.

28. The apparatus of claim 25, wherein said second processing module comprises a bandpass filter.

29. The apparatus of claim 24, wherein said first processing module comprises a highpass filter.

30. The apparatus of claim 24, wherein said first processing module comprises a lowpass filter.

31. The apparatus of claim 24, wherein said first processing module comprises a bandpass filter.

32. The apparatus of claim 24, wherein said first processing module comprises an analog filter.

33. The apparatus of claim 24, wherein said first processing module comprises a digital filter.

34. The apparatus of claim 24, wherein said first audio data stream comprises an analog signal.

35. An apparatus for enhancing audio, comprising:

a first combiner configured to combine at least a portion of a first signal with at least a portion of a second signal to create a combined signal which has a first set of frequencies and a second set of frequencies;

a signal processor configured to modify said second set of frequencies in said combined signal to produce a modified combined signal capable of creating the perception that said second set of frequencies contains at least some of said first set of frequencies, said signal processor comprising a plurality of bandpass filters driving a gain-controlled amplifier, a forward gain of said gain-controlled amplifier responsive to an amplitude of an envelope of said combined signal; and a second combiner to combine said modified combined signal with said first signal to produce an output signal.

36. A method for enhancing bass in an audio signal, comprising the acts of:

providing a multi-channel audio signal;

combining said multi-channel audio signal to produce a combined audio signal;

isolating low-frequency content of said combined audio signal;

bandpass filtering said low-frequency content to create a filtered signal;

amplifying said filtered signal in a gain-controlled amplifier to produce an amplified signal, where a gain of said gain-controlled amplifier is related to an envelope of said filtered signal according to an attack time constant and a decay time constant; and generating a multi-channel simulated low-frequency signal by combining together said multi-channel audio signal and said amplified signal.

37. The method of claim 36, wherein said step of filtering comprises filtering said low-frequency content in a plurality of bandpass filters.

38. The method of claim 37, wherein said act of filtering further comprises weighting an output of each of said bandpass filters.

39. The method of claim 37, wherein said step of amplifying comprises compressing said filtered signal.

40. The method of claim 39, wherein said step of amplifying further comprises expanding said filtered signal.

41. A method for enhancing bass in an audio signal, comprising the acts of:

providing an audio signal;

selecting low-frequency content of said audio signal to produce a filtered signal;

compressing said filtered signal to produce a compressed signal by passing said filtered signal through a first gain-controlled module having a first gain, wherein said first gain is controlled at least in part by an amplitude of an envelope of said filtered signal such that an increase in said amplitude of said envelope of said filtered signal tends to reduce said first gain;

expanding said compressed signal to produce an expanded signal by passing said compressed signal through a second gain-controlled module having a second gain, wherein said second gain is controlled at least in part by an amplitude of an envelope of said compressed signal such that an increase in said amplitude of said envelope of said compressed signal tends to increase said second gain; and generating a simulated low-frequency signal by combining together said audio signal and said expanded signal.

42. A bass enhancement system, comprising:

means for selecting low-frequency content of an audio signal to produce a filtered signal;

means for expanding said filtered signal to produce an expanded signal by gain-controlled amplifying said filtered signal according to a controlled gain, wherein said controlled gain is controlled at least in part by an amplitude of an envelope of said filtered signal such that an increase in said amplitude of said envelope of said filtered signal tends to increase said controlled gain; and means for generating a simulated low-frequency signal by combining together said audio signal and said expanded signal.

* * * * *

UNITED STATES PATENT AND TRADEMARK OFFICE

CERTIFICATE OF CORRECTION

PATENT NO. : 6,285,767 B1
DATED : September 4, 2001
INVENTOR(S) : Arnold I. Klayman It is certified that error appears in the above-identified patent and that said Letters Patent is hereby corrected as shown below:

Column 33,
Line 29, change "fire filter" to -- first filter --.

Signed and Sealed this

Twenty-first Day of May, 2002

*Attest:*

*Attesting Officer*

JAMES E. ROGAN
*Director of the United States Patent and Trademark Office*